US007626119B2

(12) United States Patent
Axland et al.

(10) Patent No.: US 7,626,119 B2
(45) **Date of Patent: *Dec. 1, 2009**

(54) MOUNTABLE POWER STRIPS

(75) Inventors: Mark Axland, Charlotte, NC (US); Cheryl Axland, Charlotte, NC (US); Kevin J. Dahlquist, Charlotte, NC (US); Daniel Lee Bizzell, Davidson, NC (US); Ian D. Kovacevich, Charlotte, NC (US)

(73) Assignee: Axland Comec, LLC, Charlotte, NC (US)

( * ) Notice: Subject to any disclaimer, the term of this patent is extended or adjusted under 35 U.S.C. 154(b) by 388 days.

This patent is subject to a terminal disclaimer.

(21) Appl. No.: 11/746,040

(22) Filed: May 8, 2007

(65) Prior Publication Data

US 2008/0066943 A1 Mar. 20, 2008

Related U.S. Application Data

(60) Provisional application No. 60/746,757, filed on May 8, 2006.

(51) Int. Cl.
*H01H 9/02* (2006.01)

(52) U.S. Cl. ..... 174/53; 174/135; 439/652; 439/655; 362/806

(58) Field of Classification Search ..... 174/53, 174/135; 439/115, 121, 652, 574, 650, 653, 439/640, 655, 651, 170; 362/806; D13/39.8, D13/160

See application file for complete search history.

(56) References Cited

U.S. PATENT DOCUMENTS 1,891,341 A 12/1932 Barocas
2,047,045 A 7/1936 Veenboer
2,230,900 A 2/1941 Neitzke
2,453,695 A 11/1948 Belling
2,465,419 A 3/1949 Barany
2,474,356 A 6/1949 Harris
2,533,222 A 12/1950 Cohen
2,759,095 A 8/1956 Kline
3,049,688 A 8/1962 Sinopoli
3,662,319 A 5/1972 Culver
3,723,723 A 3/1973 Lerner
D226,856 S 5/1973 Leto et al.

(Continued)

OTHER PUBLICATIONS

Information Disclosure Statement (IDS) Letter Regarding Common Patent Application(s), submitted by Applicant on Feb. 11, 2009.

(Continued)

*Primary Examiner*—Dhiru R Patel
(74) *Attorney, Agent, or Firm*—Tillman Wright, PLLC; Chad D. Tillman; Jeremy C. Doerre

(57) ABSTRACT

Various new designs for a power strip. Each design includes some structure that enables the mounting or attachment of the power strip to an object or portion of the object. The object may include, for example, a Christmas tree, such as the trunk or a branch thereof. Another object may includes, for example: a portion of a stud in the frame of a building that is under construction, in which case the power strip may be plugged into a generator at the construction site; and a portion of a work bench or work table.

19 Claims, 91 Drawing Sheets

U.S. PATENT DOCUMENTS

| | | | | |
|---|---|---|---|---|
| D227,371 | S | 6/1973 | Leto et al. | |
| 3,752,407 | A | 8/1973 | Baugh et al. | |
| 3,770,951 | A | 11/1973 | Corelli et al. | |
| 4,099,824 | A | 7/1978 | Schoppelrey | |
| 4,174,532 | A | 11/1979 | Kelley | |
| 4,764,128 | A | 8/1988 | Cheng | |
| 4,875,878 | A | 10/1989 | Meyer | |
| 5,150,963 | A | 9/1992 | Hill | |
| 5,306,165 | A | 4/1994 | Nadeau | |
| 5,422,801 | A | 6/1995 | Sangalli | |
| D365,803 | S | 1/1996 | Boesel et al. | |
| 5,486,650 | A * | 1/1996 | Yetter | 174/53 |
| D366,865 | S | 2/1996 | Stringer | |
| D381,315 | S | 7/1997 | Harold | |
| D397,086 | S | 8/1998 | Lin | |
| D400,414 | S | 11/1998 | Wilson et al. | |
| 5,904,591 | A | 5/1999 | Shiau | |
| 5,964,618 | A | 10/1999 | McCarthy | |
| D425,482 | S | 5/2000 | Rossman et al. | |
| D425,863 | S | 5/2000 | Yu | |
| D428,598 | S | 7/2000 | Carter-Williams et al. | |
| D433,318 | S | 11/2000 | Chang | |
| D436,922 | S | 1/2001 | Stekelenburg | |
| D437,582 | S | 2/2001 | Stekelenburg | |
| 6,243,257 | B1 | 6/2001 | Ester | |
| D455,951 | S | 4/2002 | Kozyra et al. | |
| D458,590 | S | 6/2002 | Wilson et al. | |
| 6,443,772 | B1 * | 9/2002 | Chen | 439/652 |
| D467,875 | S | 12/2002 | Barger et al. | |
| 6,540,554 | B2 | 4/2003 | McCarthy | |
| 6,581,890 | B2 | 6/2003 | Johnson et al. | |
| D481,623 | S | 11/2003 | Chen | |
| 6,663,435 | B2 | 12/2003 | Lincoln, III et al. | |
| 6,666,712 | B1 * | 12/2003 | Kramer | 439/501 |
| D490,777 | S | 6/2004 | Yu | |
| 6,764,322 | B1 | 7/2004 | Yu | |
| D508,230 | S | 8/2005 | Loftus et al. | |
| 6,933,447 | B1 | 8/2005 | Marc | |
| 7,034,224 | B2 * | 4/2006 | Kim et al. | 174/53 |
| D521,452 | S | 5/2006 | Mori et al. | |
| 7,052,314 | B1 * | 5/2006 | Rose | 439/539 |
| 7,148,419 | B1 | 12/2006 | Harrigan | |
| 7,164,082 | B2 * | 1/2007 | Kurek et al. | 174/53 |
| 7,186,146 | B1 | 3/2007 | Chang et al. | |
| 7,223,122 | B2 | 5/2007 | Mori | |
| D549,657 | S | 8/2007 | Ng | |
| 7,347,734 | B1 | 3/2008 | Teitelbaum | |
| 7,394,019 | B2 | 7/2008 | Gesue | |
| 7,435,901 | B2 | 10/2008 | Mori et al. | |
| 7,442,090 | B2 | 10/2008 | Mori et al. | |
| 2008/0261455 | A1 | 10/2008 | Axland et al. | |
| 2008/0261456 | A1 | 10/2008 | Axland et al. | |
| 2008/0268715 | A1 | 10/2008 | Axland et al. | |
| 2008/0277133 | A1 | 11/2008 | Axland et al. | |

OTHER PUBLICATIONS

Information Disclosure Statement (IDS) Letter Regarding Common Patent Application(s), submitted by Applicant on Jun. 3, 2009.

* cited by examiner

1110

1110

1110

1110

1110

22000

22000

22000

22000'

22000'

22000'

22000'

MOUNTABLE POWER STRIPS

I. CROSS-REFERENCE TO RELATED APPLICATION

The present application is a U.S. nonprovisional patent application of, and claims priority under 35 U.S.C. § 119(e) to, U.S. provisional patent application Ser. No. 60/746,757, filed May 8, 2006, which provisional patent application is incorporated by reference herein.

II. COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

III. BACKGROUND OF THE INVENTION

The present invention generally relates to various new designs for power strips and, in particular, to designs for a power strip that includes structure that facilitates the mounting or attachment of the power strip to an object.

IV. SUMMARY OF THE INVENTION

The present invention includes many aspects and features. Moreover, while certain aspects and features relate to, and are described in, the context of the mounting or attaching of a power strip to a tree and, in particular, to a Christmas Tree, the present invention is not limited to use only with trees. Indeed, as will become apparent from the following, power strips of the present invention have broad applicability and can be mounted or attached to many different objects and structures apart from trees. It further should be noted that the present invention encompasses the various possible combinations of aspects and features of the various embodiments of the present invention disclosed herein.

V. BRIEF DESCRIPTION OF THE DRAWINGS

A plurality of preferred embodiments of the present invention now will be described in detail with reference to the accompanying drawings, wherein the same elements are referred to with the same or similar reference numerals, and wherein:

FIG. 1 shows an environmental view of the power strip 10 in accordance with the first illustrated embodiment. In FIG. 1, the power strip 10 is shown mounted to the trunk of a Christmas tree, which is illustrated in phantom. Christmas tree lights, also illustrated in phantom, are shown plugged into the power strip 10.

FIG. 2 shows the power strip 10 disposed with arm sections 20,30 in an intermediate position relative to one another.

FIG. 3 shows the power strip 10 disposed with arm sections 20,30 in an open position, which is obtained by the pressing of a release member 280 in the direction of the arrow A.

FIG. 4 shows the power strip 10 disposed with its arm sections 20,30 in a closed position.

FIG. 5 shows a perspective view of a component 240 of the power strip 10 that includes biasing elements 230 and teeth elements 200.

Figure 5:
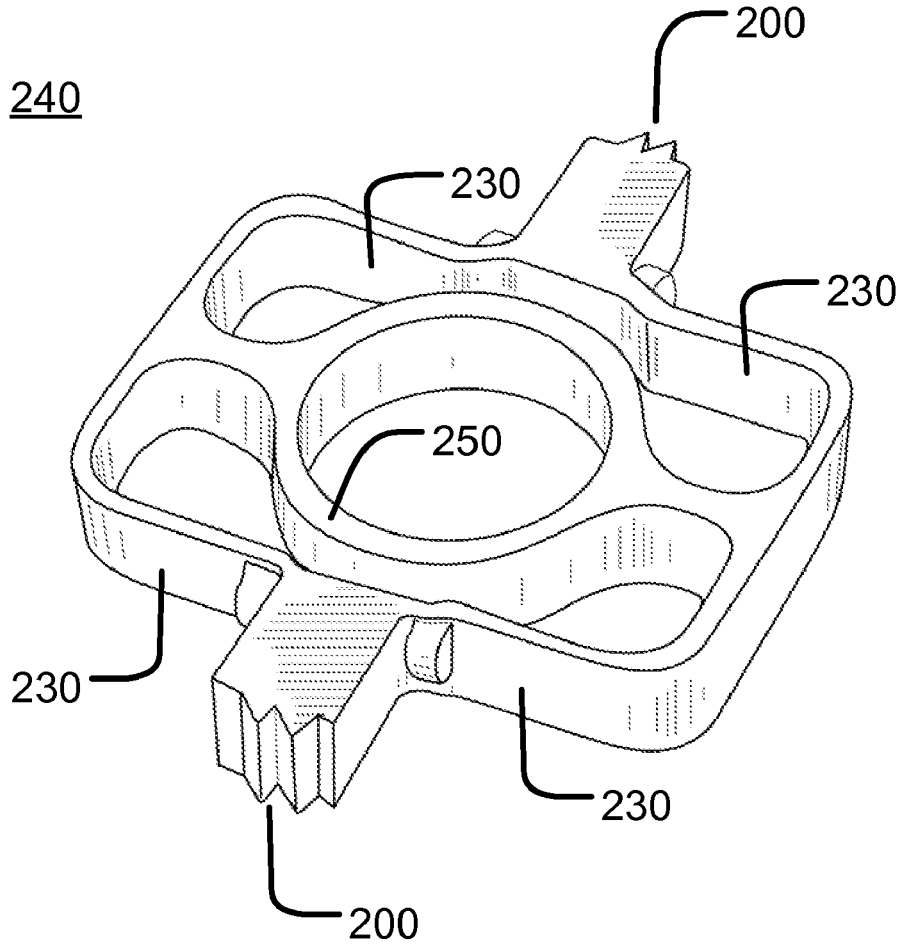
Figure 6:
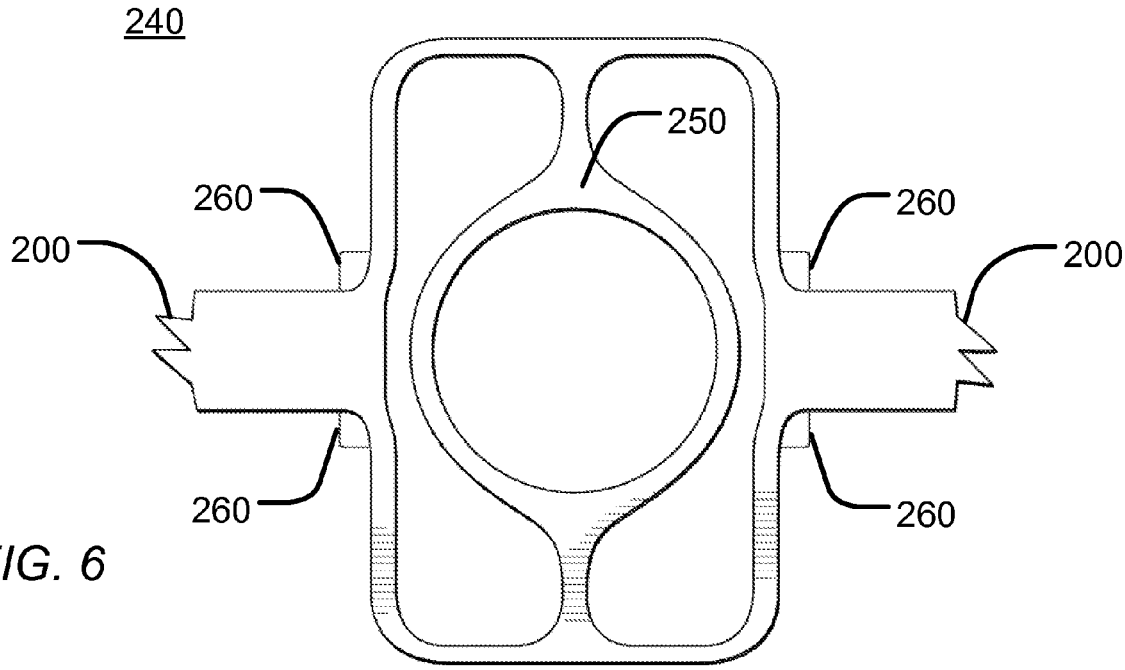
FIG. 6 shows a top plan view of the component 240 of FIG. 5.
Figure 7:
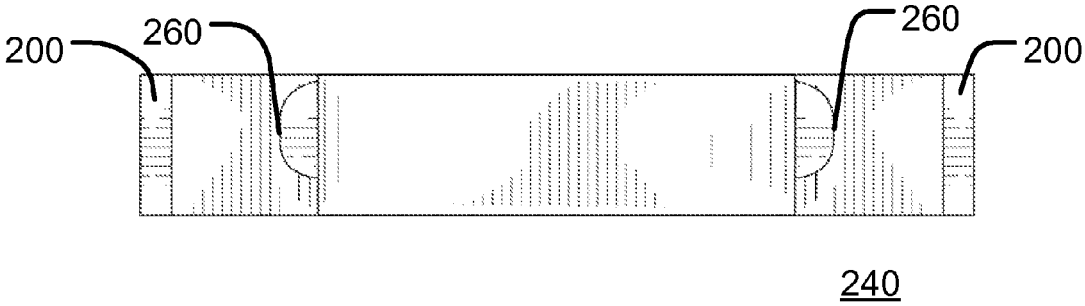
FIG. 7 shows a side plan view of the component 240 of FIG. 5.
Figure 8A:
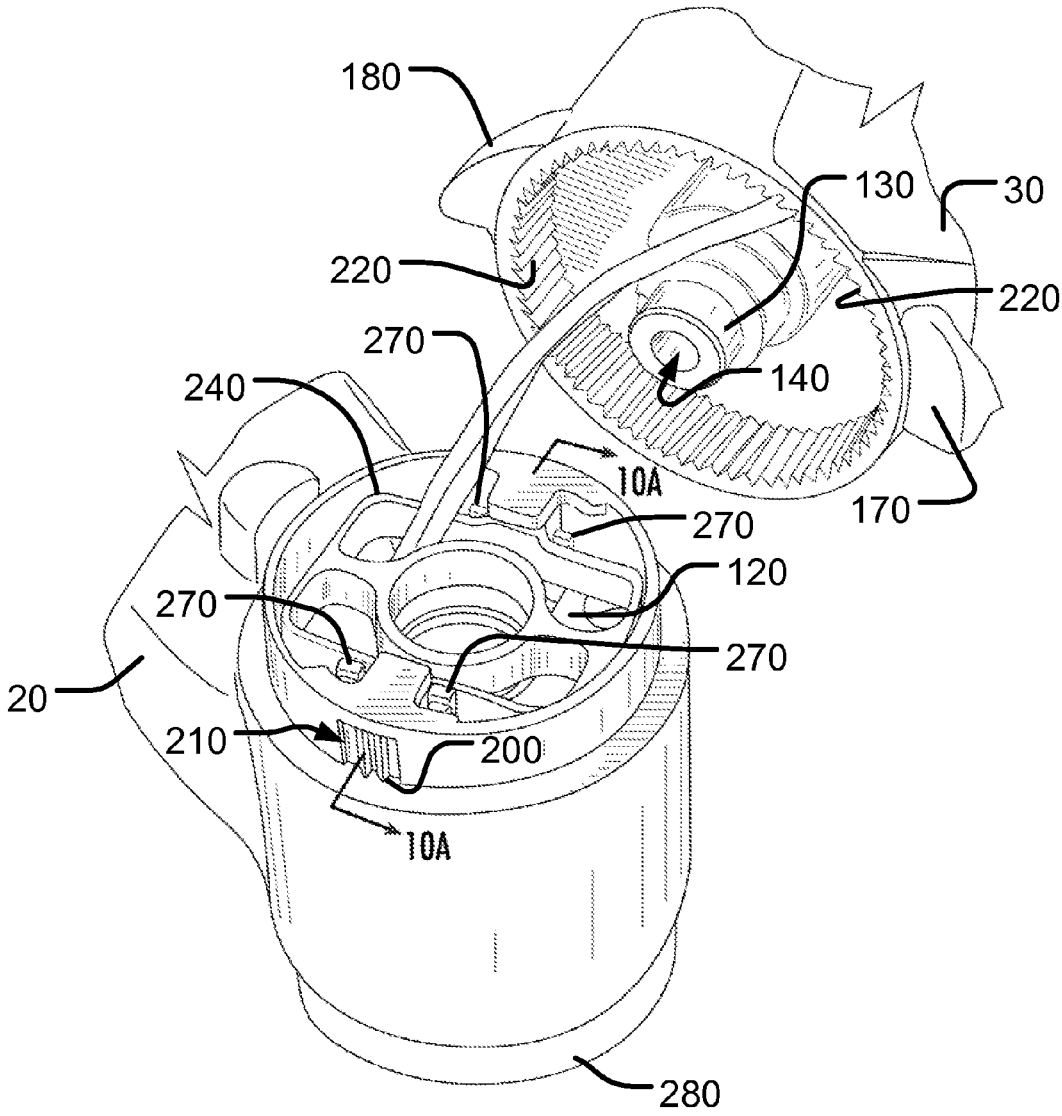

FIG. 8A shows the disposition of the component 240 of FIG. 5 when assembled with other components of the power strip 10, wherein the teeth elements 200 of the component 240 of FIG. 5 are in a protracted state.

Figure 8B:
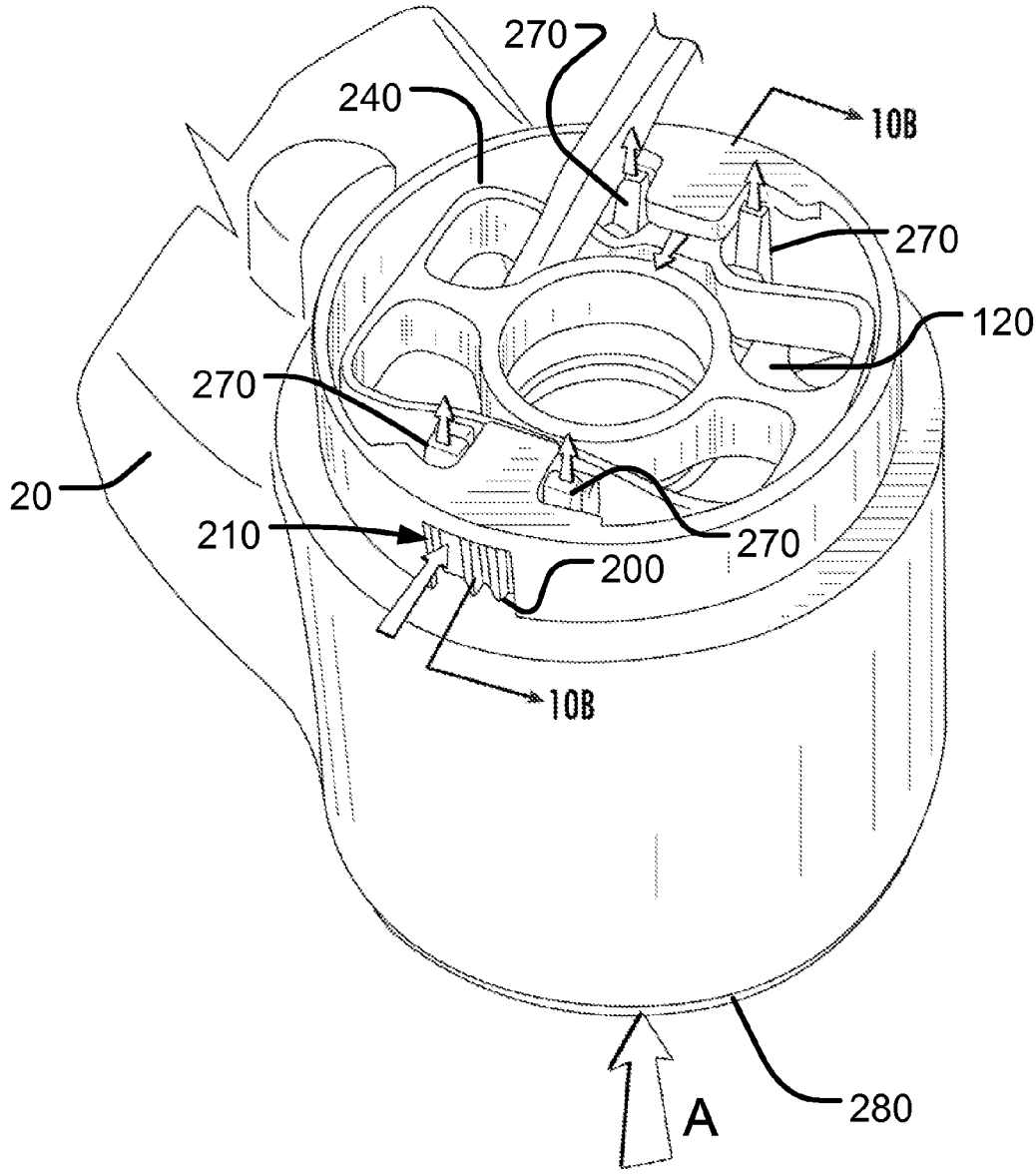

FIG. 8B shows the disposition of the component 240 of FIG. 5 relative to the other components of the power strip 10 when the release member 280 is depressed, wherein the teeth elements 200 of the component 240 of FIG. 5 are displaced into a retracted state.

Figure 1:
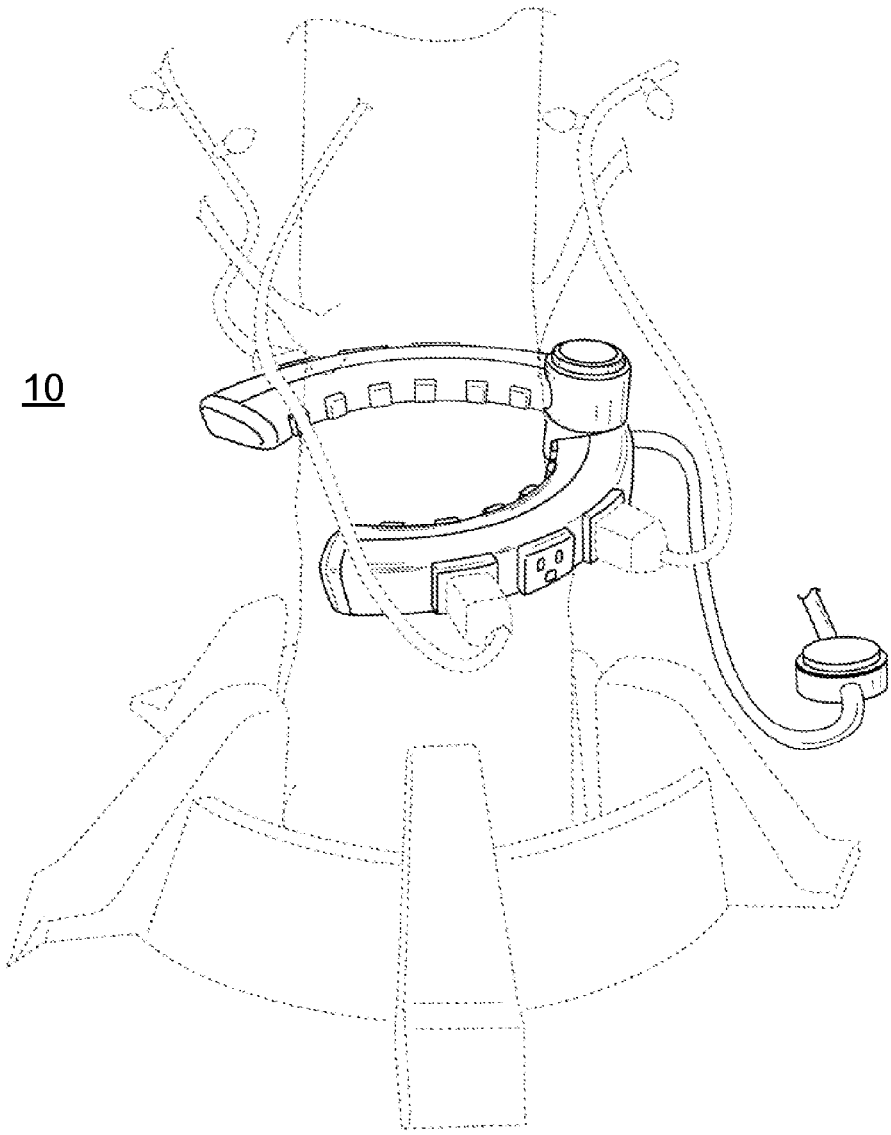
Figure 2:
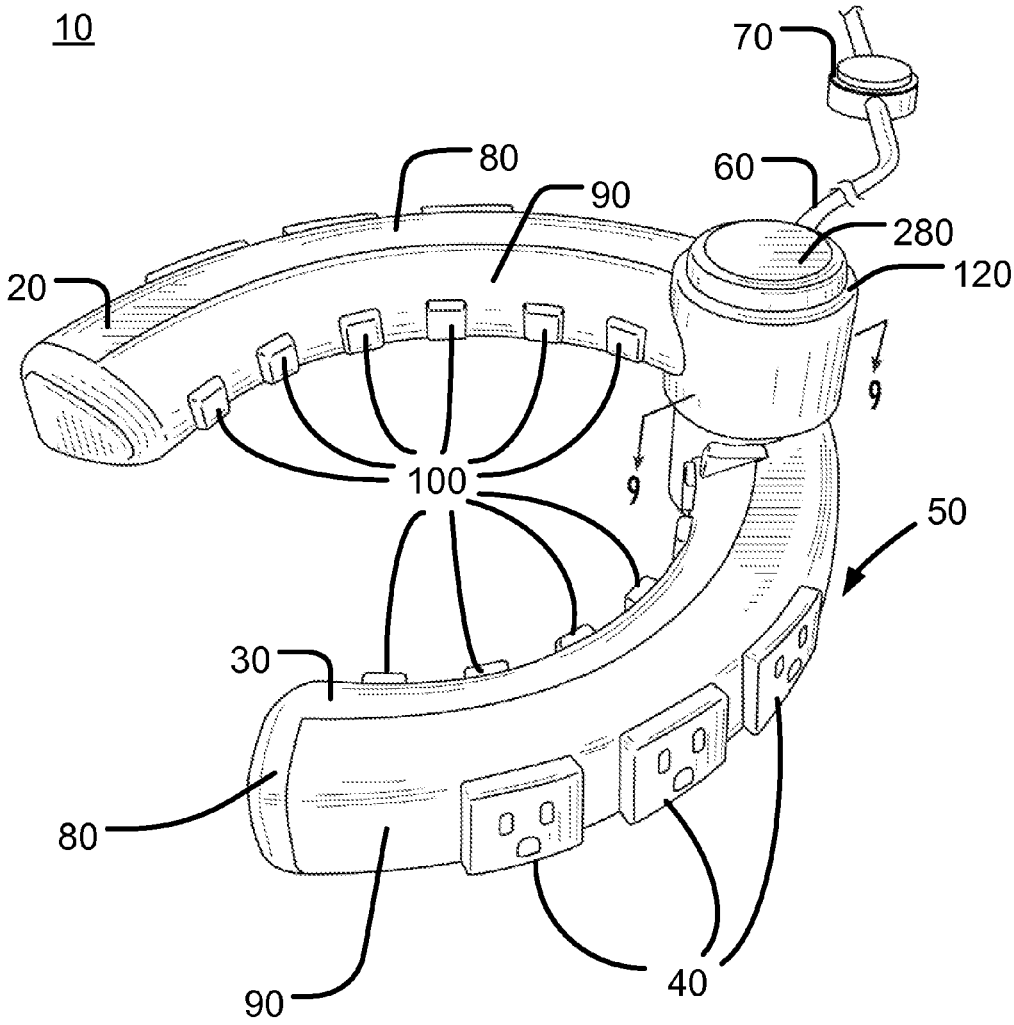
Figure 9:
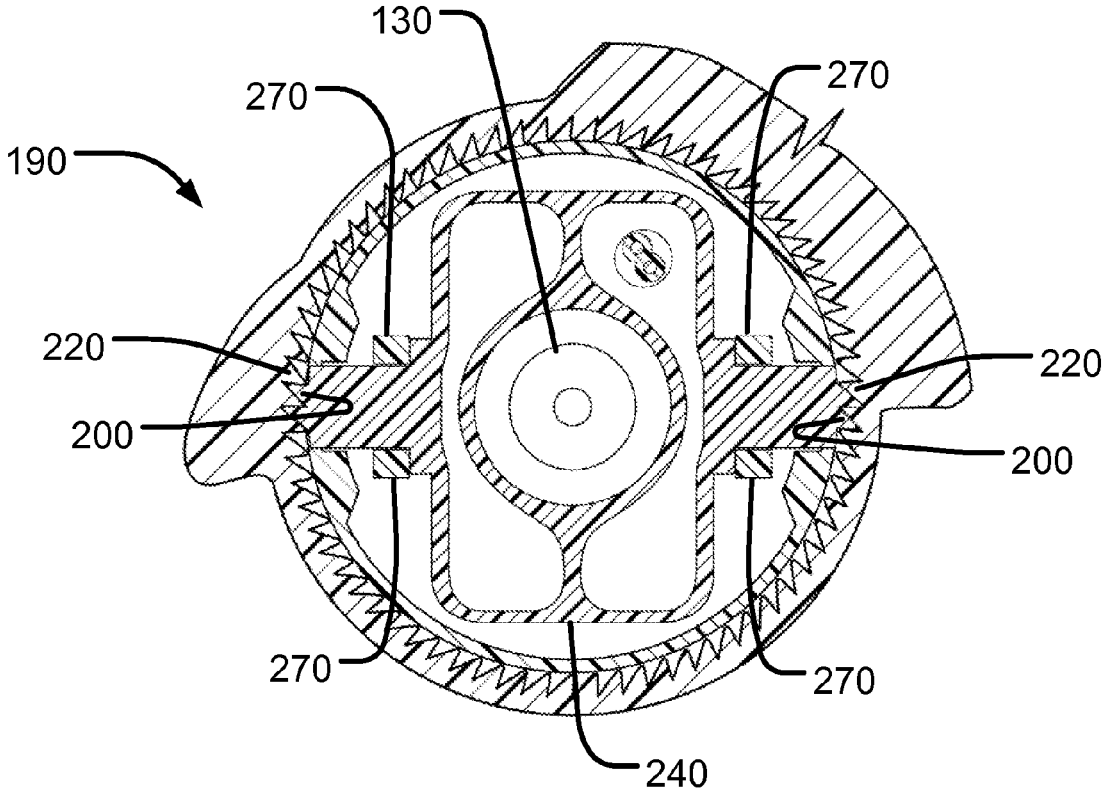

FIG. 9 shows a cross-sectional view of the power strip 10 taken along the line 9-9 of FIG. 2.

Figure 10A:
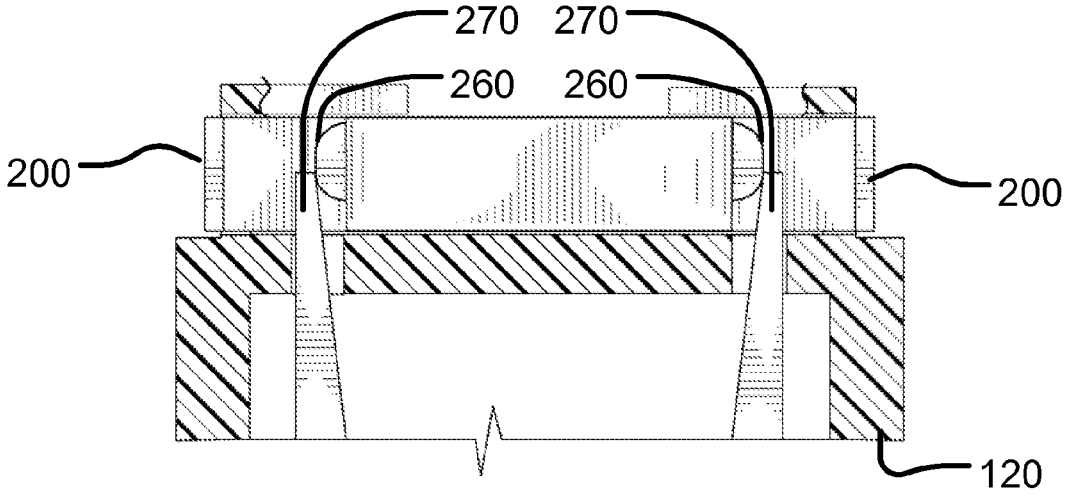

FIG. 10A shows a partial cross-sectional view of components of the power strip 10 when the teeth elements 200 of the component 240 of FIG. 5 are in a protracted state.

Figure 10B:
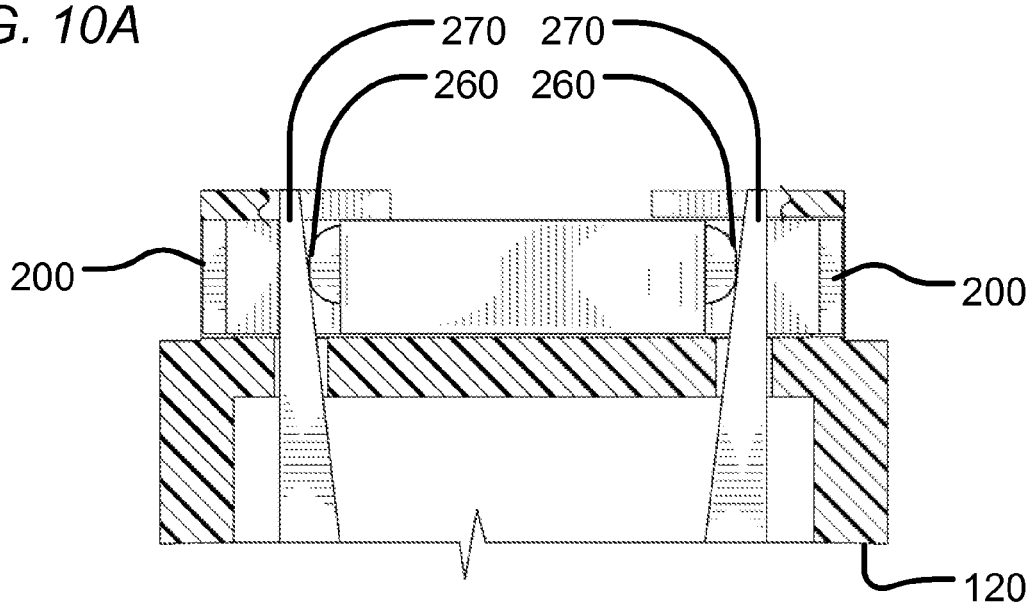
Figure 11:
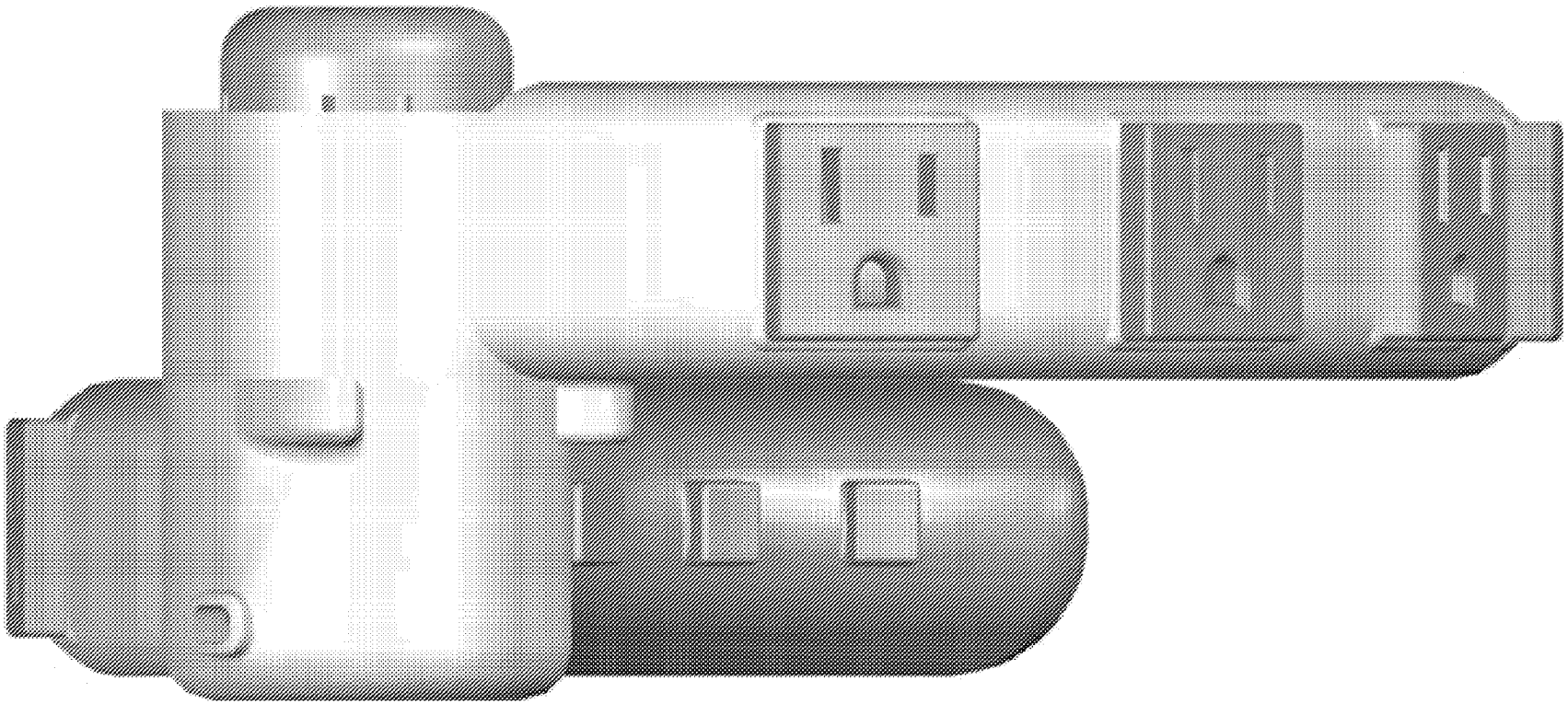
Figure 12:
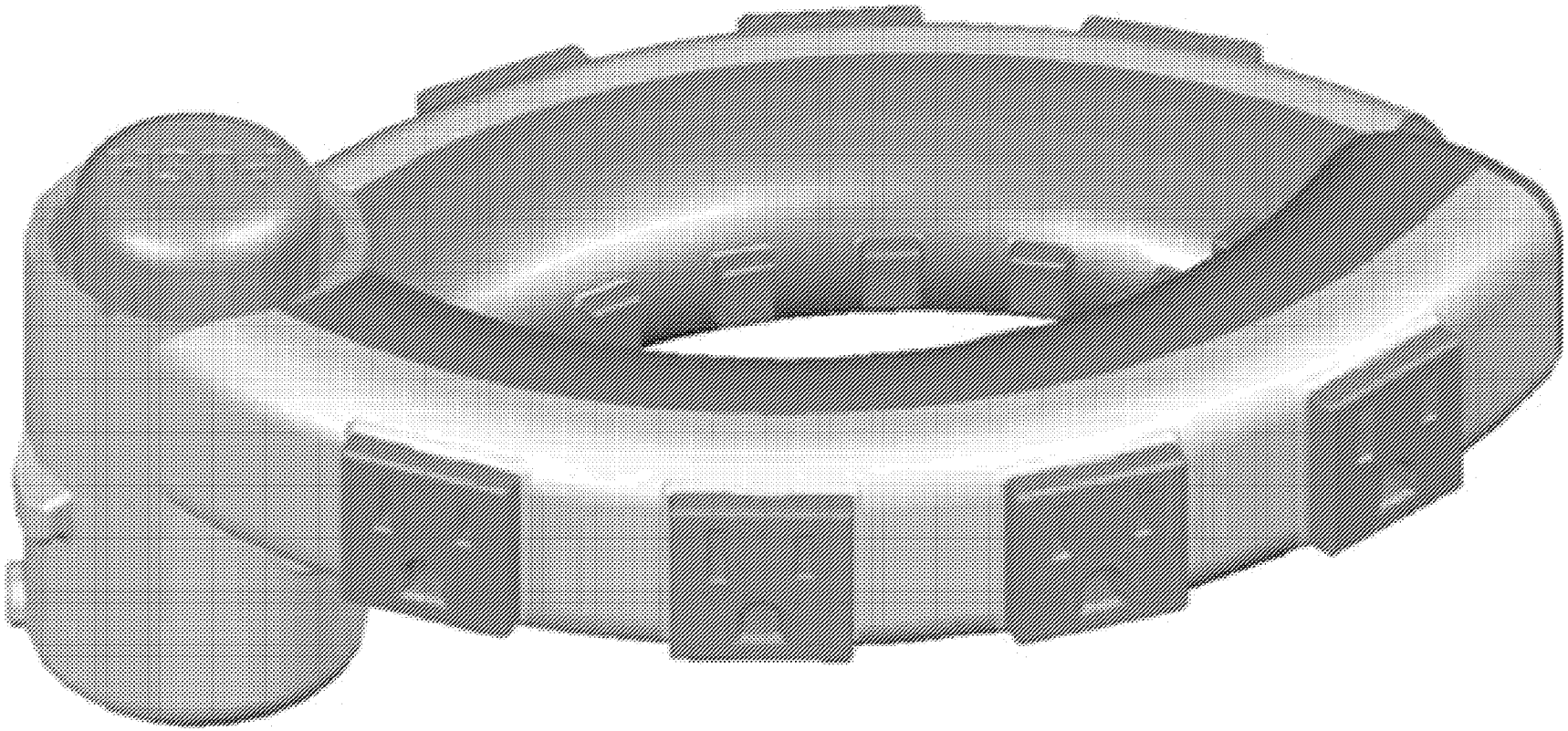

FIG. 10B shows a similar partial cross-sectional view of components of the power strip 10 when the teeth elements 200 of the component 240 of FIG. 5 are in a retracted state.

FIGS. 11-18 illustrate another power strip in accordance with another embodiment of the invention.

FIGS. 19-25 illustrate a power strip in accordance with a third embodiment of the invention.

Figure 26:
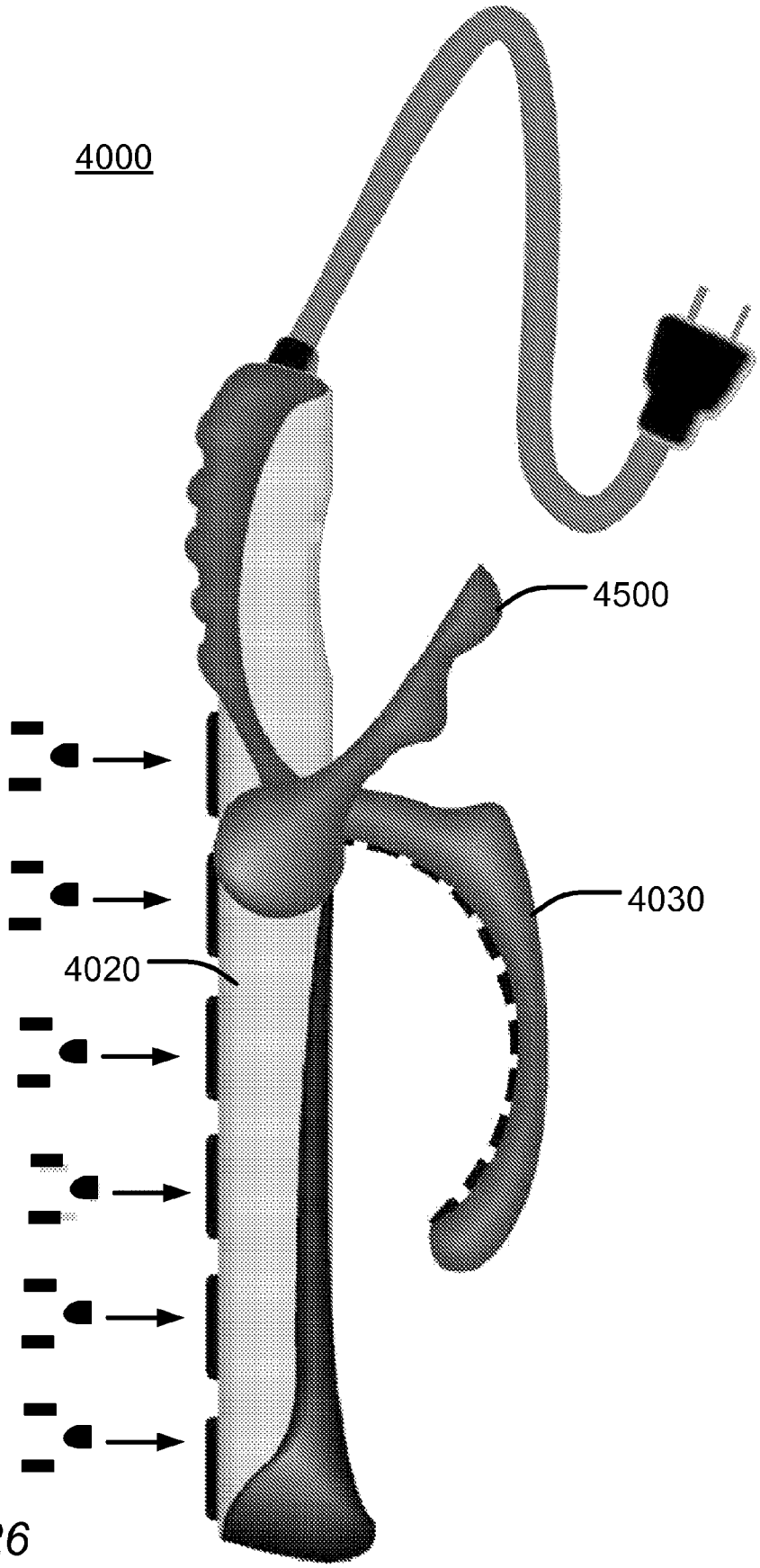
Figure 90:
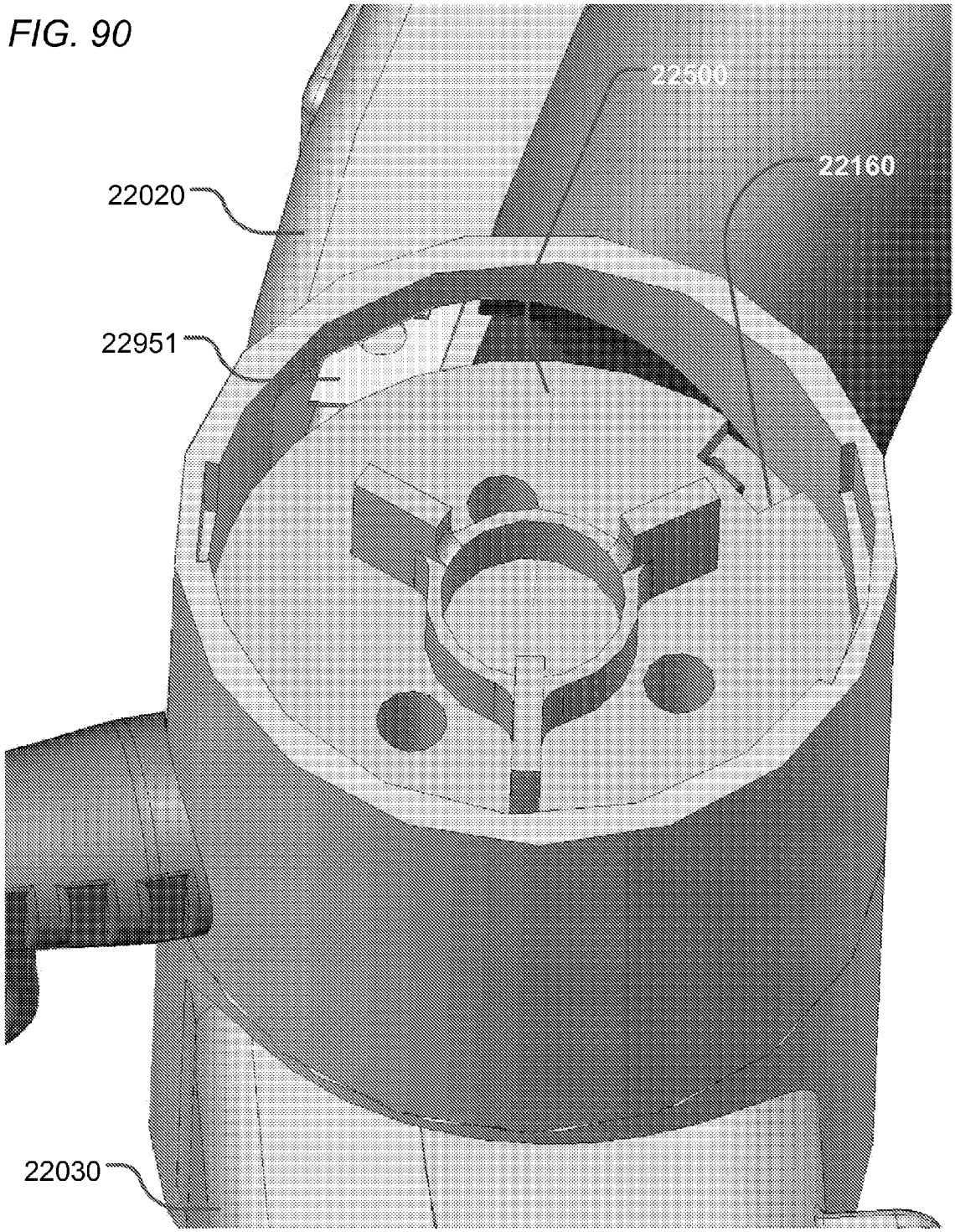

FIGS. 26-90 illustrate additional power strips and components thereof in accordance with more embodiments of the invention.

VI. DETAILED DESCRIPTION

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

A. First Illustrated Embodiment

Turning now to the drawings and, in particular to FIGS. 1-10B, a power strip 10 in accordance with a first illustrated embodiment is described. The power strip 10 generally comprises the following main components: a plurality of arm sections 20,30; a coupling assembly 110; and a ratcheting assembly 190.

1. Arm Sections

The arm sections of the first illustrated embodiment comprise a first arm section 20 and a second arm section 30. Each of the arm sections 20,30 includes standard three-prong electrical receptacles 40 into which electrical plugs may be individually inserted for powering lights conventionally used on a Christmas tree. For example, each arm section 20,30 as shown in the power strip 10 of the first illustrated embodiment includes three electrical receptacles 40. The electrical receptacles 40 of a respective arm section 20,30 are positioned adjacent each other along a curved length of the respective arm section to define a row or "strip" 50 of electrical receptacles 40. Internal wiring extends through the coupling assembly 110 and arm sections 20,30 for supplying each row 50 of receptacles 40 with power. A main power cord 60 of the power strip 10 supplies power to the internal wiring and each of the rows of electrical receptacles. The main power cord 60 extends from the second arm section 30 of the power strip 10 to a standard electrical outlet of a building (not shown). A floor switch 70 optionally is provided for turning on and off of the power strip 10 by depressing of a button of the floor switch. As the floor switch 70 is disposed on the floor, the floor switch 70 may be operable with a foot. The floor switch 70 also may be illuminated when power is provided to the power strip 10.

Each of the arm sections 20,30 includes a rigid, arcuate portion 80 that is formed from a hard material through one or more molding processes. The molding processes may include injection molding, rotational molding, and/or blow molding. Each arm section 20,30 also includes an outer resilient portion 90 that is elastic and capable of resuming its prior shape after deformation. This resilient portion 90 of each arm section 20,30 preferably comprises an over molded portion having resilient protuberances 100 for tensioned gripping. The tensioned gripping results from compression of the resilient protuberances 100 that occurs when the arm sections 20,30 are forced into a closed position about an object upon which the power strip 10 is to be mounted.

2. Coupling Assembly

Figure 3:
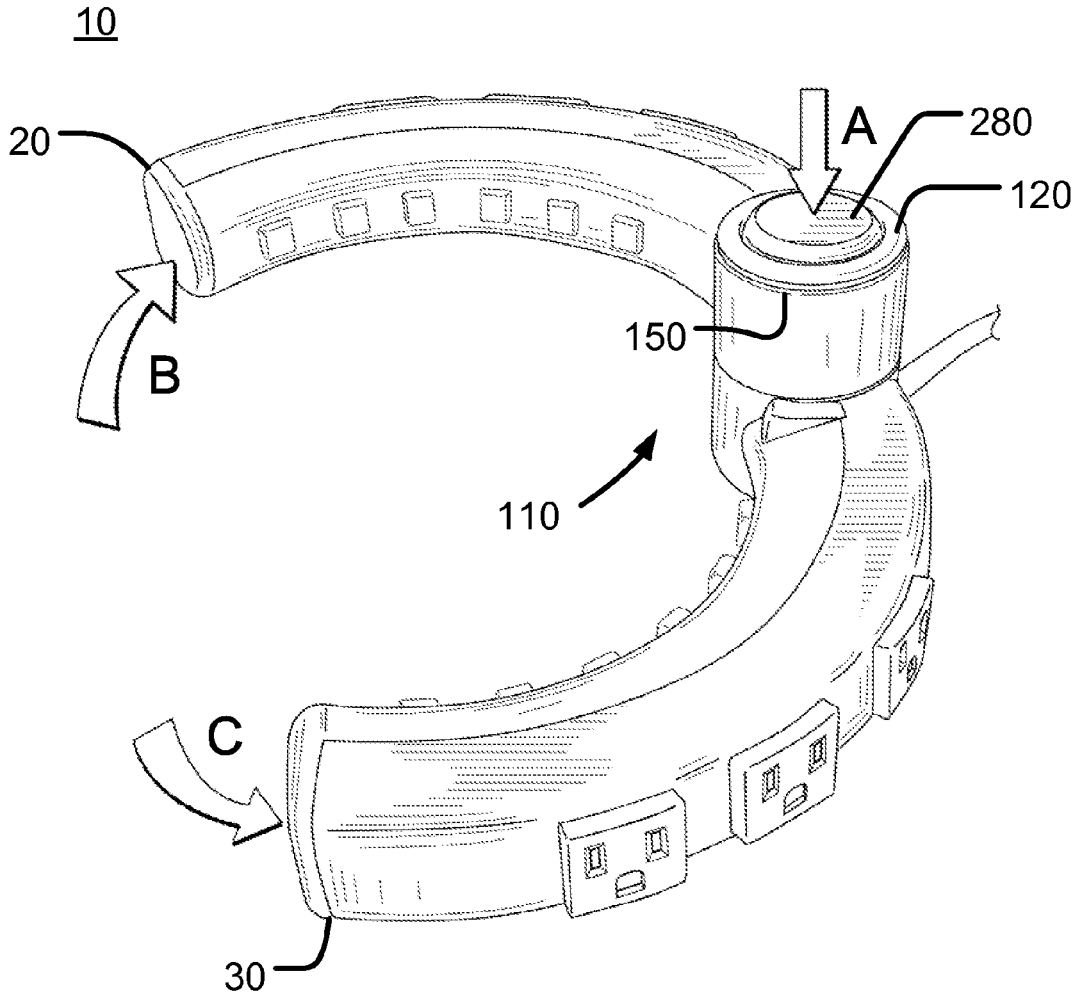
Figure 4:
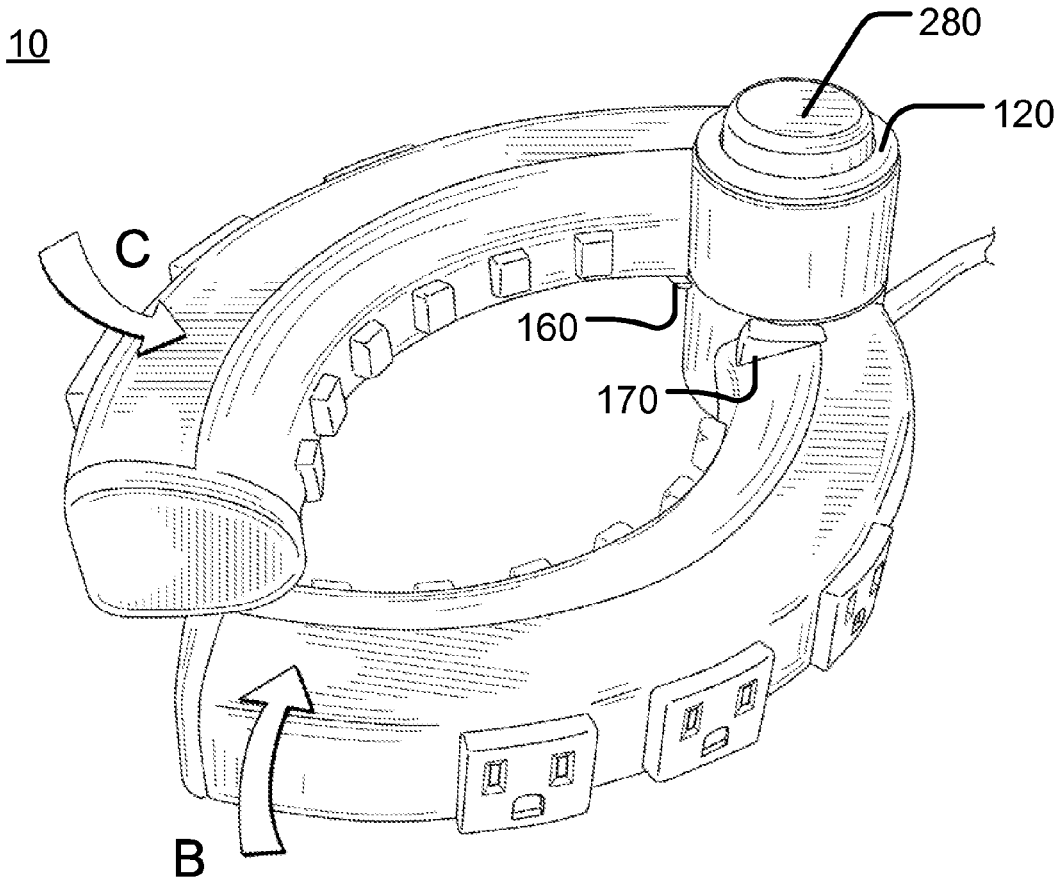

The coupling assembly 110 of the power strip 10 of the first illustrated embodiment serves to couple the two arm sections 20,30 together. The coupling assembly 110 includes a rim cap 120 (the top of which is shown in FIGS. 2-4; a portion of a bottom surface of which is shown in FIGS. 8A and 8B; and a partial cross-sectional view of which is shown in FIGS. 10A and 10B). The rim cap 120 is partially received within a cylindrical recess of the first arm section 20 and is fastened to an axle portion 130 of the second arm section 30 by a fastener in the form of a screw (not shown with respect to the power strip 10, but illustrated with respect to the power strip 1110 in FIGS. 13A, 13B, and 18). The screw extends through an axial opening 140 of the axle portion 130 of the second arm section 30 and is kept from passing completely through and out of the axial opening 140 by the head of the screw and/or by a washer or bushing (not shown) that abuts an exterior surface of the second arm section 30. The threaded portion of the screw is received and retained within a mating threaded portion (not shown) of the rim cap 120. With reference to FIG. 3, the first arm section 20 is retained by the rim cap 120 to the second arm section 30 by a circular flange of the rim cap 120 (which is the portion of the rim cap 120 shown in FIG. 3). This circular flange is not received within the cylindrical recess of the first arm section 20 but, instead, is disposed in abutting engagement with a surrounding edge 150 of the cylindrical recess of the first arm section 20 as shown in FIG. 3.

Because the rim cap 120 is secured to the axle portion 130 of the second arm section 30 by the screw in coaxial relation thereto, the rim cap 120 is capable of rotational motion about an axis of the axle portion 130. Furthermore, the rim cap 120 is disposed in fixed rotational disposition relative to the first arm section 20 about the axis of the axle portion 130 by ribs (not shown) of the rim cap 120 that axially extend along the outer side of the rim cap 120 and that are received within slots (not shown) of the cylindrical recess of the first arm section 20. Accordingly, the first arm section 20 is thereby coupled to the second arm section 30 for rotational movement relative to the second arm section 30 about this axis. This rotational movement of the arm sections 20,30 relative to one another is illustrated in FIGS. 2-4. It will also be apparent from FIGS. 2-4 that the arm sections 20,30 are offset from one another and are not generally coplanar with one another. This offset disposition permits the distal ends of the arm sections 20,30 to extend beyond the point where the distal ends of the arm sections 20,30 would otherwise meet if the arm sections 20,30 were in generally coplanar disposition. Because of this, the power strip 10 can be mounted to an object having a smaller diameter or cross-section than otherwise would be the case if the arm sections 20,30 were generally coplanar.

Additionally, in order to inhibit repetitive circular motion of the arm sections 20,30 relative to one another, which would tend to cause winding of any wires extending between the arm sections 20,30 through the coupling assembly 110, stops preferably are provided for limiting the range of the rotational movement. In this respect, a stop 160 is provided on the first arm section 20 and a corresponding stop 170 is provided on the second arm section 30. The stops 160,170 are configured to move into abutment with each other in order to limit the extent to which the first arm section 20 and second arm section 30 may be rotated in the direction shown by the respective arrows B,C in FIG. 4. Another corresponding stop 180 (shown in FIG. 8A) also is provided on the second arm section 30. The stops 160,180 also are configured to abut each other to limit the extent to which the first arm section and second arm section may be rotated in the direction shown by the respective arrows B,C in FIG. 3.

3. Ratchet Assembly

The ratchet assembly 190 defines stepped or degrees of relative rotational movement between the first arm section 20 and the second arm section 30. The ratchet assembly in operation is best shown in the partial cross-sectional view of FIG. 9. Preferably, the ratchet assembly 190 also selectively permits rotational movement of the arm sections 20,30 toward one another (i.e., in the direction shown by the arrow in FIG. 4) while precluding rotational movement of the arm sections 20,30 away from one another (i.e., in the direction shown by the arrow in FIG. 3).

In this respect, the ratchet assembly 190 includes inclined teeth elements 200 disposed in the cylindrical recess of the first arm section 20 that extend in a protracted state through oppositely disposed openings 210 of the first arm section 20 (one opening 210 of which is shown in FIGS. 8A and 8B). In the protracted state, the teeth elements 200 engage corresponding inclined teeth elements 220 that are disposed along an inner cylindrical area of the second arm section 30.

Each of the teeth elements 200 is urged into engagement with the inclined teeth elements 220 by a respective biasing element 230 (FIG. 5). Due to the shape of the inclined teeth 200 and 220 and their relative dispositions, the ratchet assembly 190 permits relative rotational movement between the first arm section 20 and the second arm section 30 toward one another and precludes or inhibits relative rotational movement between the first arm section and the second arm section away from one another. Further, as will be appreciated from the drawings, the interlocking engagement between the teeth elements 200,220 is disposed generally opposite each other about the pivot axis. Opposed sides of the lower arm section 30 thereby are locked against the prohibited rotational movement. The ratchet assembly 190 further defines increments in the direction of permitted rotational movement.

The biasing elements 230 includes spring-like characteristics and are retained on the axle portion 130 of the second arm section 30 for rotation about the axis of the axle portion 130 with the first arm section 20. Furthermore, as shown in FIG. 5, for example, the teeth elements 200 and the biasing elements 230 preferably are integrally formed as a single piece comprising a double bowspring component 240. Apart from the teeth elements 200 and the biasing element 230, the double bowstring component 240 includes a circular mounting element 250 through which the axle portion 130 of the second arm section 30 is received; and bearing surfaces 260 against which release arms 270 of a release member 280 abut in slidable disposition relative thereto.

Preferably, while the biasing elements 230 urge interlocking engagement of the teeth elements 200,220, the spring force preferably is not so great as to preclude release of the arm sections 20,30 if a great amount of torque is applied so that irreparable damage to the power strip 10 that otherwise would occur is avoided.

The release member 280 comprises a portion that is exposed and serves as a "button" for release of the locking engagement of the ratchet assembly 190 and may include the word "PUSH" or other indicia, such as a logo or trademark, disposed thereon. The release member 280 is retained within the rim cap 120 and is configured to slide back and forth in the direction and counter direction of the arrow "A" shown in FIG. 3. Moreover, the release arms 270 of the release member 280 extend through openings in the bottom of the rim cap 120 to engage the bearing surfaces 260 of the double bowspring component 240 as shown in FIG. 10A, whereby the release member is biased into a disposition in which the release "button" is raised relative to the circular flange of the rim cap 120.

In operation, the power strip 10 may be clamped onto an object or portion thereof such as, for example, a trunk or branch of a tree, a stud in a building under construction, or a work bench or work table. By depressing the release member 280, the two arm sections 20,30 are released from a locked condition to an unlocked position and can be freely moved within their relative range of motion about their mutual pivot axis. The power strip 10 then can be positioned such that the object is disposed between the arm section 20,30. Upon ceasing depression of the release member 280 (which is biased by the biasing elements 230), the arm sections 20,30 will return to the locked condition such that movement of the arm sections 20,30 toward one another is permitted but movement of the arm sections 20,30 away from one another is precluded or inhibited. The arm sections 20,30 then can be closed in tight fitting disposition on the object located there between for mounting of the power strip 10 to the object.

To further facilitate mounting of the power strip 10, a further biasing member may be included in the assembly for biasing the arm sections 20,30 away from one another such that the arm sections 20,30 will automatically open when the release member 280 is depressed. Such a biasing member may comprise a torsion spring (not shown in power strip 10) that is located on the axle portion 130 of the lower arm section 30 and that has opposed ends fixedly attached to both arm sections 20,30.

Alternative clamp-on power strips now are illustrated which serve to highlight several variations on the clamp-on power strip 10 of FIGS. 1-10.

B. Second Illustrated Embodiment

Turning now to the drawings and, in particular to FIGS. 11-18, a power strip 1110 in accordance with a second illustrated embodiment is shown. The power strip 1110 generally comprises the same main components as the power strip 10 of FIGS. 1-10, including: a plurality of arm sections; a coupling assembly; and a ratcheting assembly.

Among some differences between these two illustrated power strips, the release member of the power strip 1110 also includes the work "PUSH" formed in a surface thereof. Also, the power strip 1110 includes a single row of four receptacles per arm section, rather than a row of three receptacles per arm section. As will be appreciated, any number of receptacles may be included along a particular arm section of a power strip in accordance with an embodiment of the invention. Thus, for example, an arm section may include a row of six receptacles. Moreover, different arm sections may include rows having different number of receptacles (or none at all, as desired).

Figure 13A:
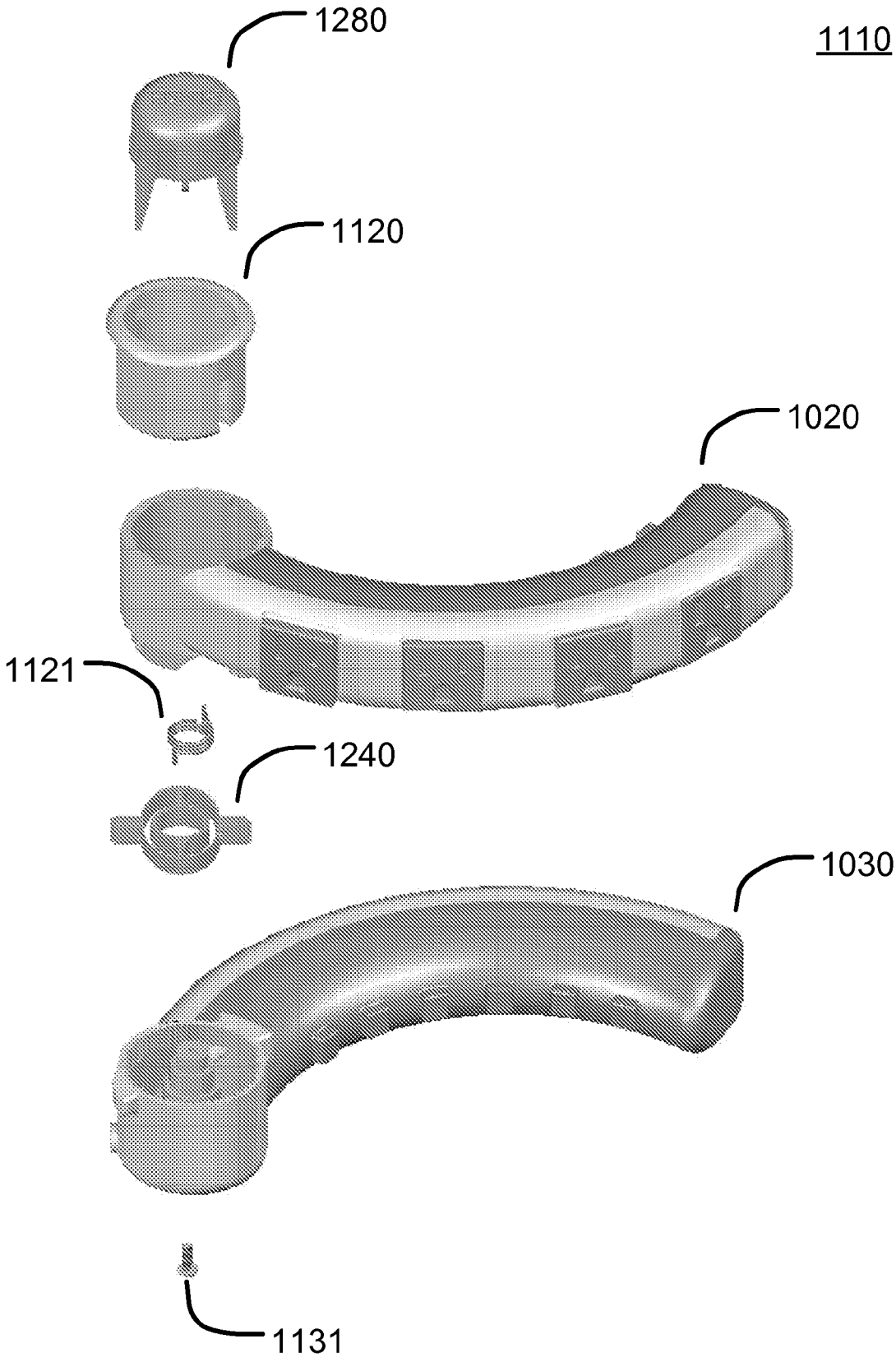
Figure 13B:
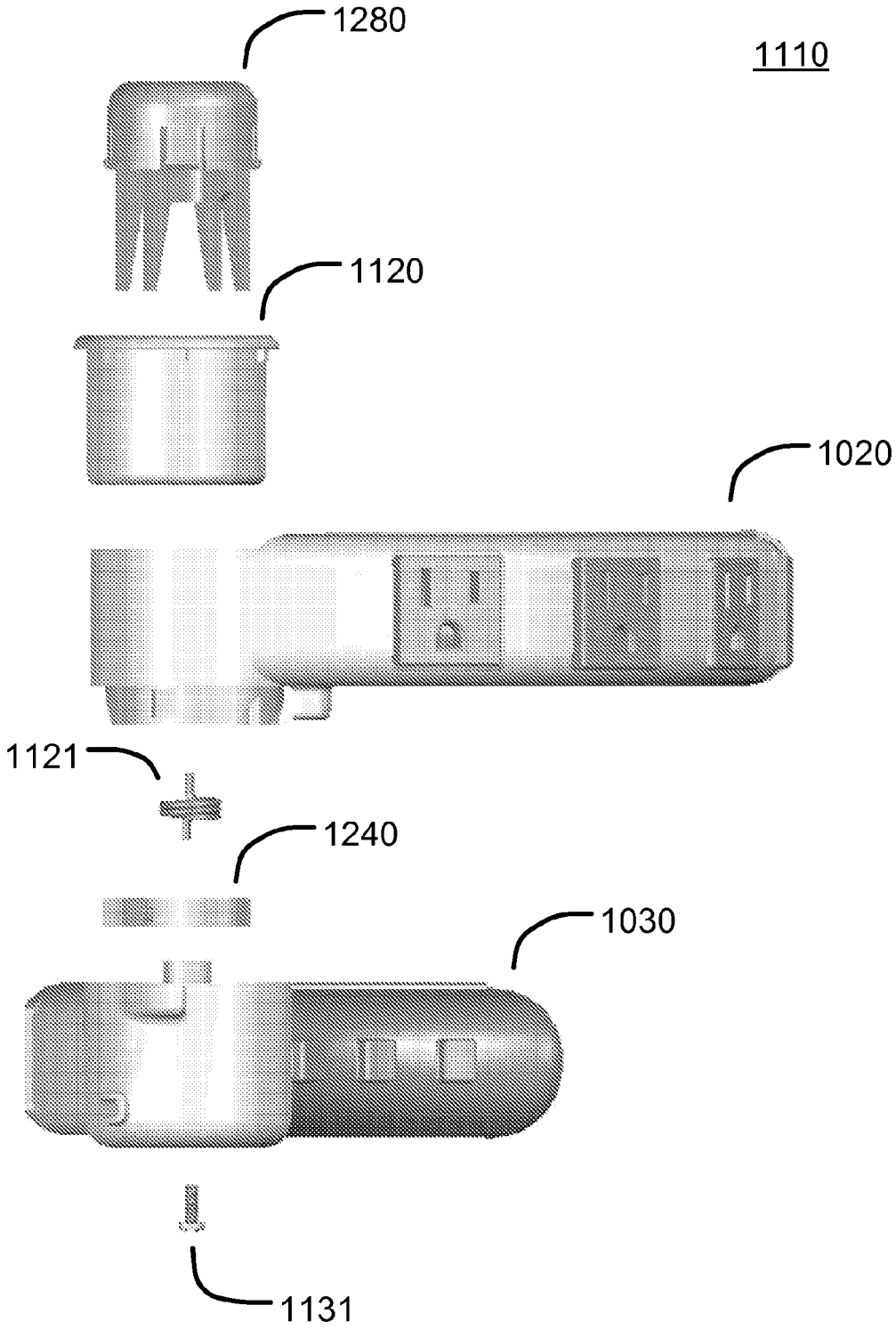
Figure 14:
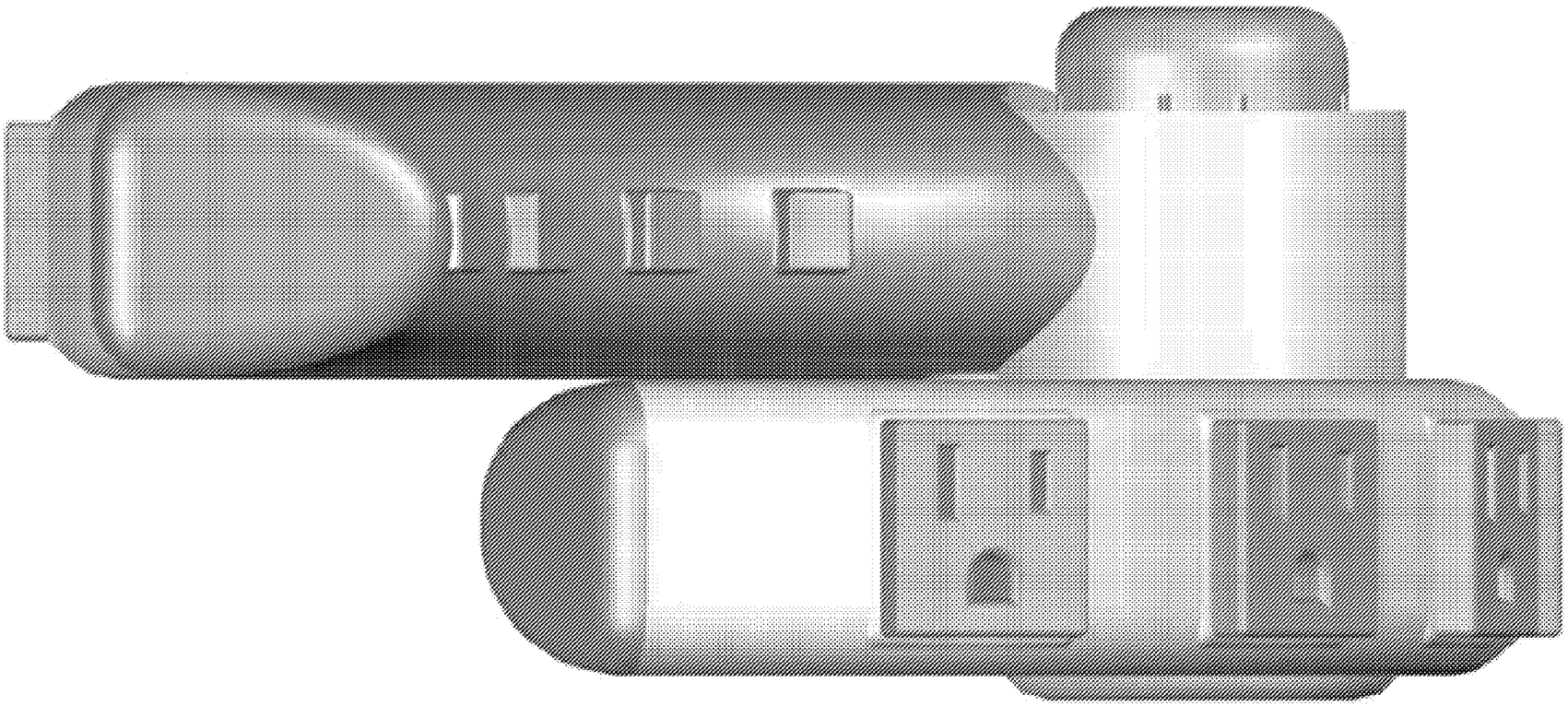
Figure 15:
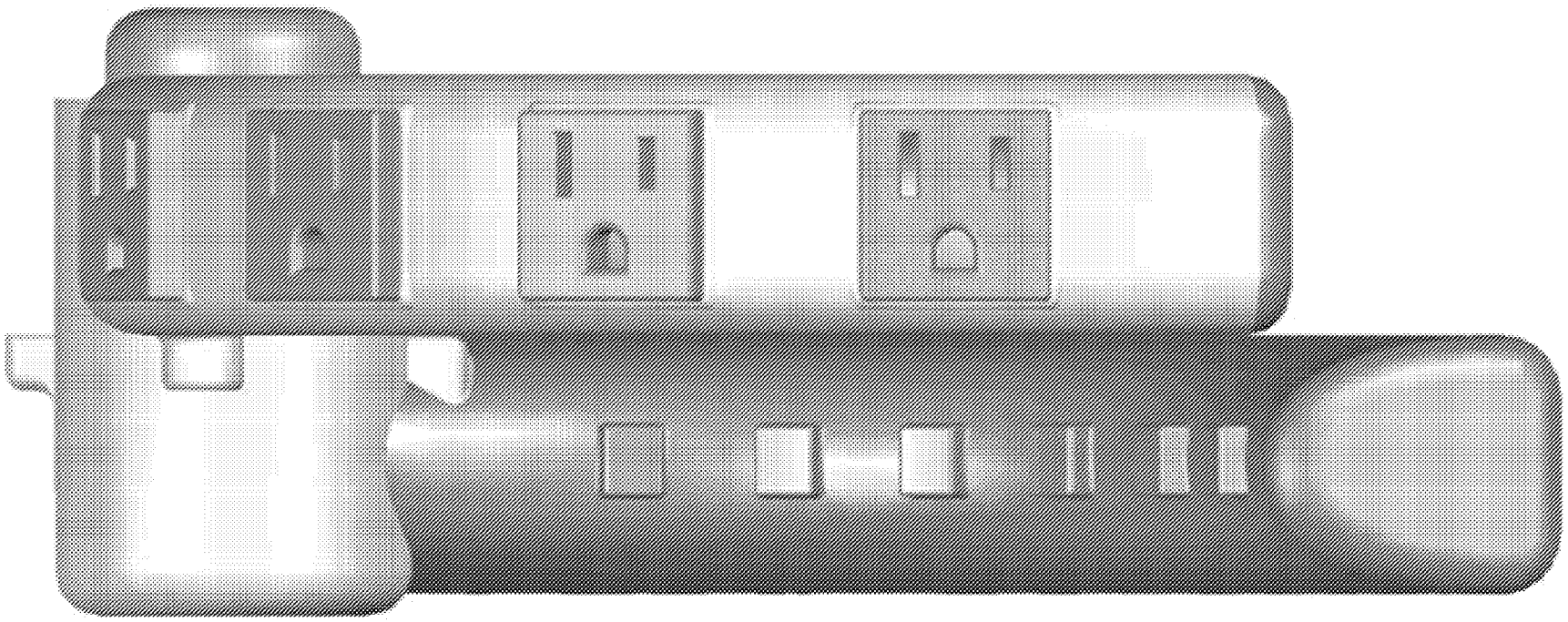
Figure 16:
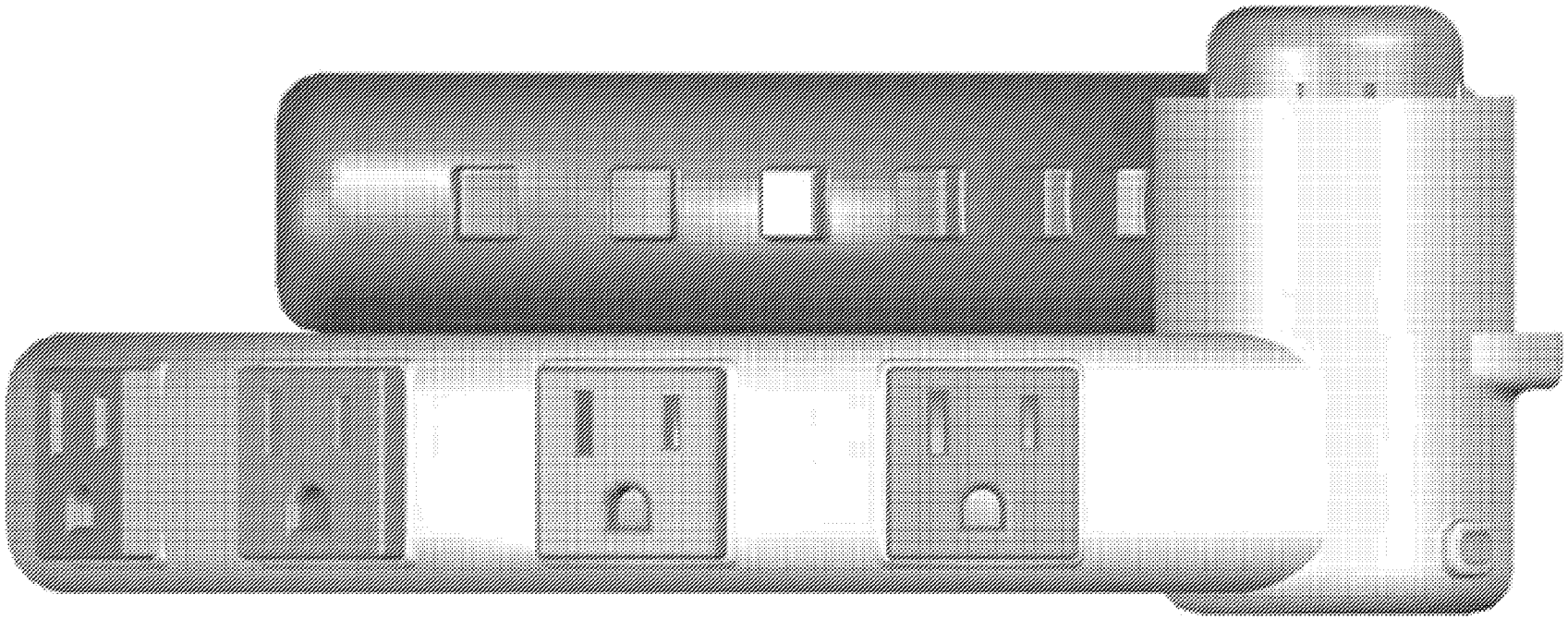
Figure 17:
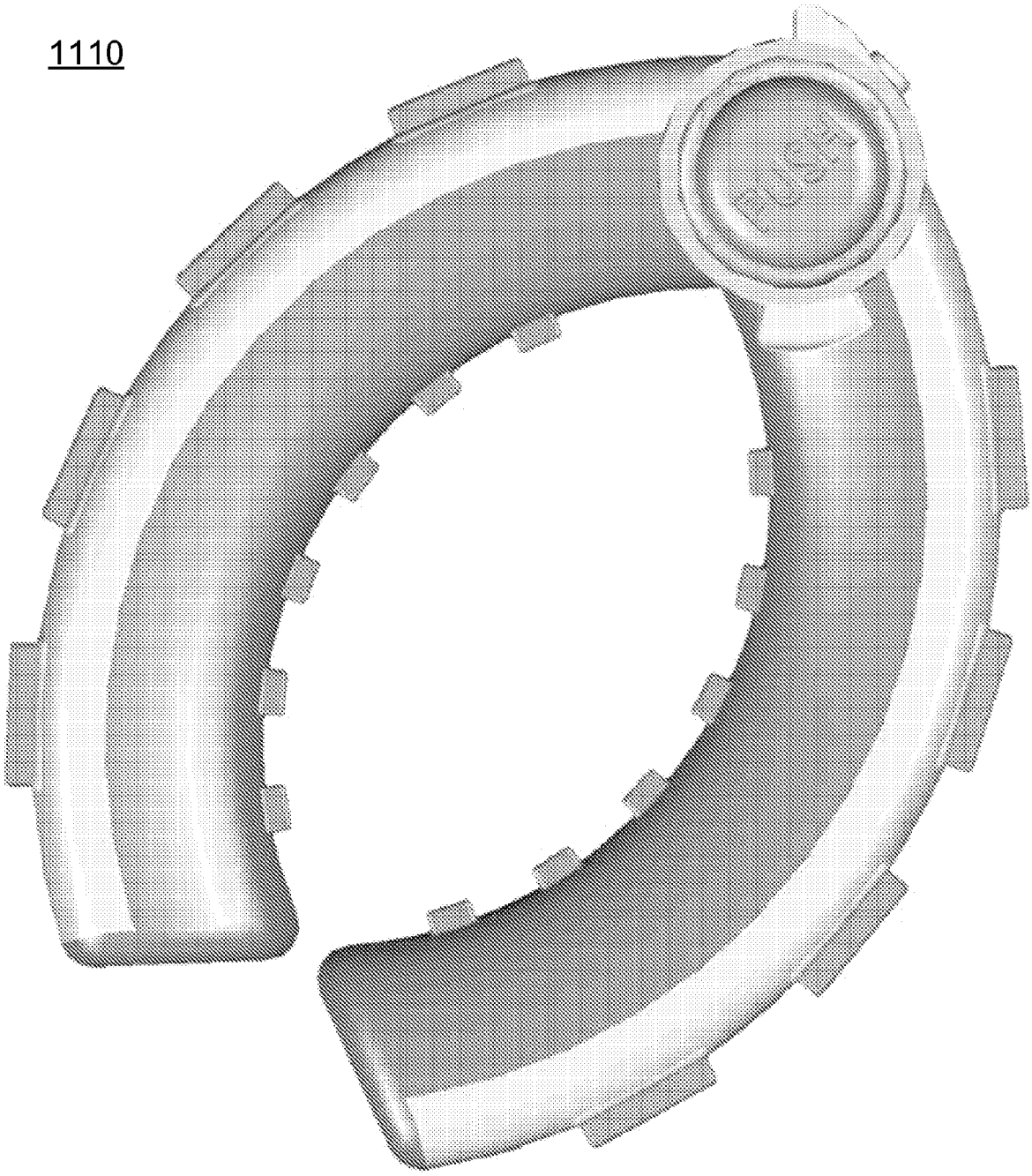
Figure 18:
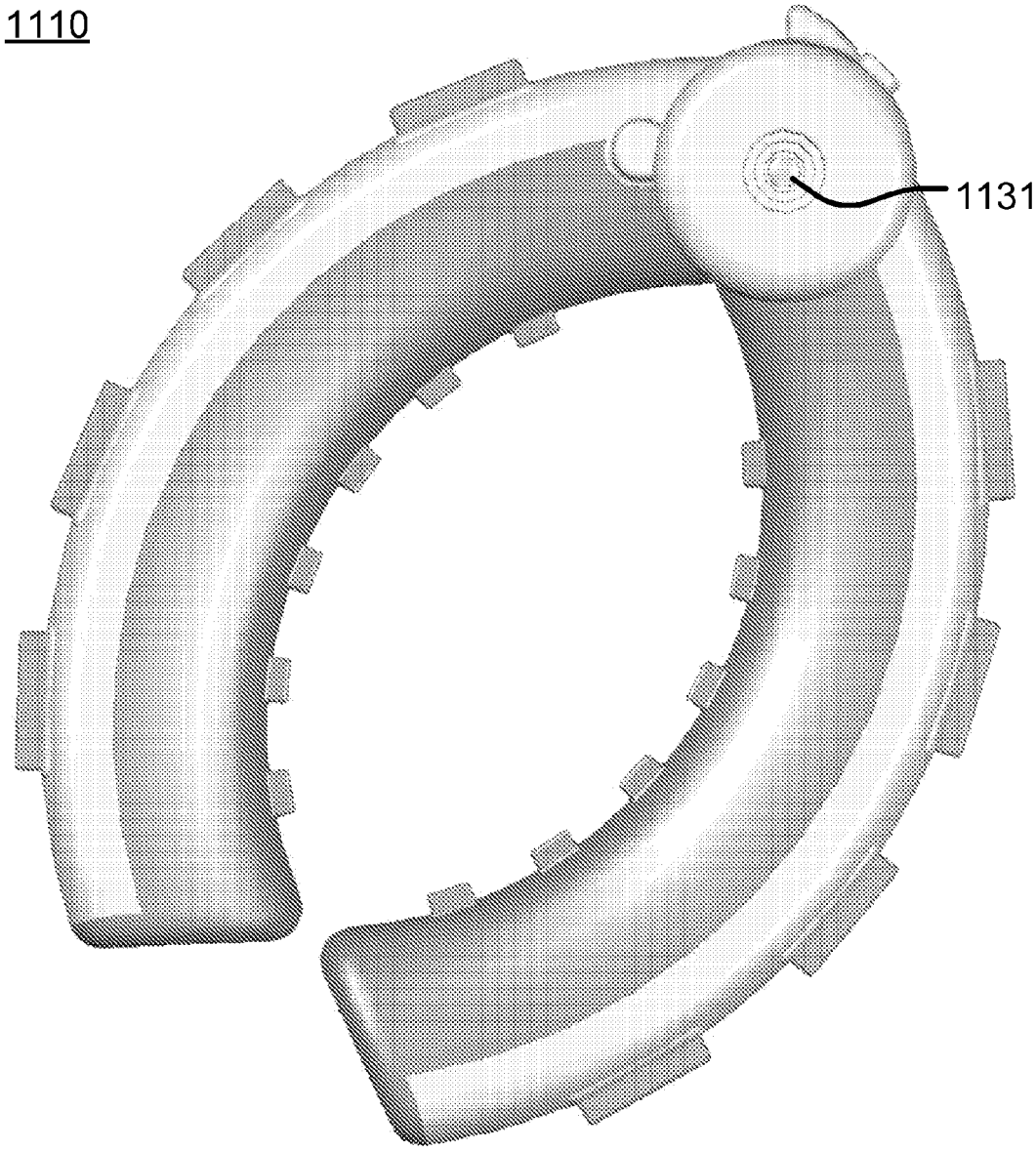
Figure 19:
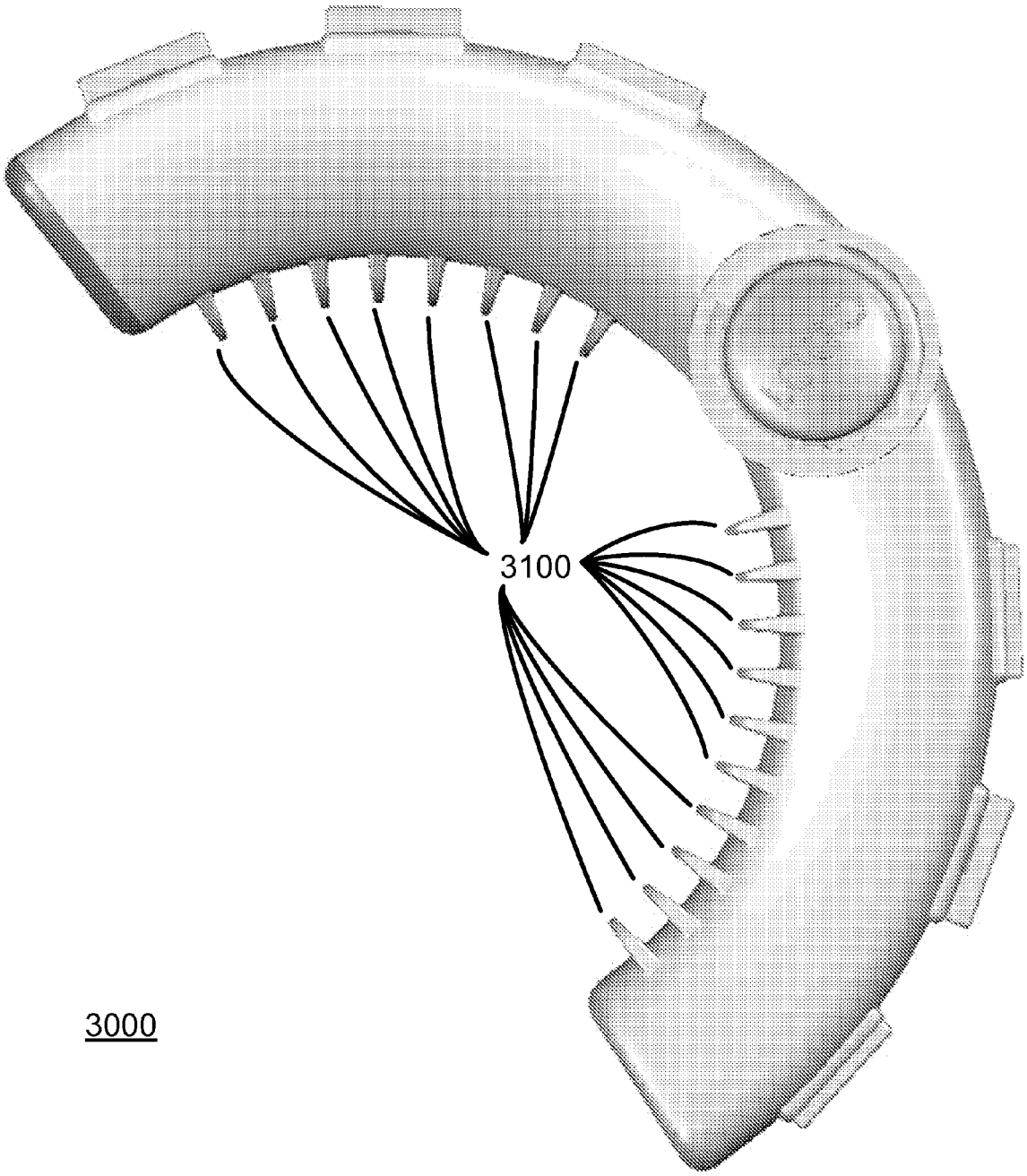
Figure 20:
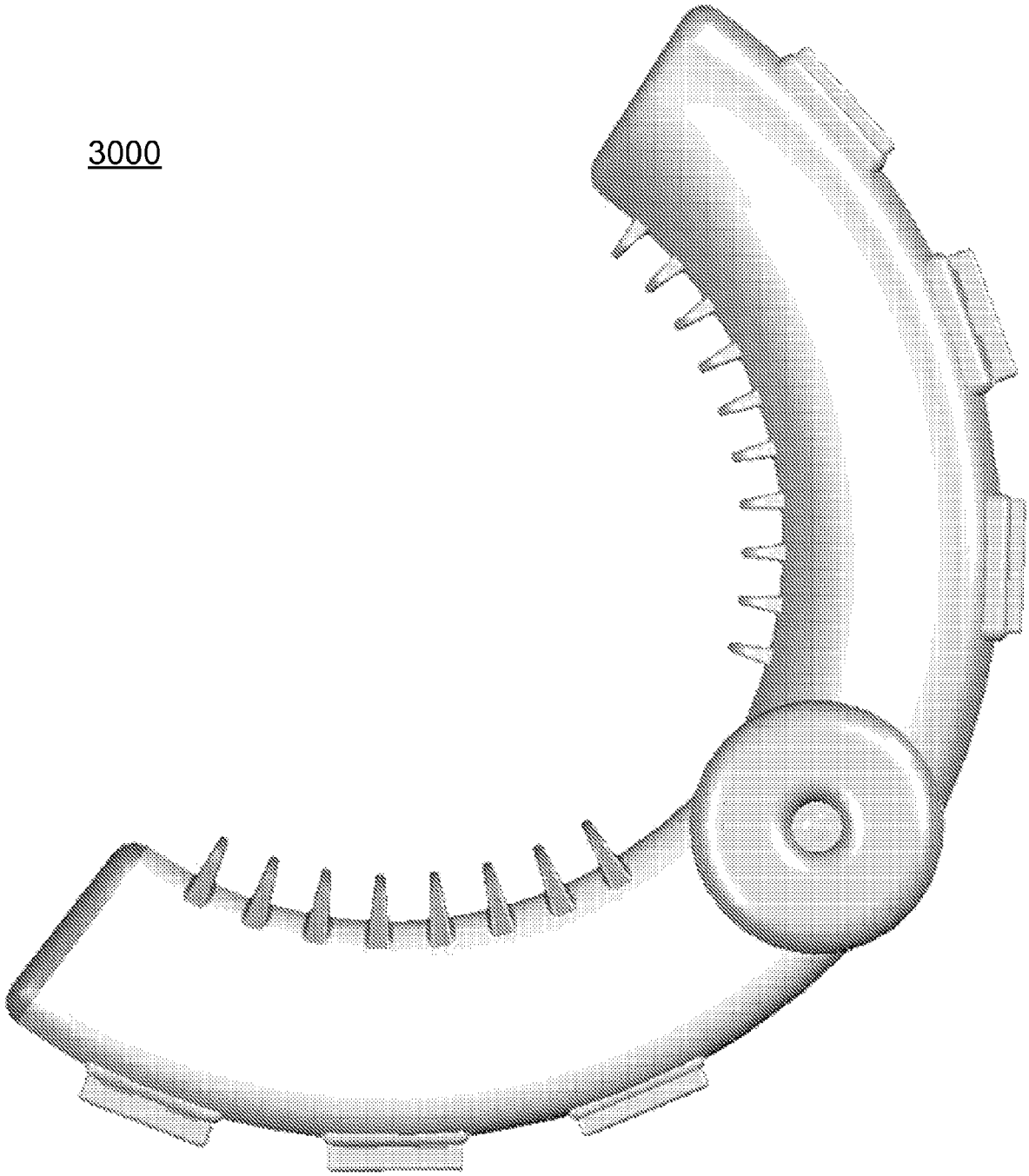
Figure 21:
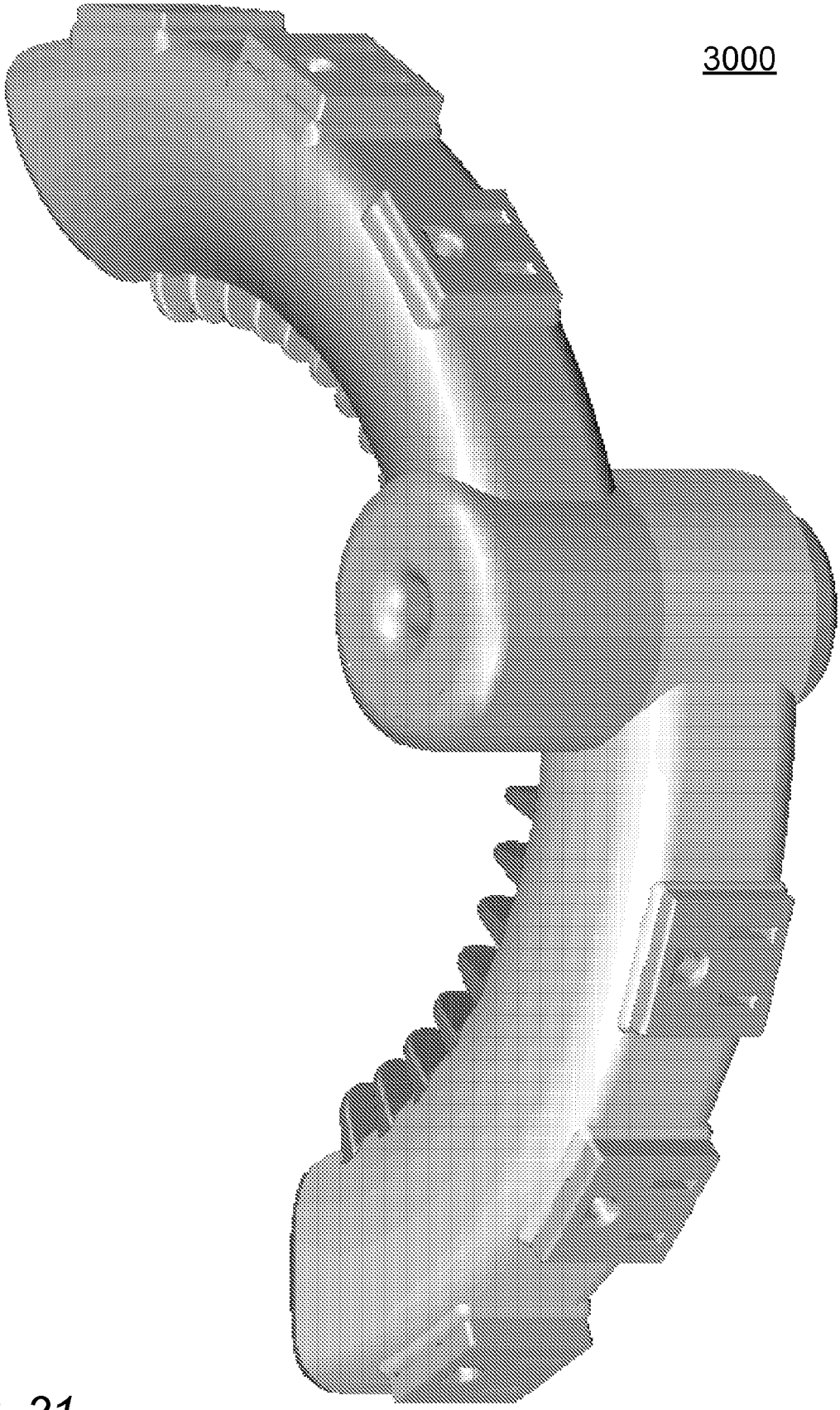
Figure 22:
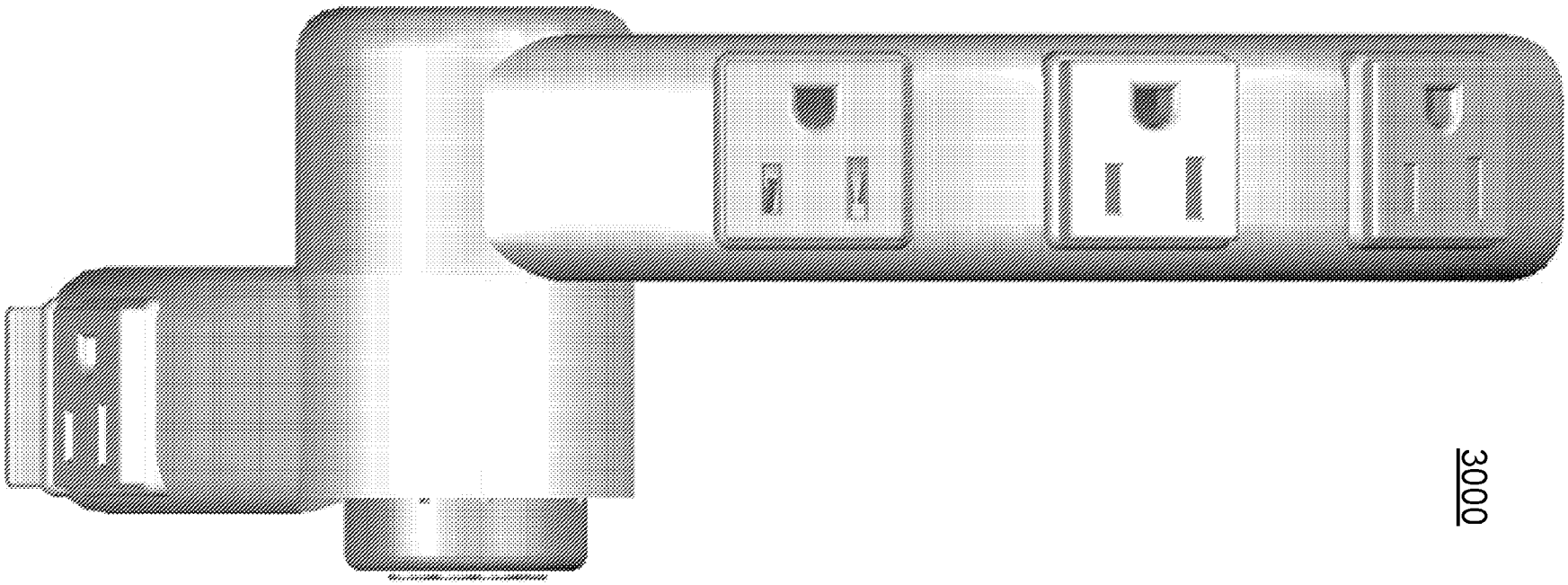

An exploded view of the power strip 1110 is illustrated in FIGS. 13A-13B. As shown therein, the power strip 1110 includes a release member 1280; a rim cap 1120; upper arm section 1020; torsion spring 1121; a double bowspring 1240; a lower arm section 1030; and a screw fastener 1131.

C. Third Illustrated Embodiment

A power strip 3000 in accordance with a third illustrated embodiment is shown in FIGS. 19-25. The power strip 3000 generally includes the same construction as power strip 10 and comprises the same main components as the power strip 10 of FIGS. 1-10, including: a plurality of arm sections; a coupling assembly; and a ratcheting assembly.

Figure 23:
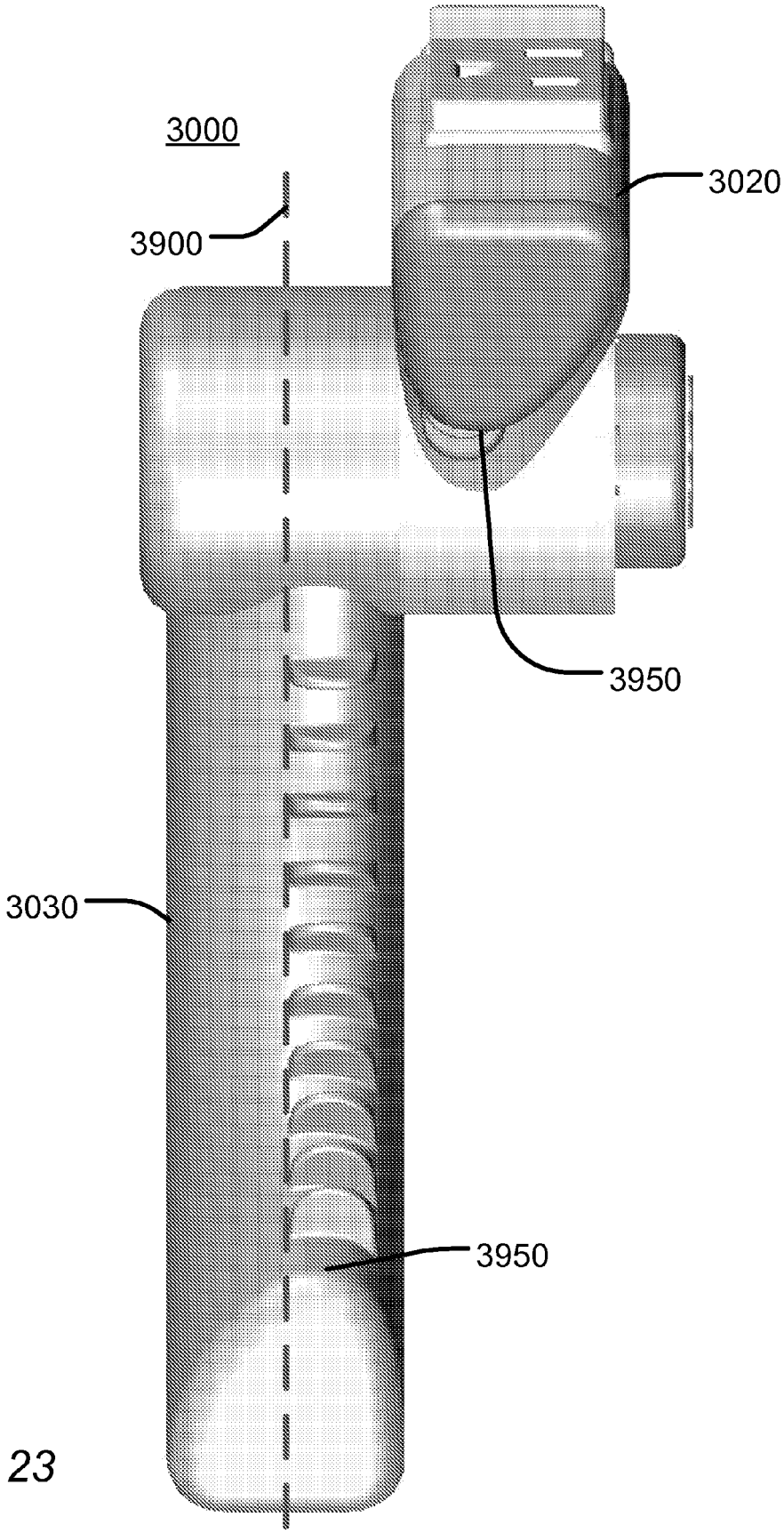
Figure 24:
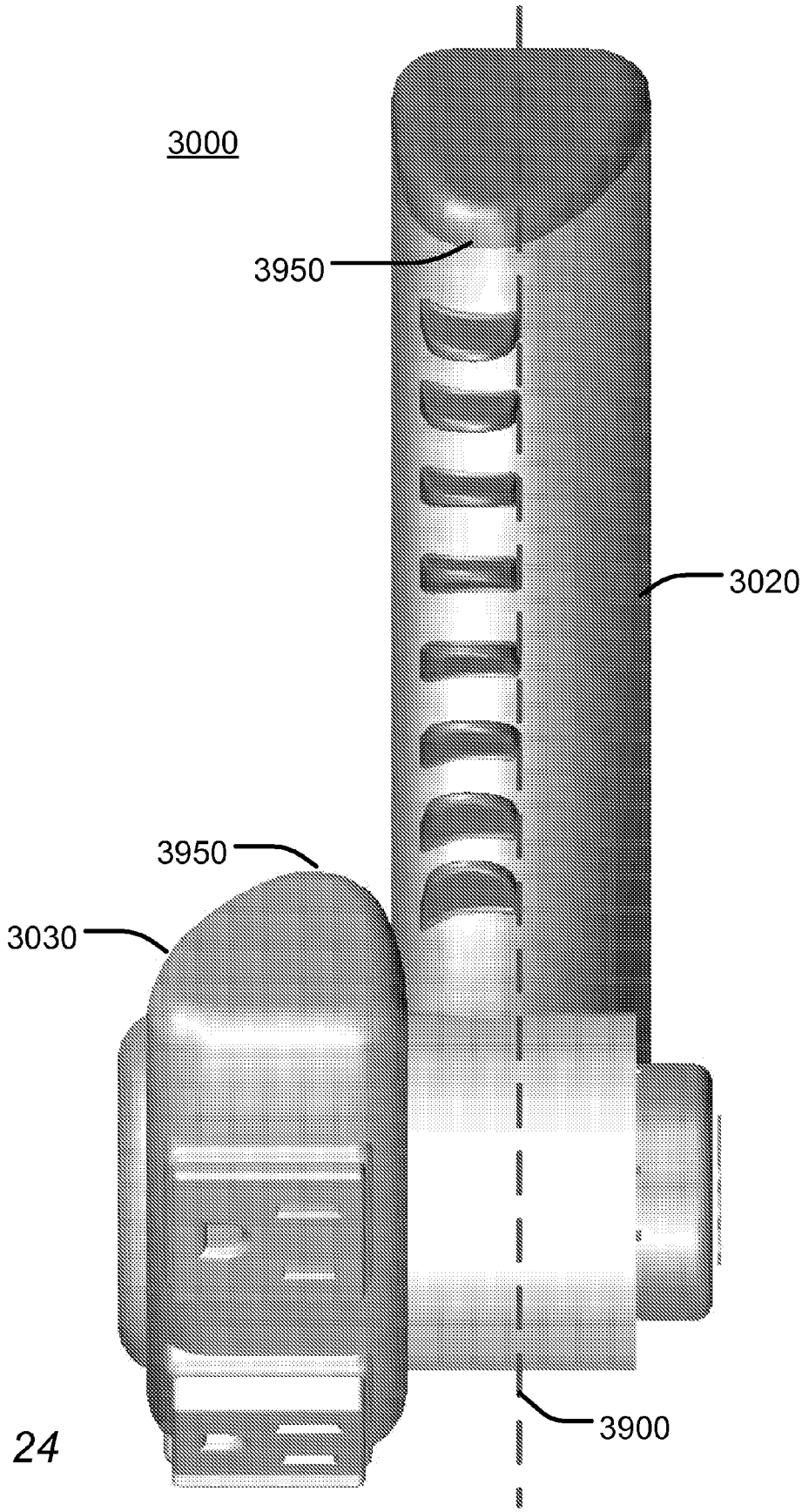
Figure 25:
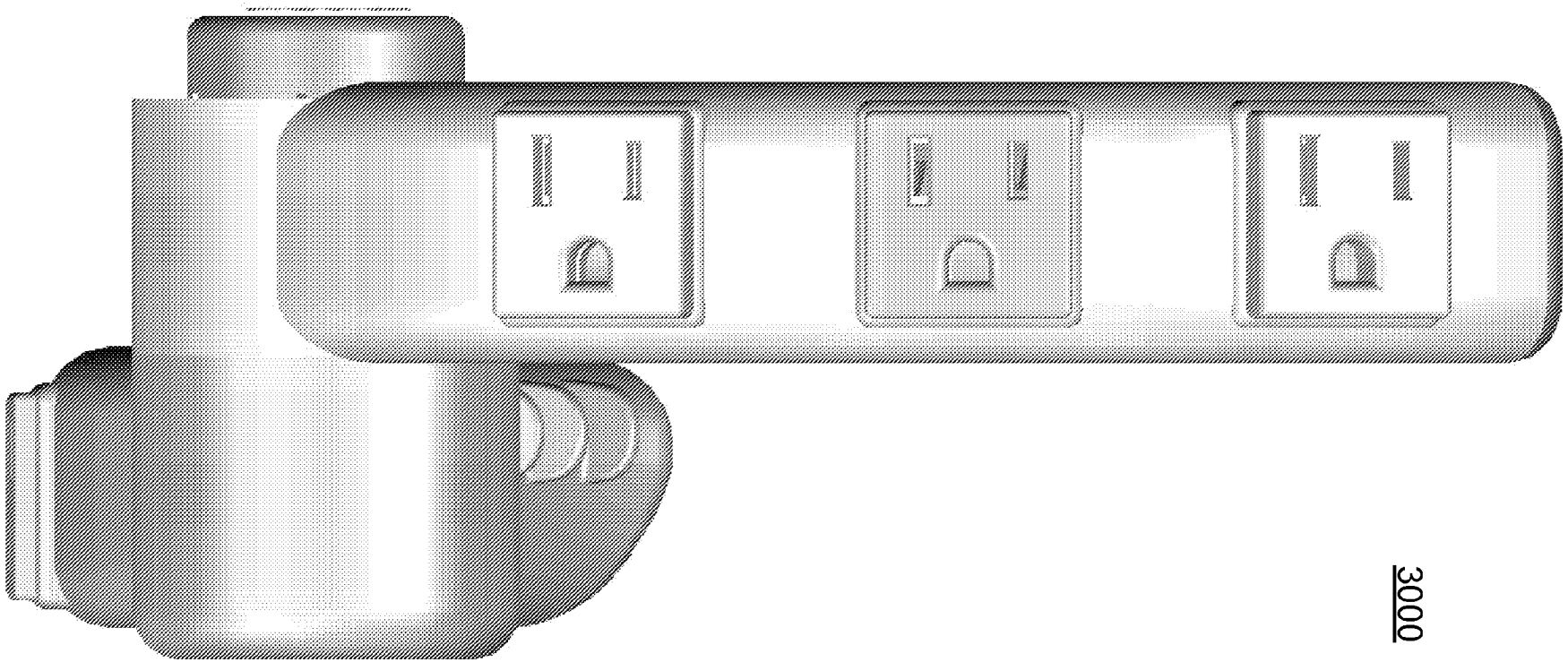

One difference over the previous illustrated power strips 10,1110 that is illustrated by power strip 3000 relates to the form of the resilient protuberances for tensioned gripping that are disposed on the inner concave portion of the arm sections. In the power strip 3000, the resilient protuberances include bendable or flexible fingers 3100 (see FIG. 19), which in use may better conform to and provide a better grip on the object to which the power strip 3000 is mounted. The protuberances 3100 also are aligned in two generally parallel rows, each row of which is generally offset from a centerline 3900 of its respective arm section 3020,3030 in a direction toward the other row of the other arm section 3020,3030. This arrangement of the two rows of protuberances 3100 is best seen in FIGS. 23 and 24. In other words, the arm sections 3020,3030 themselves are offset from one another, as consequently are the protuberances 3100; however, the protuberances 3100 are not offset to the same extent as the arm sections 3020,3030.

Each arm section 3020,3030 further includes a profile that is not symmetrical along the centerline 3900 of the arm section, again as best shown in FIGS. 23 and 24. Instead, the profile of each arm section 3020,3030 includes a rounded edge 3950 that is offset toward the other arm section 3020, 3030, with the protuberances 3100 on each arm section 3020, 3030 extending long this rounded edge 3950.

D. Additional Illustrated Embodiments

Additional embodiments are illustrated in FIGS. 26-46.

A power strip 4000 is illustrated in FIG. 26 that includes a spring-biased lever arm 4500 with finger grips for spring-biased clamping of an object between arm section 4020 and an arm section 4030. The arm sections 4020,4030 are joined at pivot coupling 4110. Further in this respect, the lever arm 4500 and the arm section 4030 preferably are disposed in fixed position relative to each other. Additionally, in the power strip 4000, electrical receptacles are only provided on arm section 4020. In this respect, arm section 4020 includes six electrical receptacles.

Figure 27:
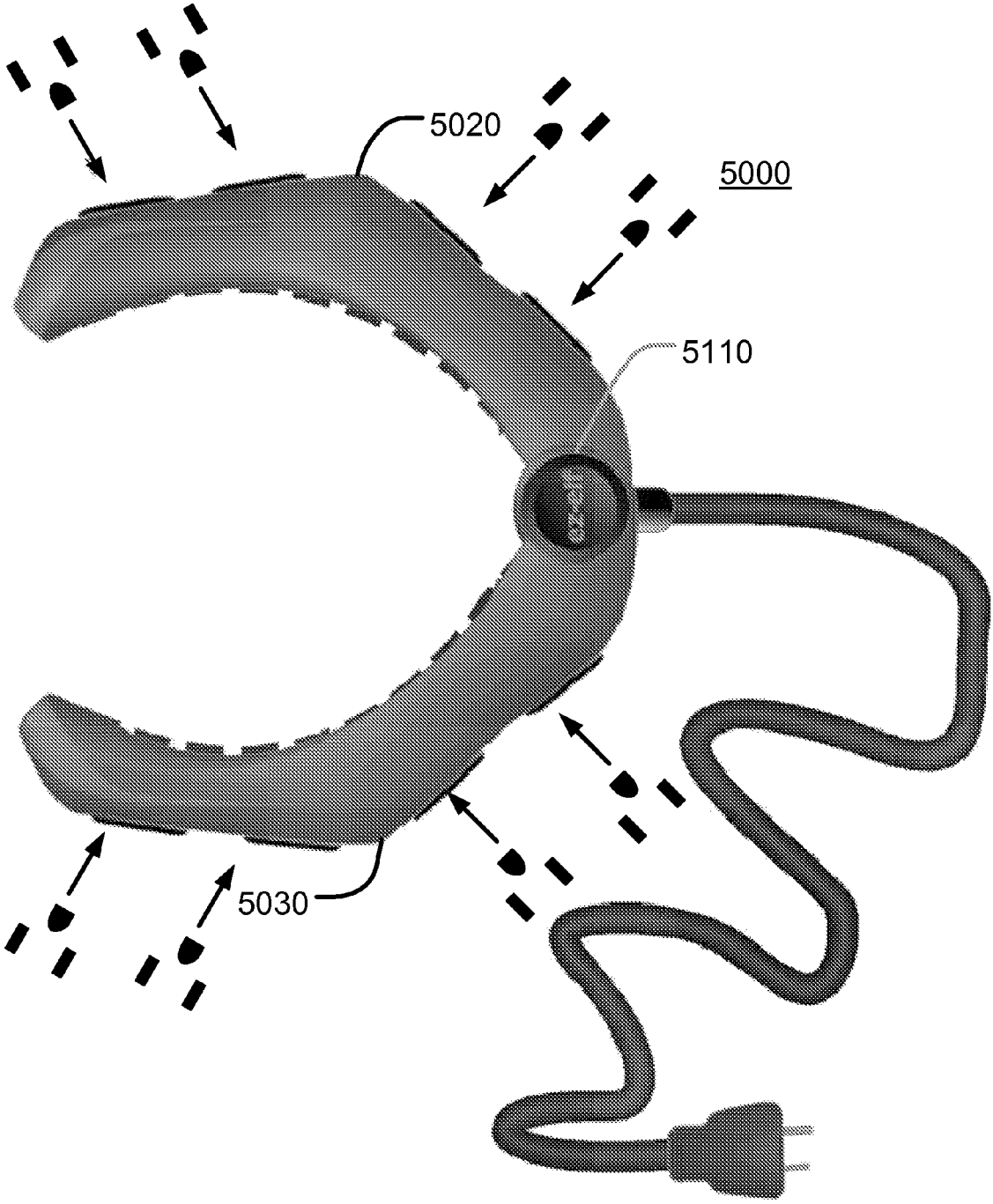

A power strip 5000 is illustrated in FIG. 27 and includes spring-biased arm sections 5020,5030. Each arm section includes four electrical receptacles, and the arm sections 5020,5030 are biased toward one another by an internal biasing component (not shown) disposed at the pivot coupling 5110, which biasing component provides the clamping force for mounting of the power strip 5000 to an object. The power strip further may include a ratcheting mechanism (not shown) permitting the arm sections to be moved toward one another, but precluding the arm sections from moving away from one another. A release button (not shown) also may be provided for enabling the arm sections to be parted.

Figure 28:
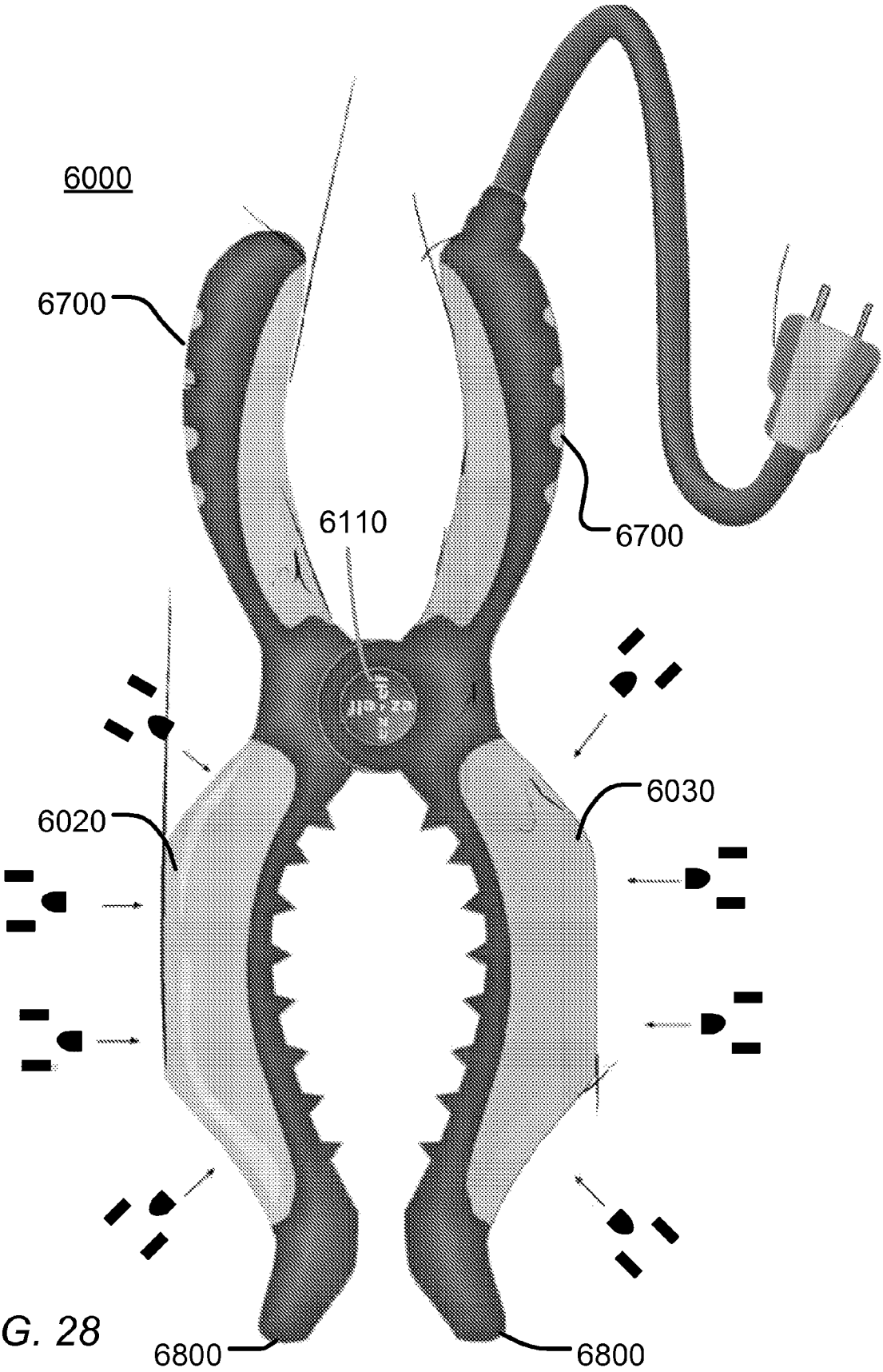

A power strip 6000 is illustrated in FIG. 28 and includes spring-biased arm sections 6020,6030. Each arm section includes four electrical receptacles, and the arm sections are biased toward one another by an internal biasing component (not shown) disposed at the pivot coupling 6110, which biasing component provides the clamping force for mounting of the power strip 6000 to an object. Handle grips 6700 also are provided in the power strip 6000 and are formed by each of the arm sections, whereby the power strip overall resembles a clamp found in jumper cables for a car battery. The arm sections further include end portions 6800 that define guides against which a user can push an object, thereby parting the arm sections 6020,6030 for mounting of the power strip 6000 onto the object.

Figure 29:
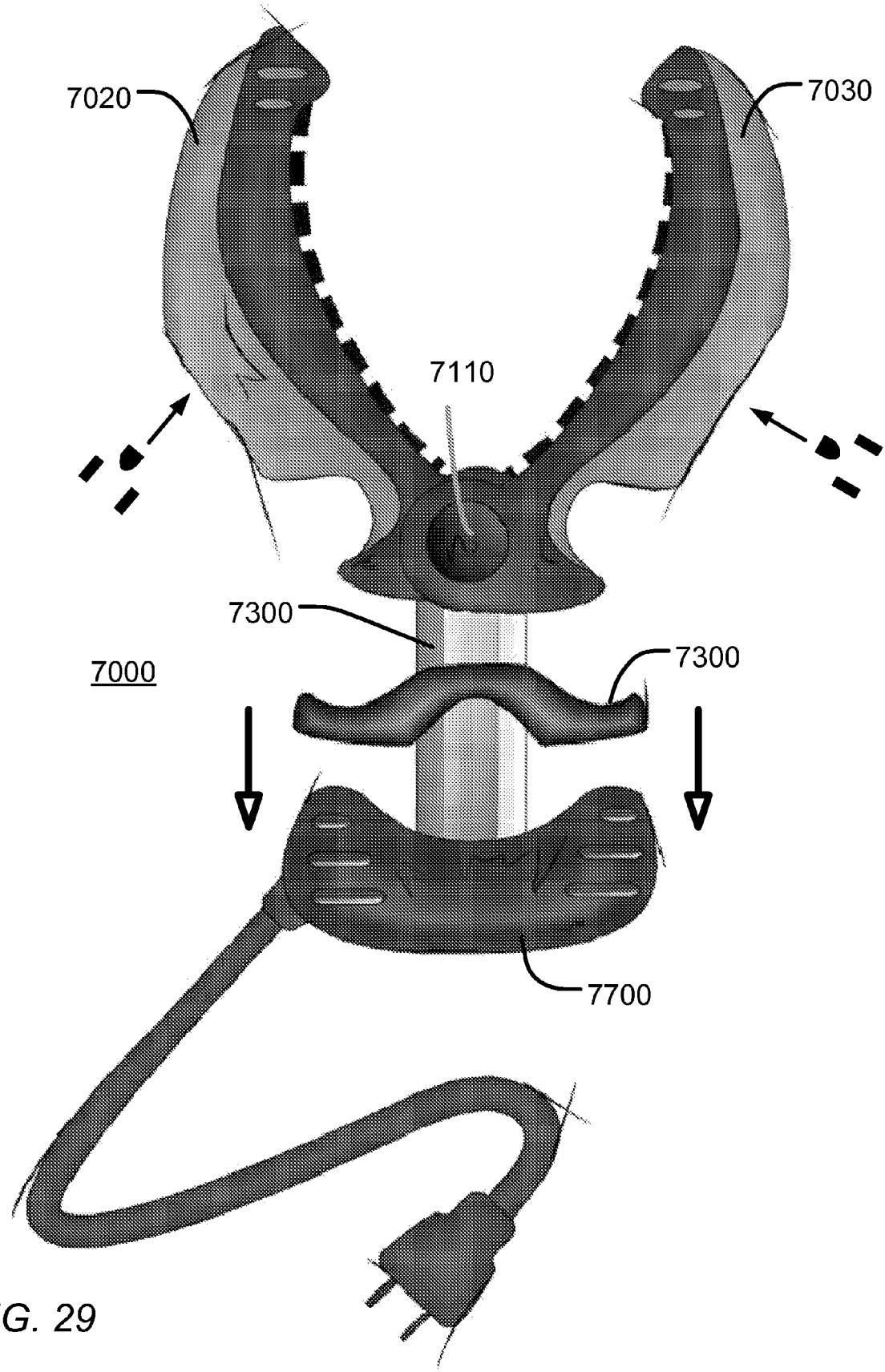

A power strip 7000 is illustrated in FIG. 29 and includes spring-biased arm sections 7020,7030. Each arm section includes an electrical receptacle, and the arm sections are biased toward one another by an internal biasing component (not shown) disposed at the pivot coupling 7110, which biasing component provides the clamping force for mounting of the power strip 7000 onto an object. The arm sections 7020, 7030 are parted by sliding pull bar 7300 along shaft 7400 toward handle 7700. The pull bar 7300 counters the biasing component in parting the arm sections for attachment of the power strip to an object.

Figure 30:
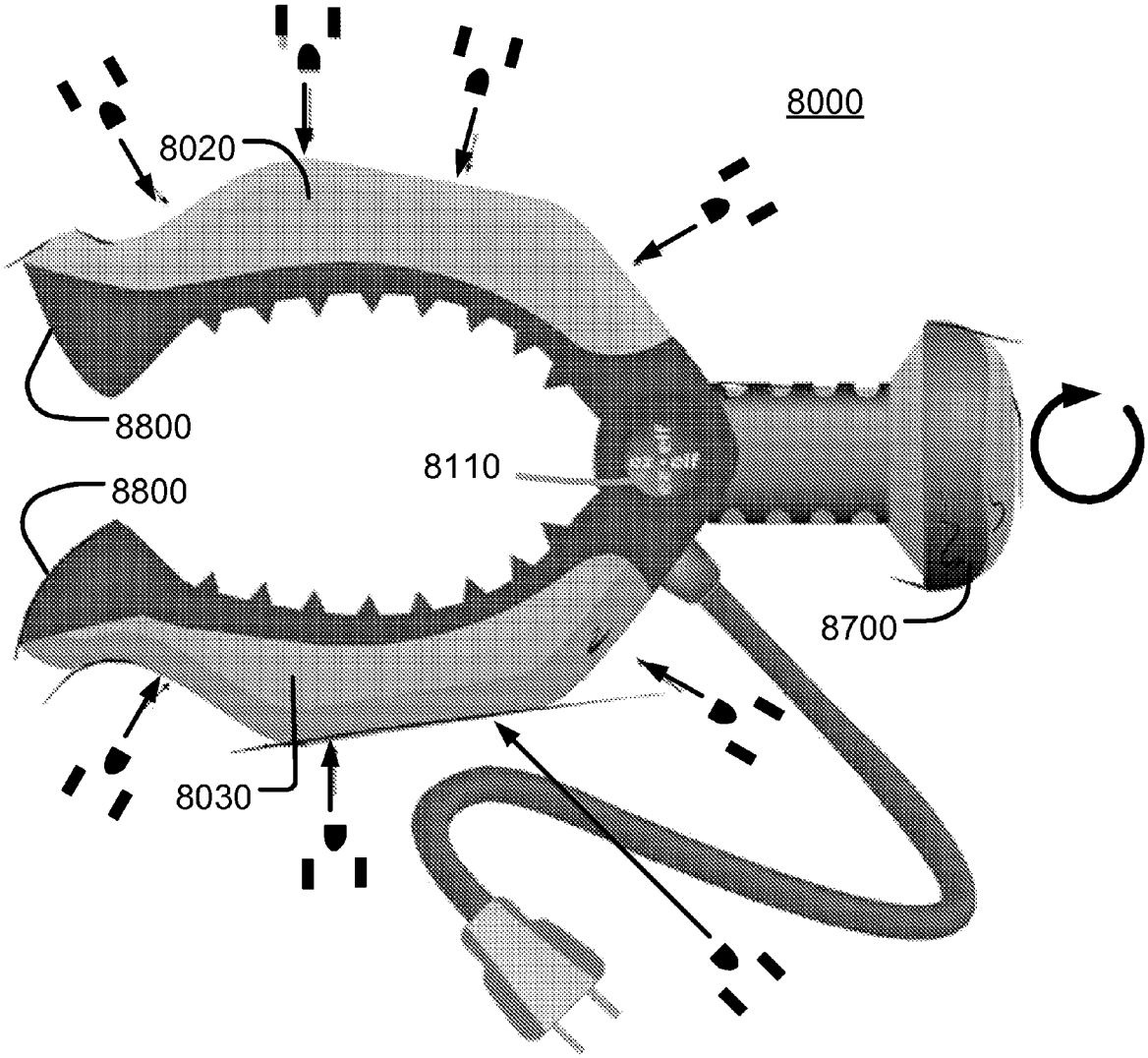

A power strip 8000 is illustrated in FIG. 30 and includes spring-biased arm sections 8020,8030. Each arm section includes four electrical receptacles, and the arm sections are biased toward one another by an internal biasing component (not shown) disposed at the pivot coupling 8110, which biasing component provides the clamping force for mounting of the power strip 8000 to an object. A handle 8700 extends from the pivot coupling. The arm sections further include end portions 8800 that define guides against which a user can push an object, thereby parting the arm sections 8020,8030 for mounting of the power strip 8000 onto the object. Furthermore, the tension in the biasing component at the pivot coupling 8110 preferably is adjustable, whereby the degree of force required to part the arm sections is adjustable. Adjustment of the tension in the biasing component preferably is accomplished by rotating the end of the handle 8700 as shown by the arrow in FIG. 30.

Figure 31:
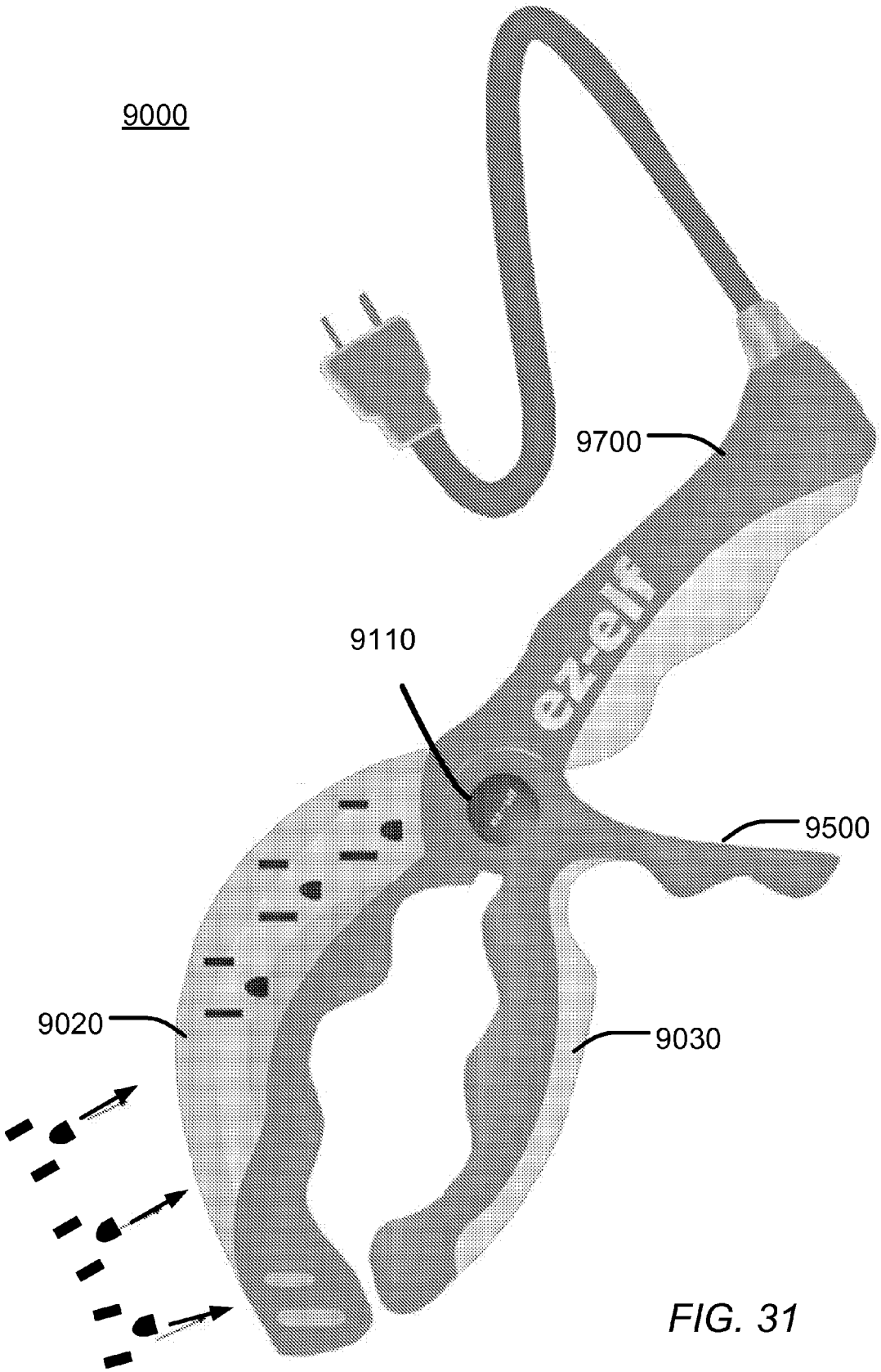
Figure 32:
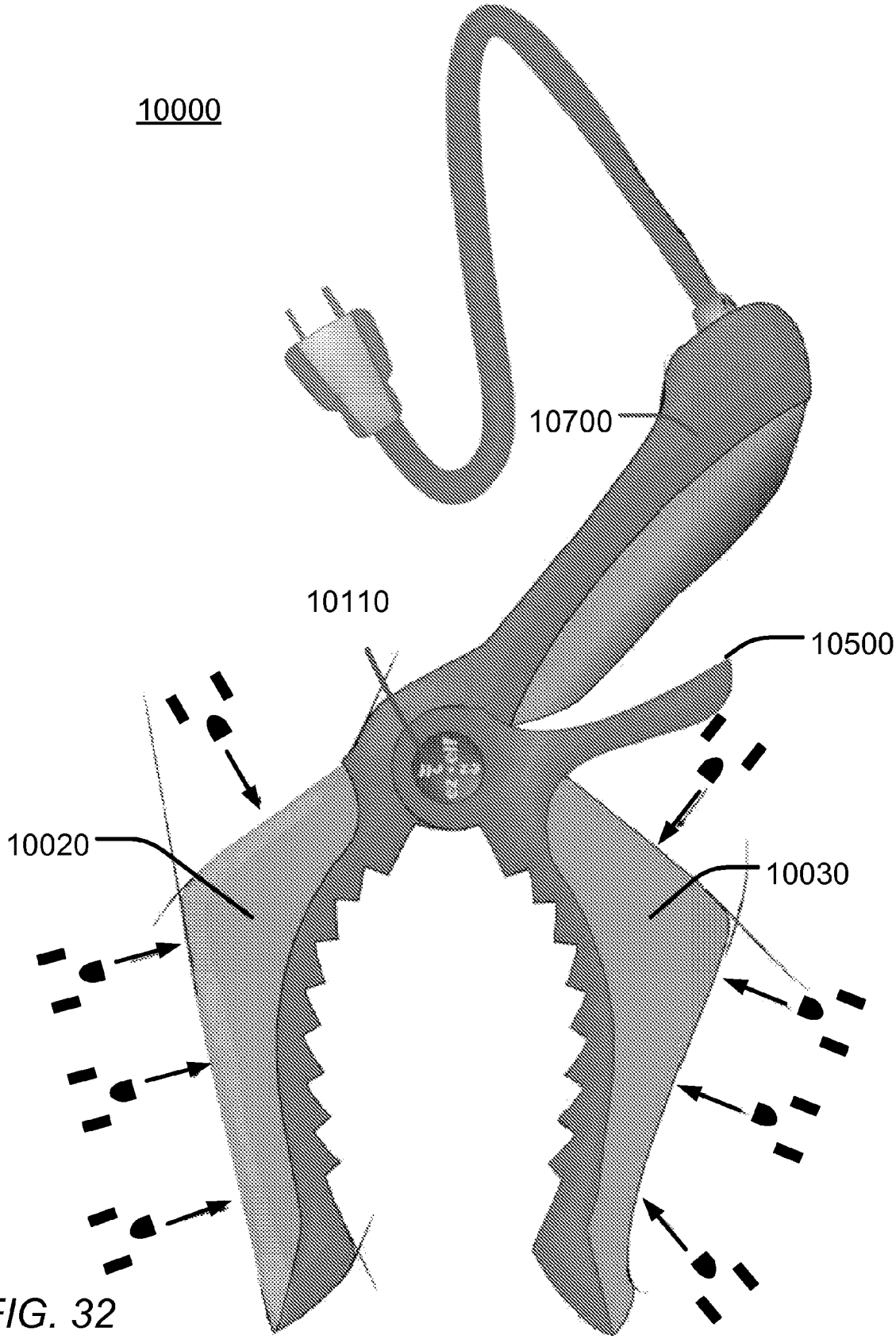

A power strip 9000 is illustrated in FIG. 31 and includes a spring-biased lever arm 9500 with finger grips for spring-biased clamping of an object between arm section 9020 and an arm section 9030. The arm sections 9020,9030 are joined at pivot coupling 9110. Further in this respect, the lever arm 9500 and the arm section 9030 preferably are disposed in fixed disposition relative to each other and may be integrally formed. Moreover, electrical receptacles are only provided on arm section 9020. In this respect, arm section 9020 includes six electrical receptacles. Furthermore, half of the receptacles are disposed on a first side of the arm section 9020, and the other half are disposed on a second side of the arm section 9020 that, generally, is orthogonally disposed to the first side. In other words, a row of receptacles extends along a top portion of the arm section 9020 and a row of receptacles extends along a side portion of the arm section 9020. A handle 9700 extends from the pivot coupling 9110 and preferably is formed by an extension of the arm section 9020 past the pivot coupling 9110.

Figure 33:
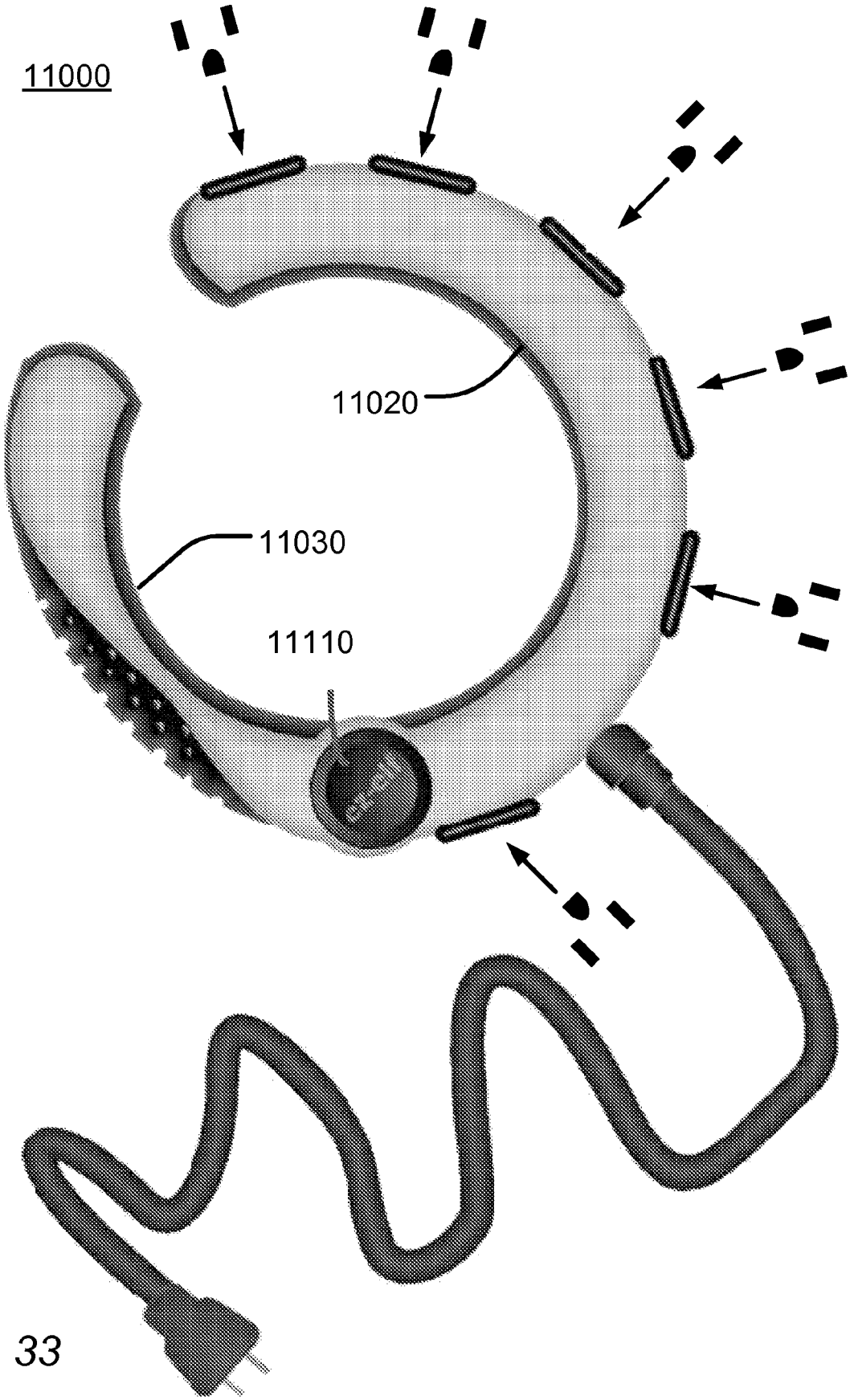

A power strip 11000 is illustrated in FIG. 33 and includes spring-biased arm sections 11020,11030. Only arm section 11020 includes electrical receptacles, and six are provided. One electrical receptacle is divided from the other five by the power cord, which enters and supplies power to the power strip through the arm section 11020. The arm sections 11020,

11030 are biased toward one another by an internal biasing component (not shown) disposed at the pivot coupling 11110, which biasing component provides the clamping force for mounting of the power strip 11000 onto an object. As will be apparent from FIG. 33, arm section 11030 is substantially longer than arm section 11020. The power strip further may include a ratcheting mechanism (not shown) permitting the arm sections to be moved toward one another, but precluding the arm sections from moving away from one another. A release button (not shown) also may be provided for enabling the arm sections to be parted.

Figure 34:
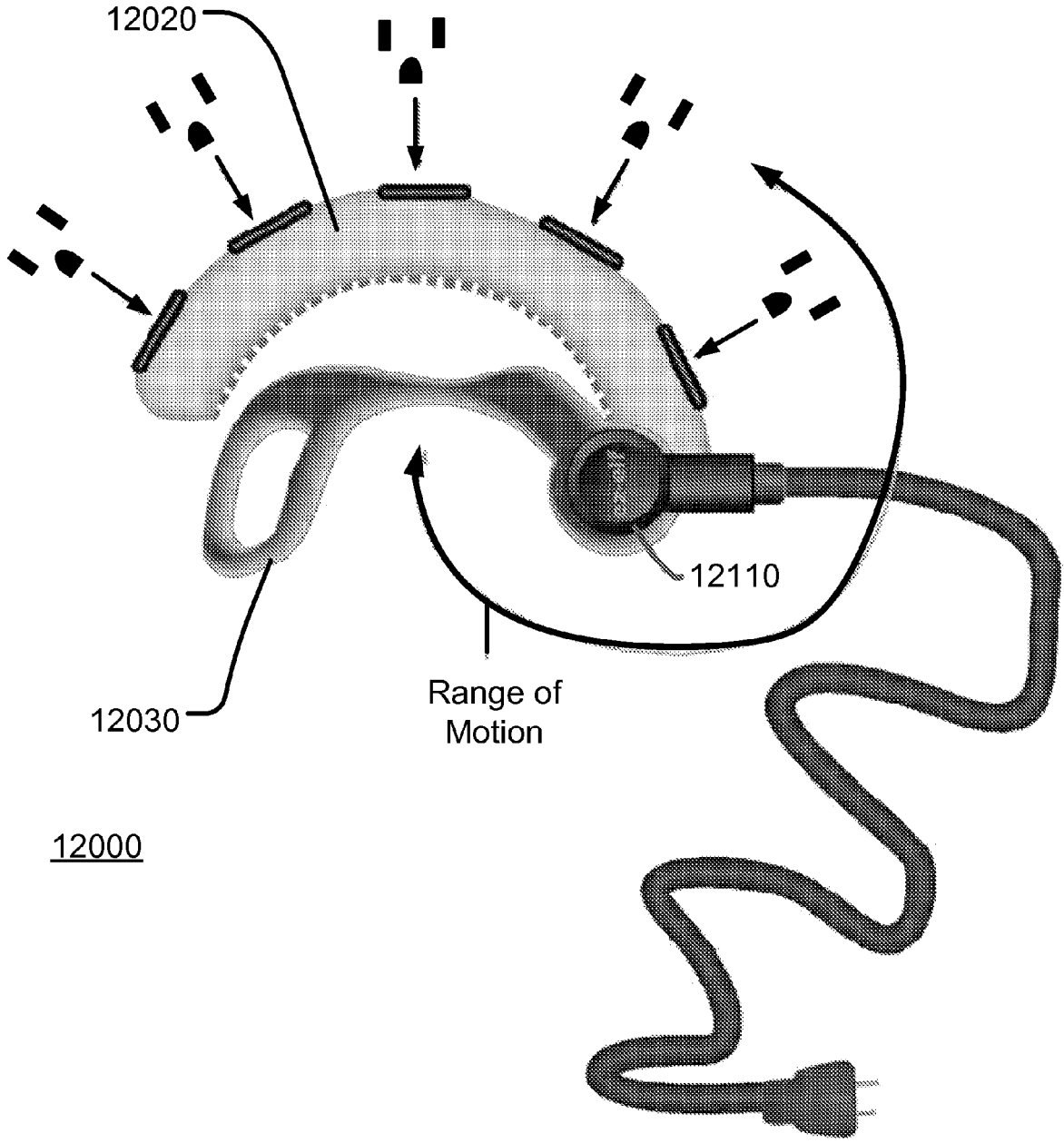

A power strip 12000 is illustrated in FIG. 34 and includes spring-biased arm sections 12020,12030. Only arm section 12020 includes electrical receptacles, and five are provided. The arm sections 12020,12030 are biased toward one another by an internal biasing component (not shown) disposed at the pivot coupling 12110, which biasing component provides the clamping force for mounting of the power strip 12000 onto an object. As will be apparent from FIG. 34, the two arm sections have a relative wide range of motion. The power strip further may include a ratcheting mechanism (not shown) permitting the arm sections to be moved toward one another, but precluding the arm sections from moving away from one another. A release button (not shown) also may be provided for enabling the arm sections to be parted.

Figure 35:
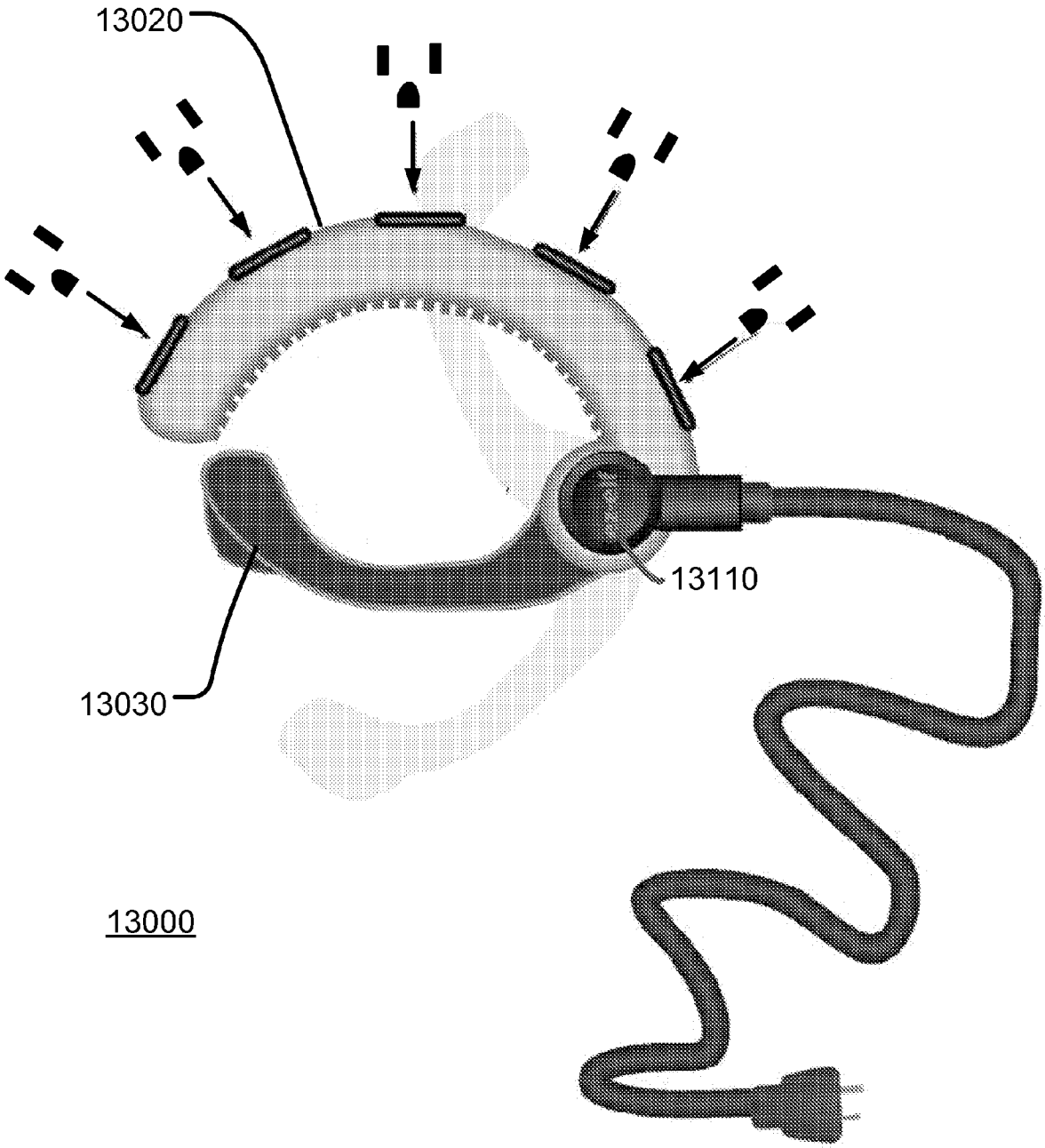

A power strip 13000 is illustrated in FIG. 35 and includes spring-biased arm sections 13020,13030. Only arm section 13020 includes electrical receptacles, and five are provided. The arm sections 13020,13030 are biased toward one another by an internal biasing component (not shown) disposed at the pivot coupling 13110, which biasing component provides the clamping force for mounting of the power strip 13000 onto an object. As will be apparent from FIG. 35, the two arm sections have a relative wide range of motion as shown in phantom by two possible alternate positions of arm section 13030. The power strip further may include a ratcheting mechanism (not shown) permitting the arm sections to be moved toward one another, but precluding the arm sections from moving away from one another. A release button (not shown) also may be provided for enabling the arm sections to be parted.

Figure 36:
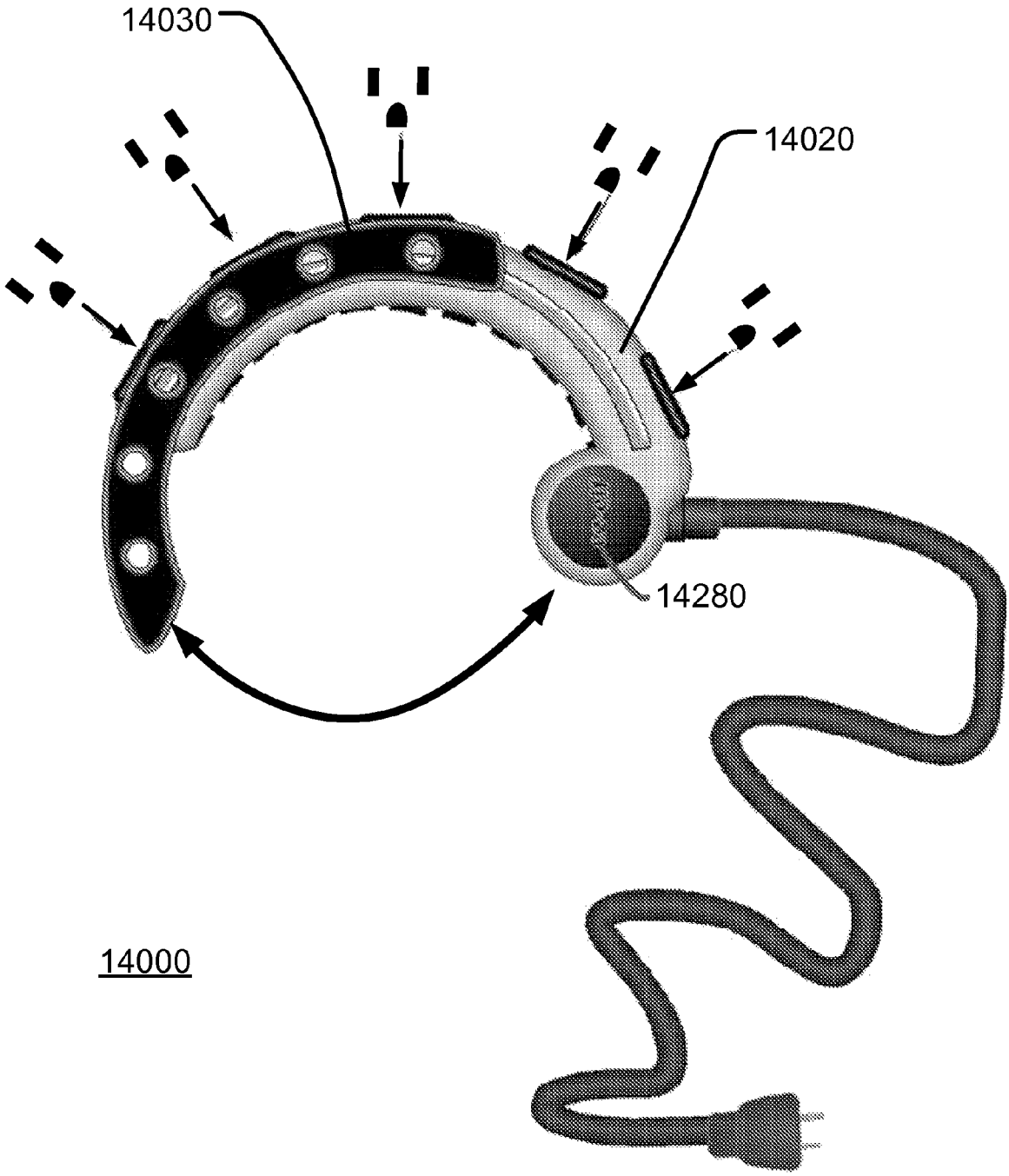

A power strip 14000 is illustrated in FIG. 36 and includes spring-biased arm sections 14020,14030. Only arm section 14020 includes electrical receptacles, and five are provided. The arm sections 14020,14030 are biased away from one another, in that arm section 14030 is mounted on arm section 14020 in sliding disposition relative thereof between a retracted position and a protracted position. Each arm section is generally semi-circular, and extension of the arm section 14030 results in the two arm sections at least substantially (if not completely) enclosing and enclosing an object for mounting of the power strip. As will be apparent from FIG. 36, the two arm sections have a relative wide range of motion as shown by the arrow. The power strip further may include a ratcheting mechanism (not shown) permitting the arm section 14030 to be moved at defined increments from the retracted position toward the protracted position, but precluding the arm section 14030 from moving from the protracted position toward the retracted position. A release button (not shown) also may be provided for enabling the arm section 14030 to be moved from the protracted position toward the retracted position for release of the power strip from the object.

Figure 37:
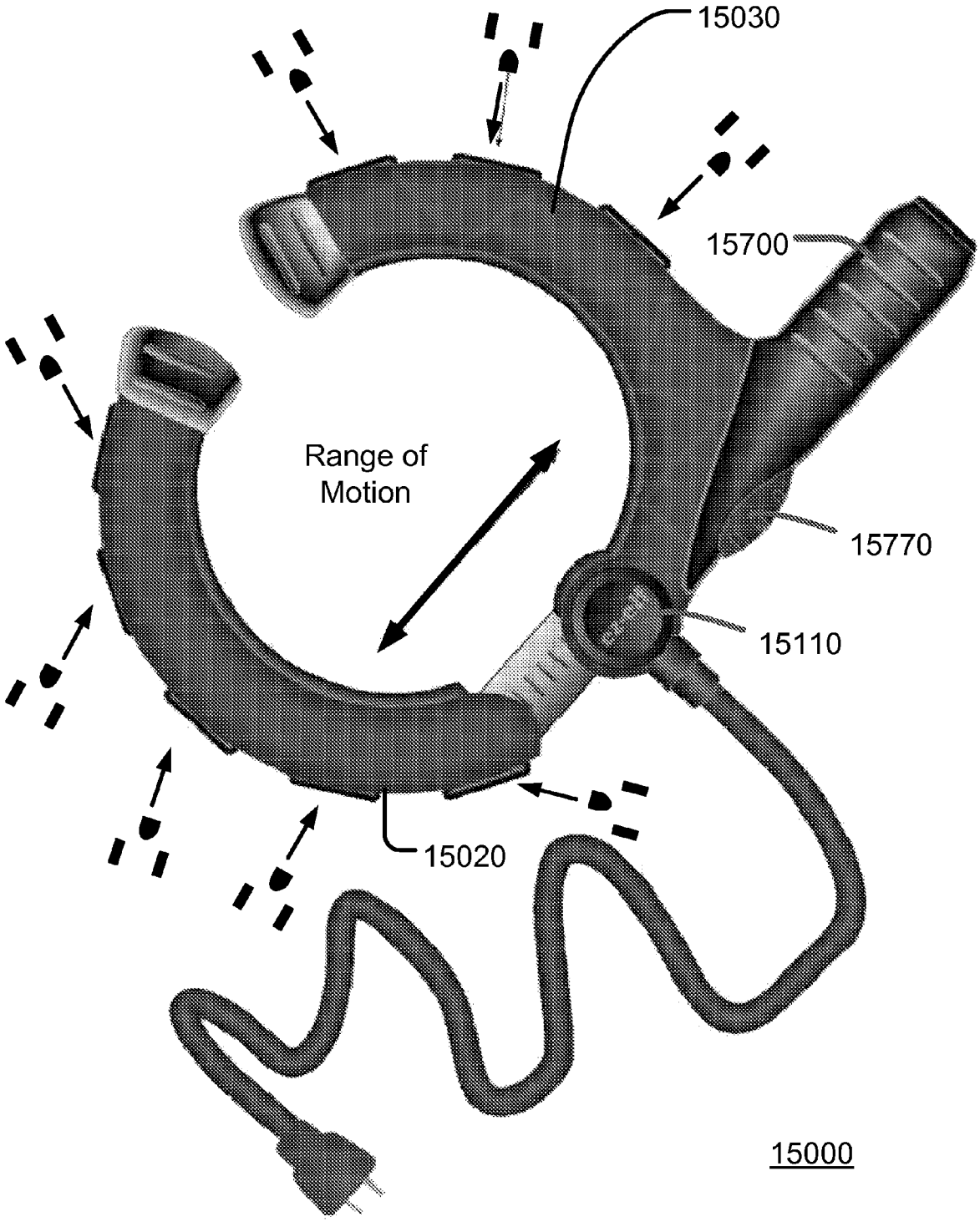

A power strip 15000 is illustrated in FIG. 37 and includes spring-biased arm sections 15020,15030. Each arm section includes electrical receptacles, with arm section 15020 including five electrical receptacles and with arm section 15030 including three electrical receptacles. Arm section 15020 preferably is received within arm section 15030 at a telescoping coupling, whereby arm section 15020 may be linearly displaced relative to arm section 15030 along the range of motion illustrated in FIG. 37. An internal biasing element (not shown) also preferably is included that biases arm sections 15020,15030 toward one another, which biasing component provides the clamping force for mounting of the power strip 15000 onto an object. A handle 15700 extends from the telescoping coupling 15110 and preferably is formed by an extension of the arm section 15030. The power strip further preferably includes a ratcheting mechanism (not shown) permitting the arm sections 15020,15030 to be moved toward one another, but precluding arm sections 15020,15030 from moving away from one another, and handle 15700 preferably includes a release button 15770 for enabling the arm sections to be parted.

Figure 38:
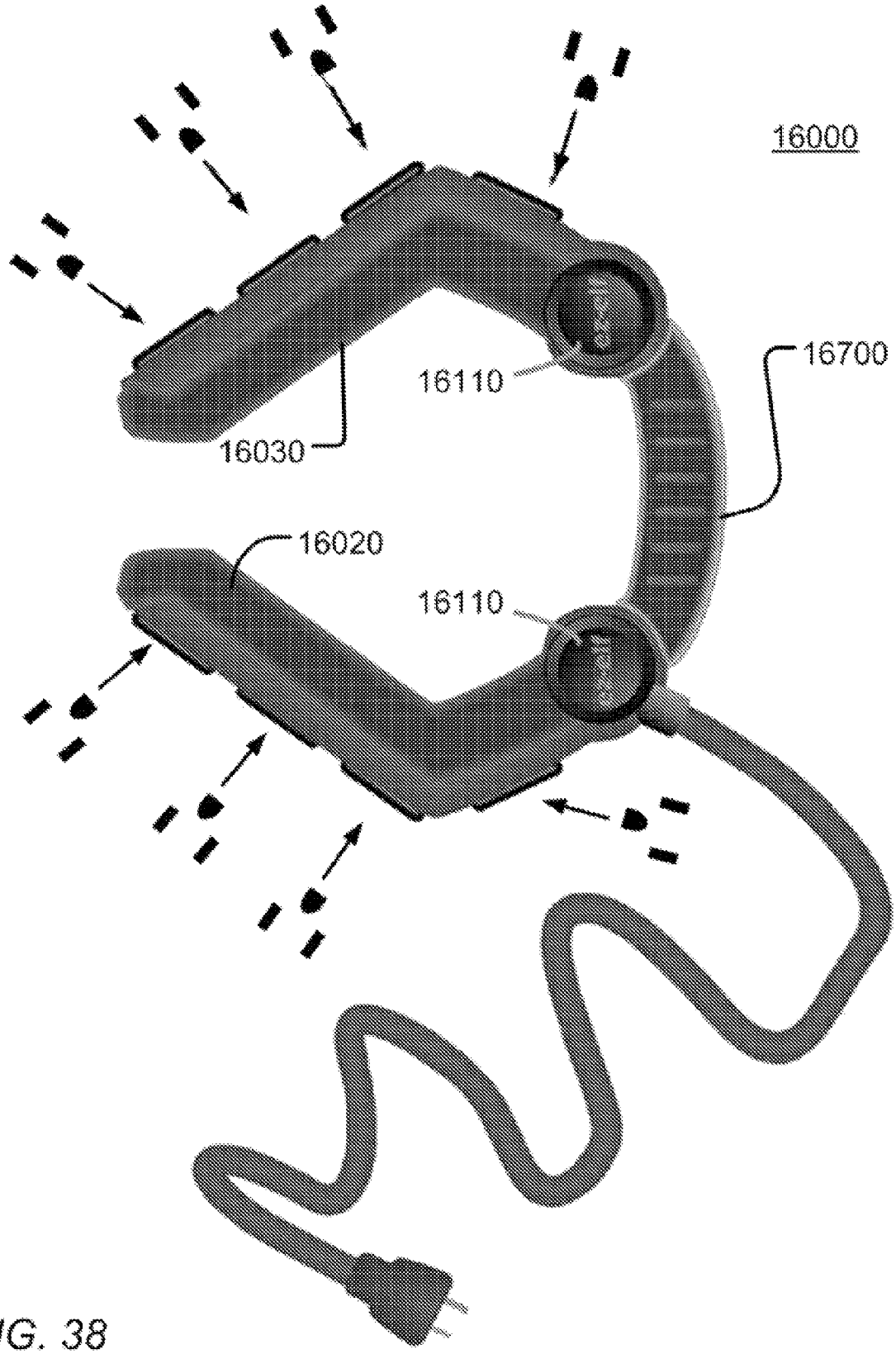

A power strip 16000 is illustrated in FIG. 38 and includes spring-biased arm sections 16020,16030. Each arm section includes four electrical receptacles. Furthermore, on each arm section, three of the receptacles are disposed on a first side and the other one is disposed on a second side that, generally, is disposed at an angle to the first side of between about 100 degrees and about 120 degrees. The arm sections 16020,16030 are connected by a handle 16700 and are biased toward one another by internal biasing components (not shown), each biasing component being disposed at a respective pivot coupling 16110 of an arm section to the handle 16700. The biasing components collectively provide the clamping force for mounting of the power strip 16000 onto an object. As further will be apparent from FIG. 38, the power strip 16000 includes two pivot couplings 16110 that have generally parallel pivot axes. Furthermore, each arm section preferably is independently biased about the pivot axis of its respective pivot coupling.

Figure 39:
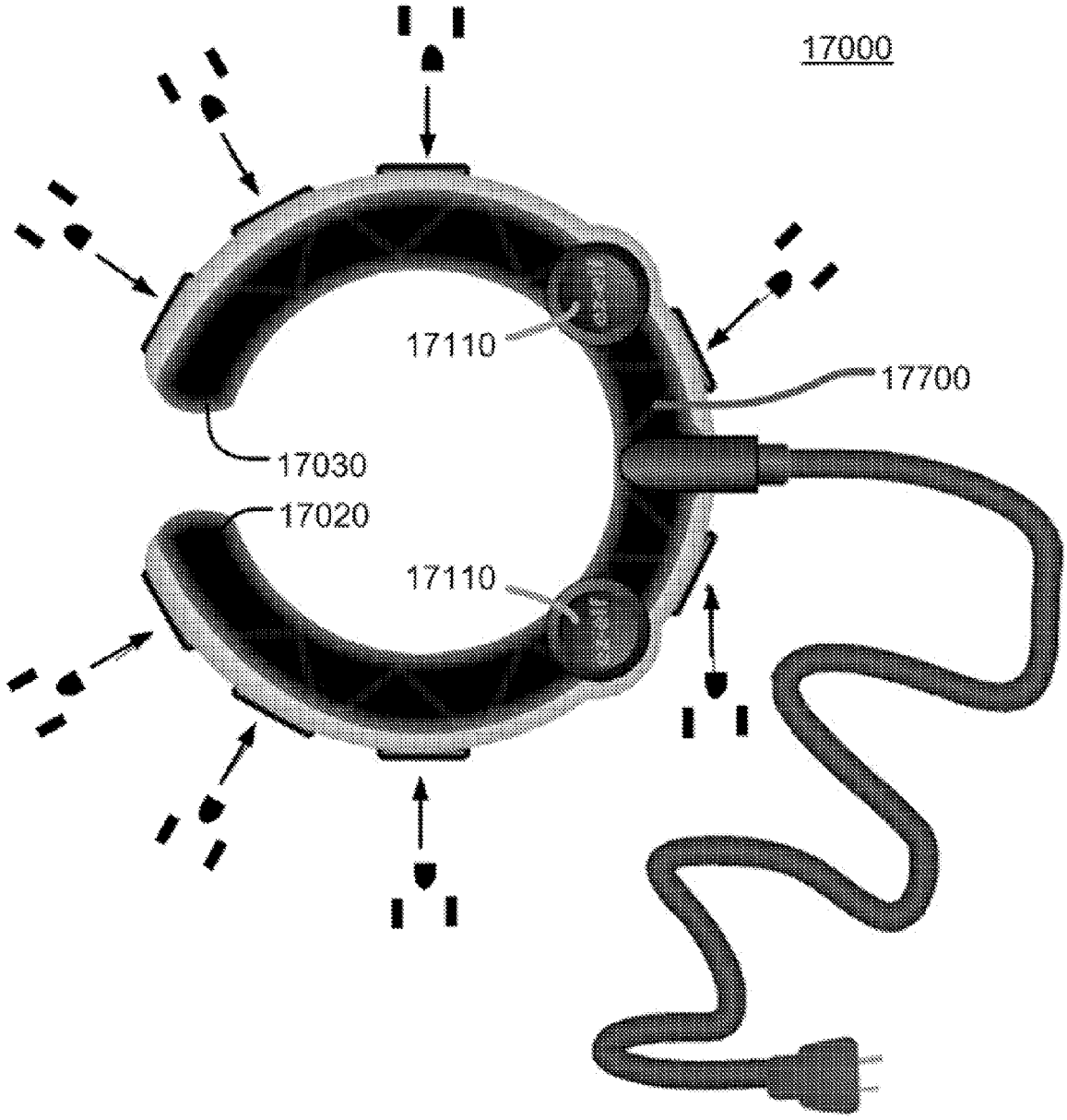

A power strip 17000 is illustrated in FIG. 39 and includes spring-biased arm sections 17020,17030. Each arm section includes three electrical receptacles. The arm sections 17020, 17030 are connected by a handle 16700 and are biased toward one another by internal biasing components (not shown), each biasing component being disposed at a respective pivot coupling 17110 where an arm section is joined to the handle 17700. The biasing components collectively provide the clamping force for mounting of the power strip 17000 onto an object. As further will be apparent from FIG. 39, the power strip 17000 includes two pivot couplings 17110 that have generally parallel pivot axes. Each arm section preferably is independently biased about the pivot axis of its respective pivot coupling. Furthermore, the handle 17700 includes two electrical receptacles, each one being located on an opposite side of the power cord.

Figure 40:
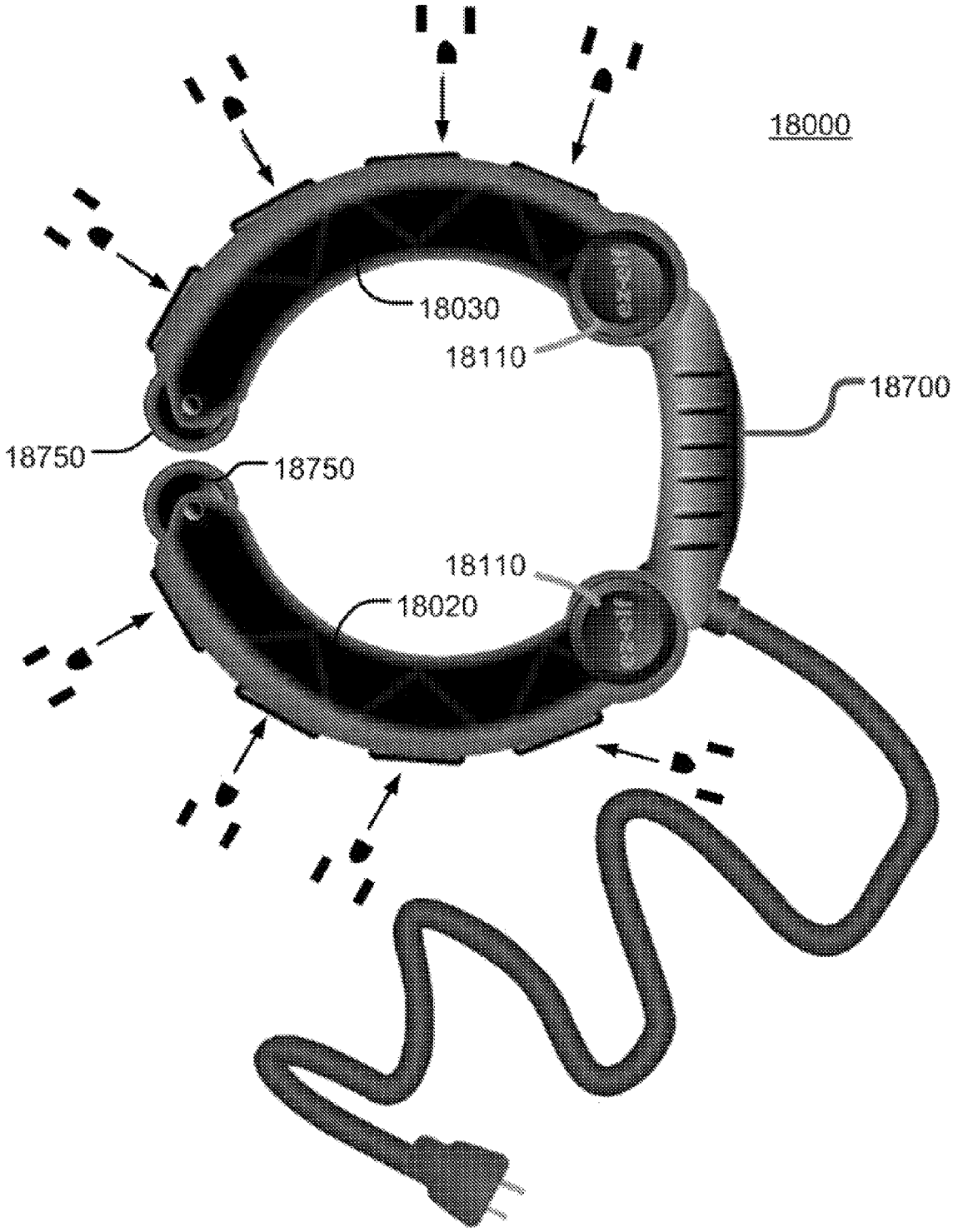

A power strip 18000 is illustrated in FIG. 40 and includes spring-biased arm sections 18020,18030. Each arm section includes four electrical receptacles. The arm sections 18020, 18030 are connected by a handle 18700 and are biased toward one another by internal biasing components (not shown), each biasing component being disposed at a respective pivot coupling 18110 where an arm section is joined to the handle 18700. The biasing components collectively provide the clamping force for mounting of the power strip 18000 onto an object. As further will be apparent from FIG. 40, the power strip 18000 includes two pivot couplings 18110 that have generally parallel pivot axes. Each arm section preferably is independently biased about the pivot axis of its respective pivot coupling. Furthermore, guides in the form of rollers 18750 are mounted to distal ends of the arm sections 18020, 18030. By pushing against an object with the rollers, a user can part the arm sections 18020,18030 for mounting of the power strip 18000 onto the object, which can provide a "snap-on" attachment of the power strip 18000.

Figure 41:
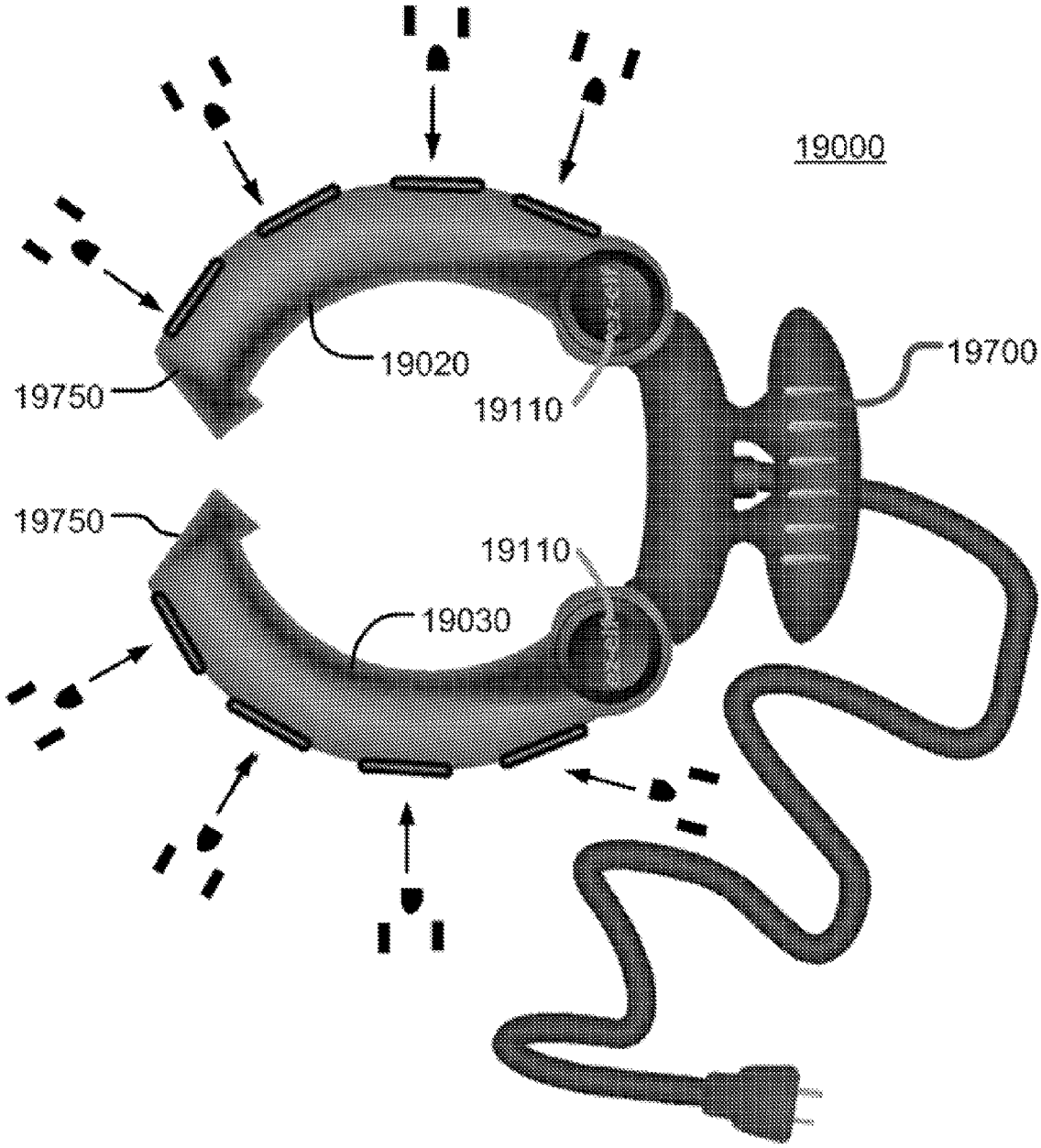

A power strip 19000 is illustrated in FIG. 41 and includes spring-biased arm sections 19020,19030. Each arm section includes four electrical receptacles. The arm sections 19020, 19030 are connected by a handle 19700 and are biased toward one another by internal biasing components (not shown), each biasing component being disposed at a respective pivot coupling 19110 where an arm section is joined to the handle 19700. The biasing components collectively provide the clamping force for mounting of the power strip 19000 onto an object. As further will be apparent from FIG. 41, the power strip 19000 includes two pivot couplings 19110 that have generally parallel pivot axes. Each arm section preferably is independently biased about the pivot axis of its respective pivot coupling. Furthermore, guides in the form of slanted or inclined surfaces 19750 are formed in the distal ends of the arm sections 19020,19030. By pushing against an object with these inclined surfaces 19750, a user can part the arm sections 19020,19030 for mounting of the power strip 19000 onto the object, which can provide a "snap-on" attachment of the power strip 19000.

Figure 42:
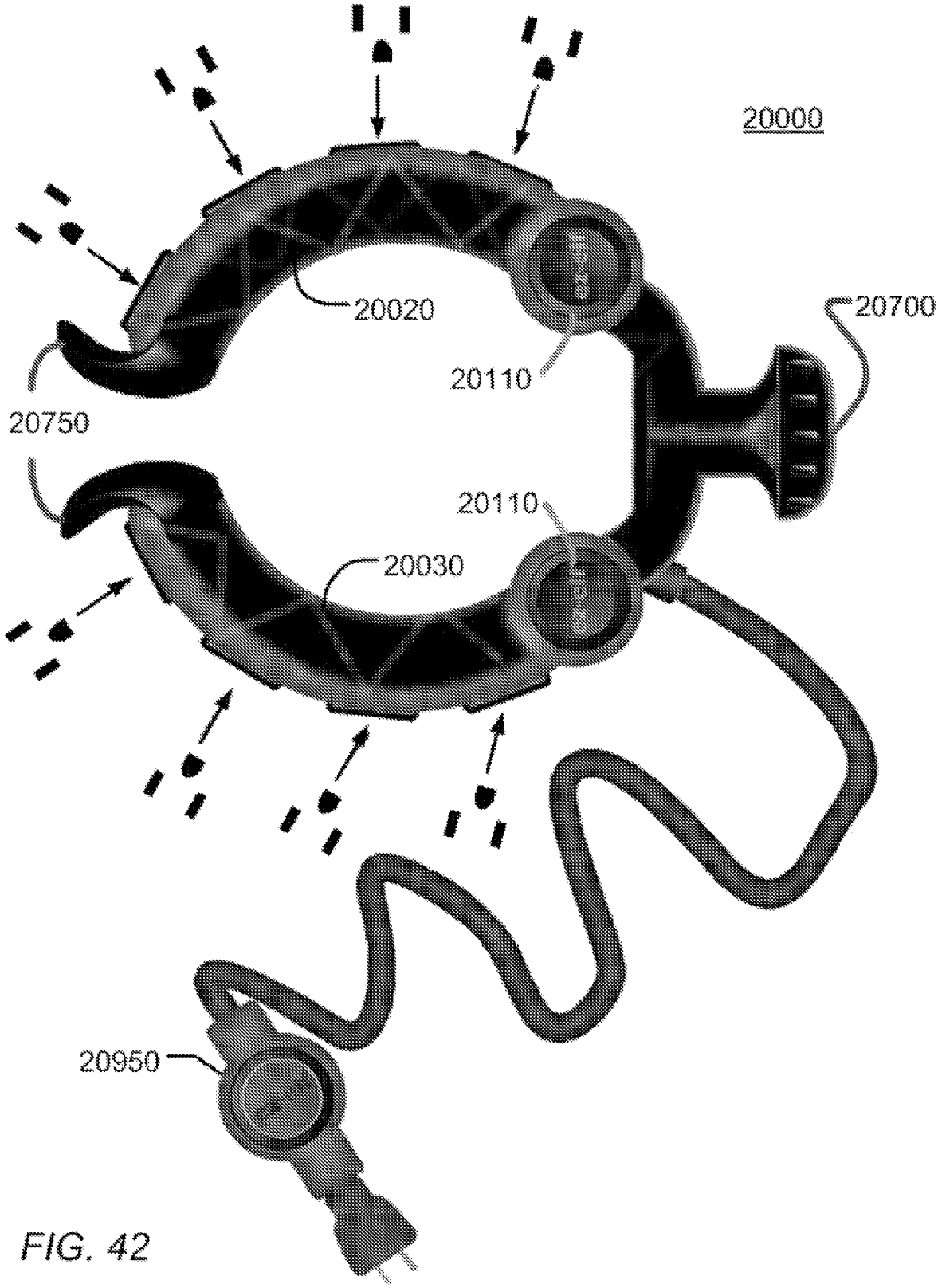
Figure 43:
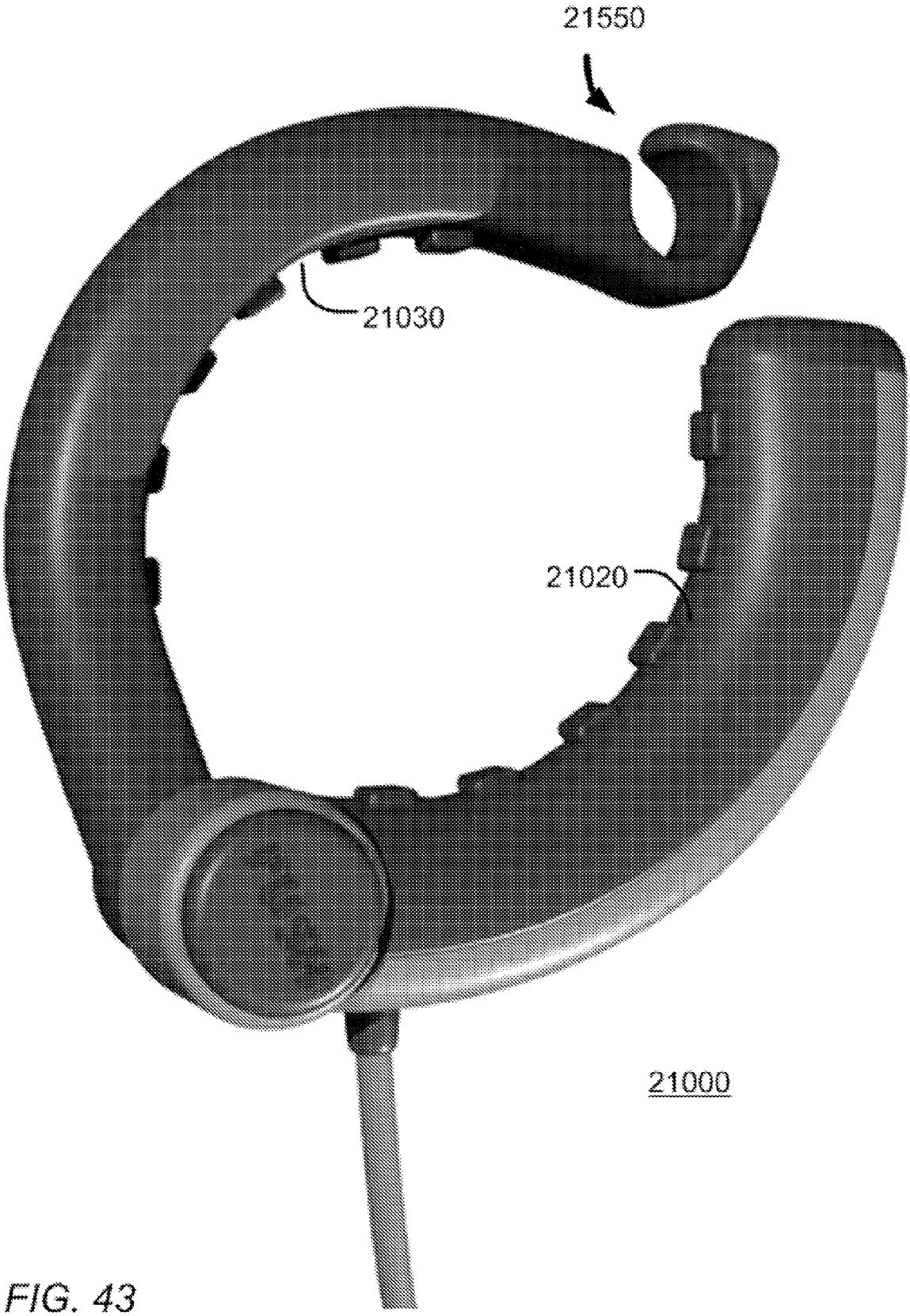
Figure 44:
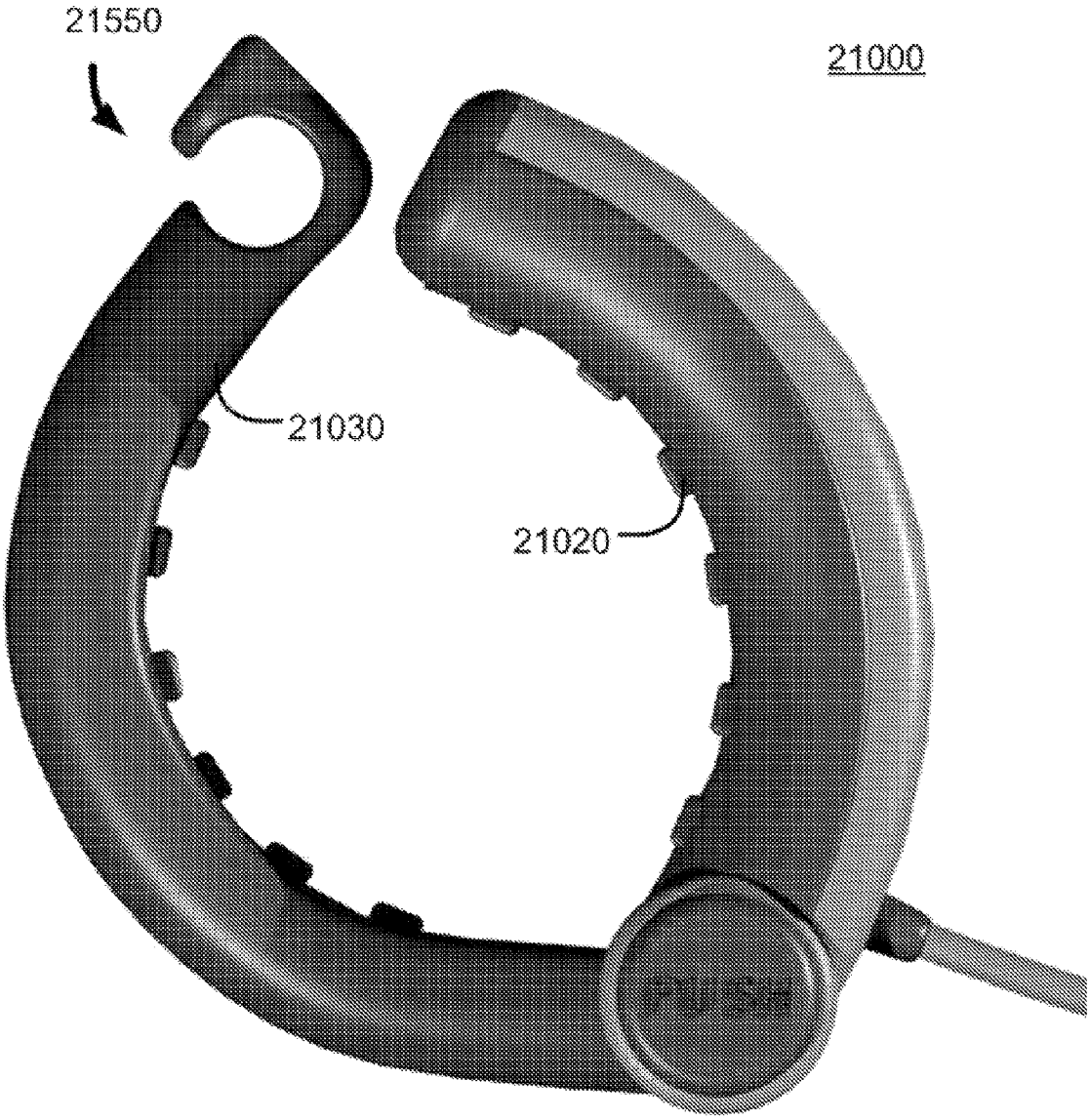

A power strip 20000 is illustrated in FIG. 42 and includes spring-biased arm sections 20020,20030. Each arm section includes four electrical receptacles. The arm sections 20020, 20030 are connected by a handle 20700 and are biased toward one another by internal biasing components (not shown), each biasing component being disposed at a respective pivot coupling 20110 where an arm section is joined to the handle 20700. The biasing components collectively provide the clamping force for mounting of the power strip 20000 onto an object. As further will be apparent from FIG. 42, the power strip 20000 includes two pivot couplings 20110 that have generally parallel pivot axes. Each arm section preferably is independently biased about the pivot axis of its respective pivot coupling. Furthermore, guides in the form of outwardly extending rounded surfaces 20750 are formed in the distal ends of the arm sections 20020,20030. By pushing against an object with these inclined surfaces 20750, a user can part the arm sections 20020,20030 for mounting of the power strip 20000 onto the object, which can provide a "snap-on" attachment of the power strip 20000. Power strip 20000 also includes a switch 20950 built into the power cord near the plug. The switch 20950 preferably illuminates when power is supplied to the power strip 20000.

Figure 45:
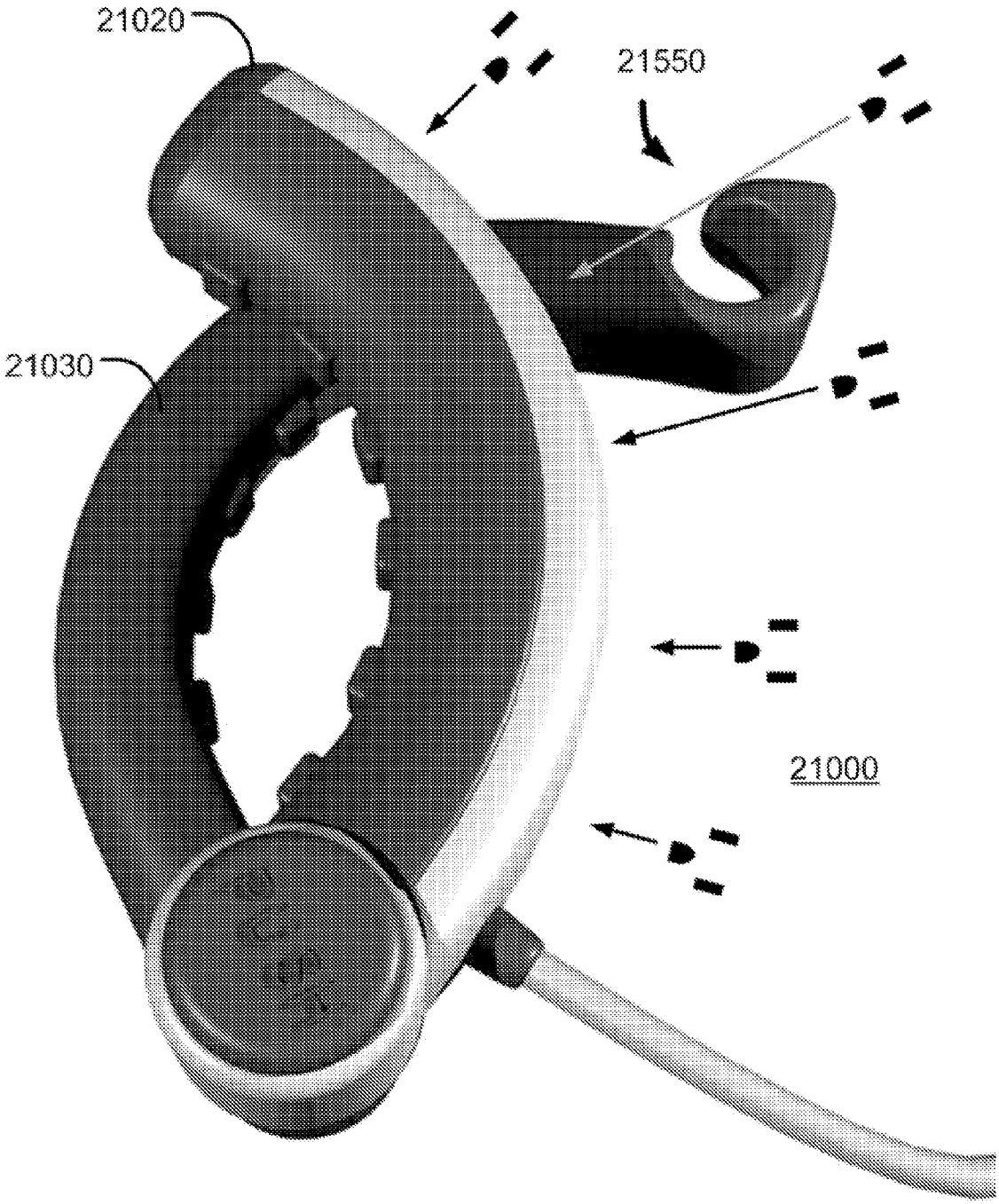
Figure 46:
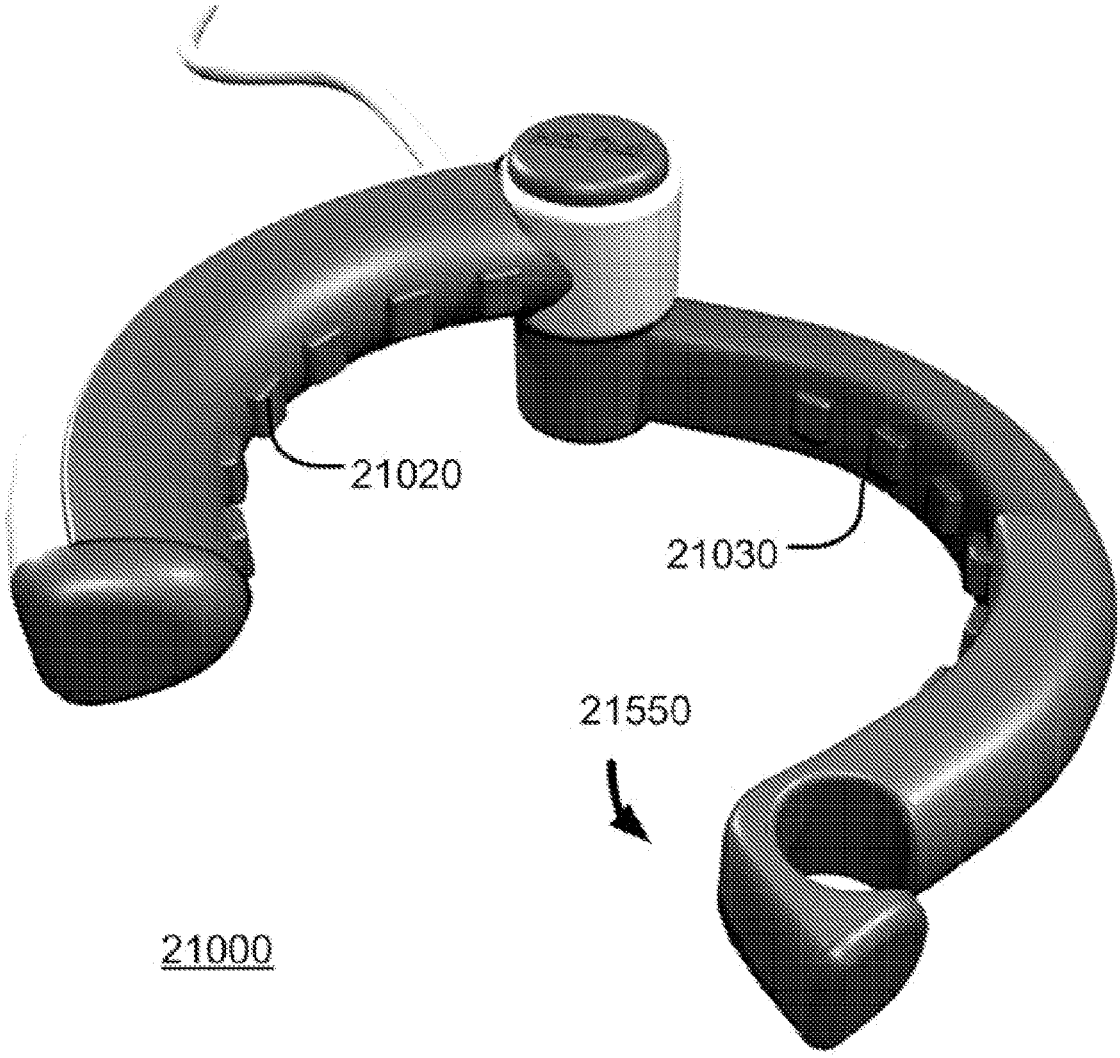
Figure 47:
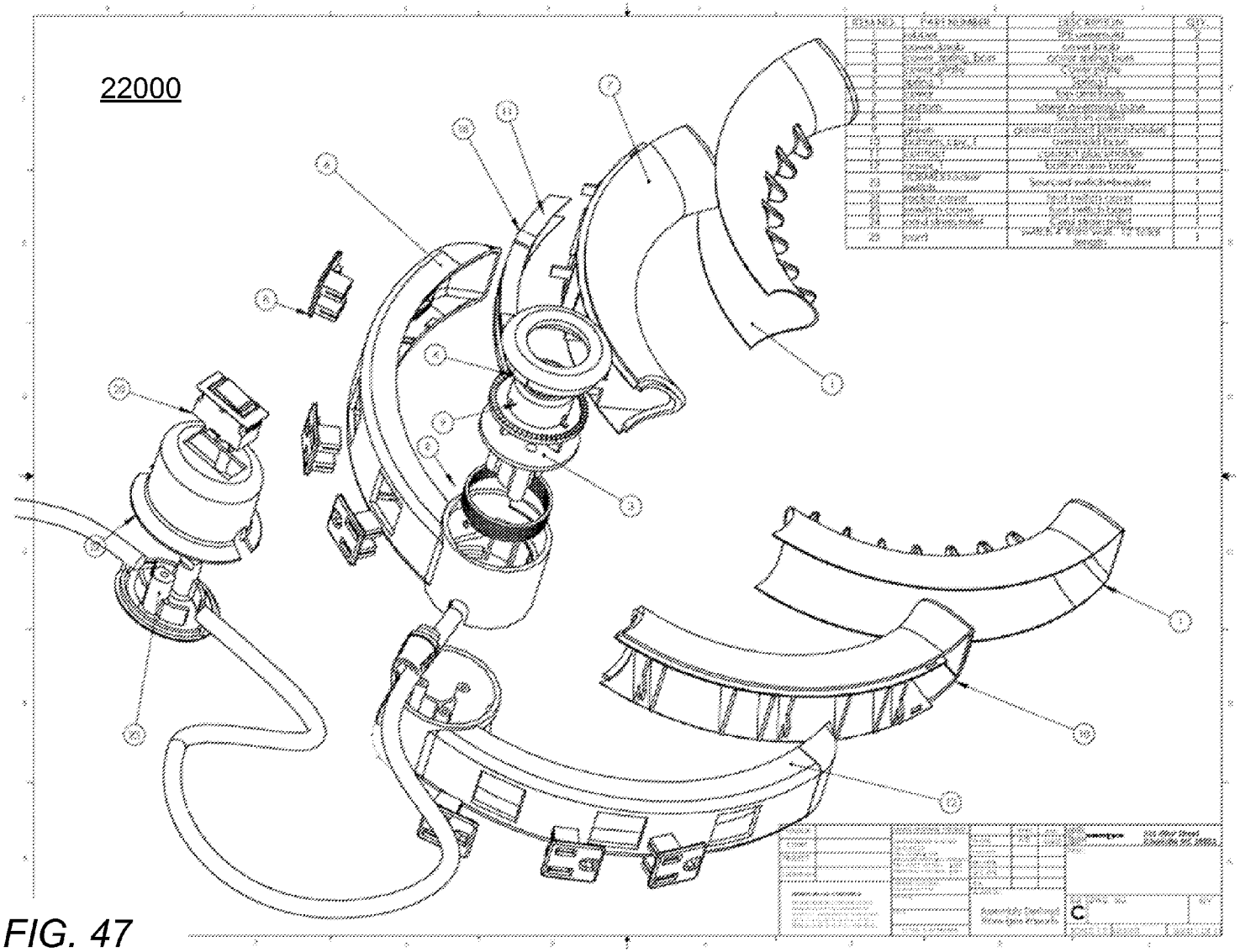
Figure 48:
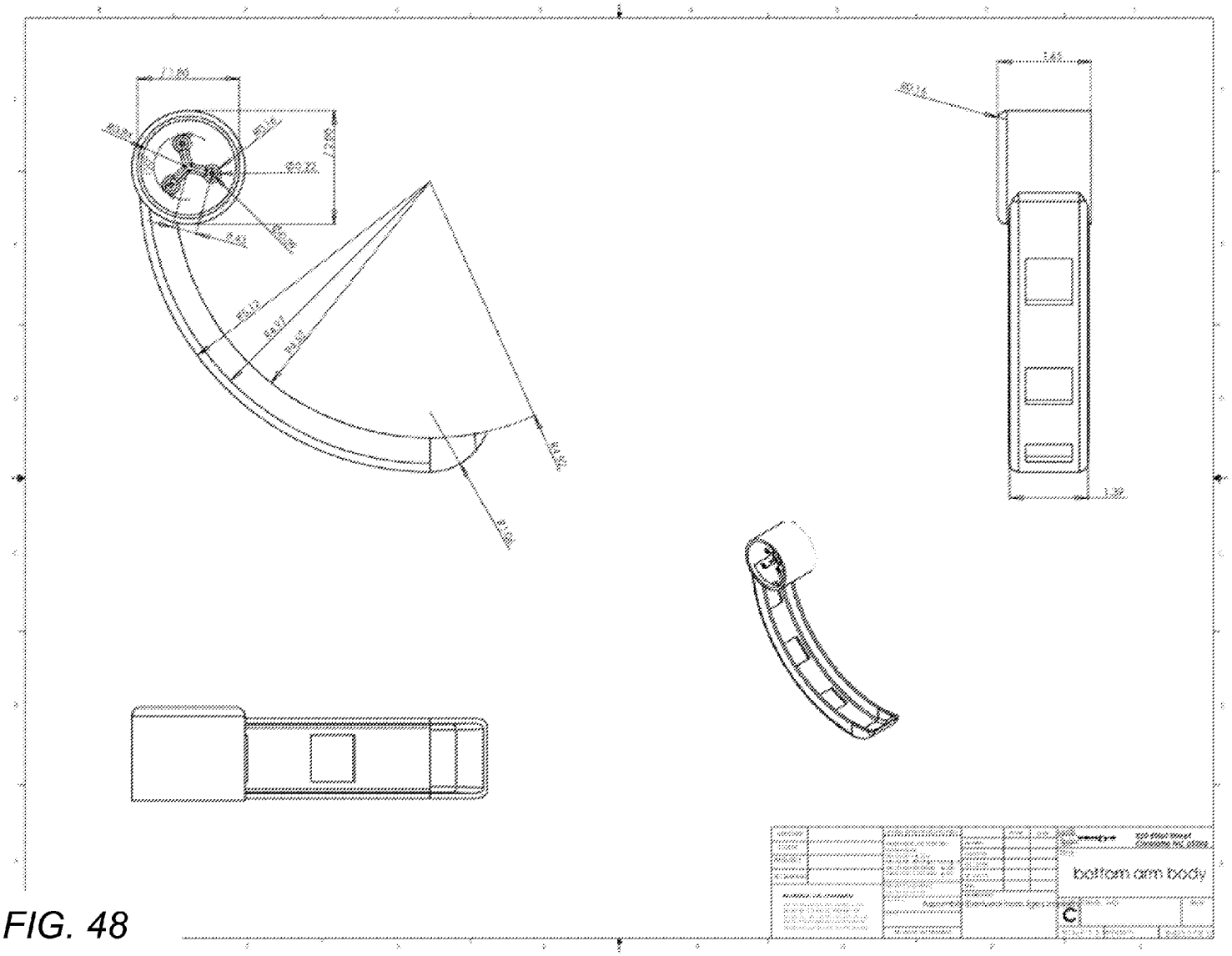
Figure 49:
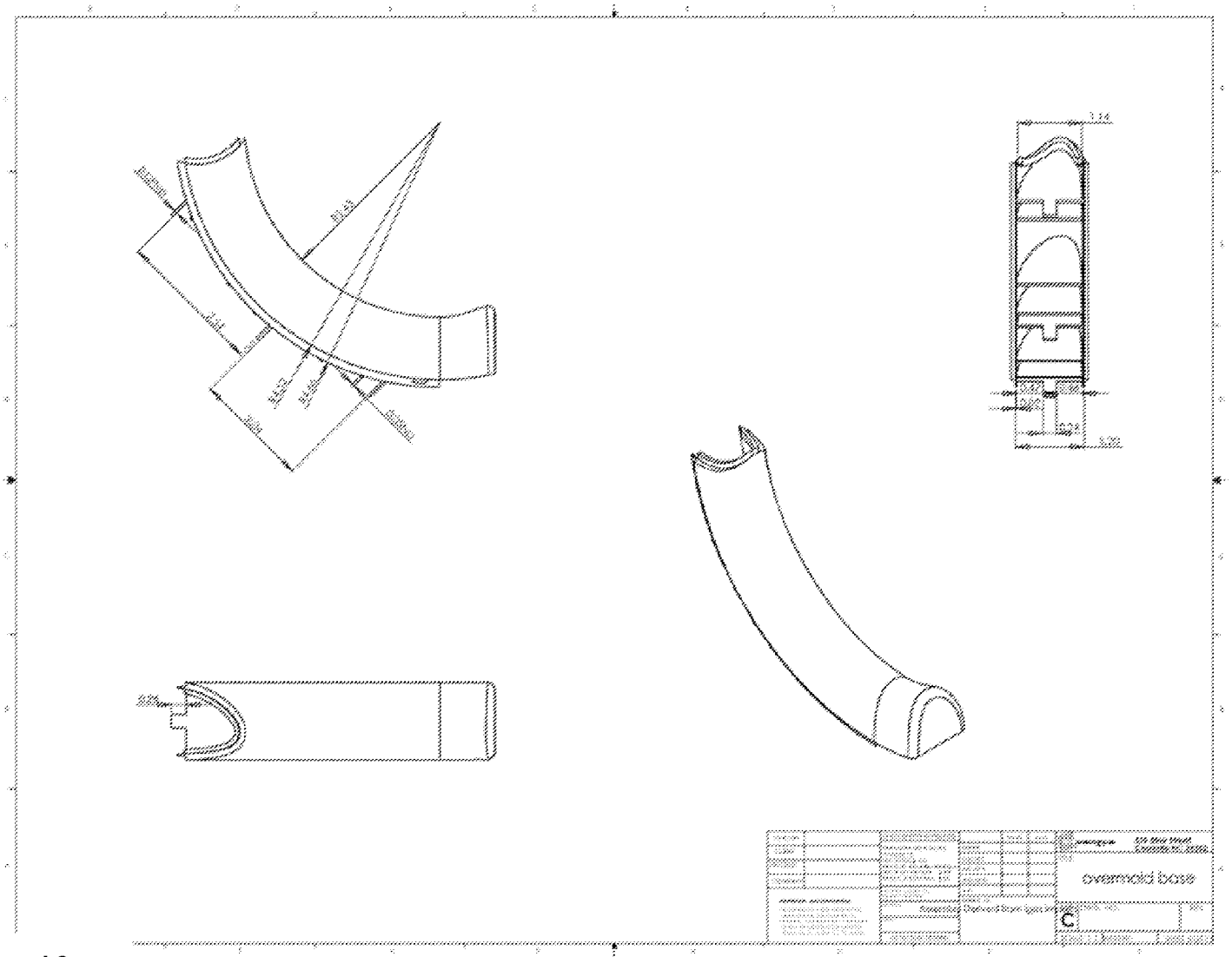
Figure 50:
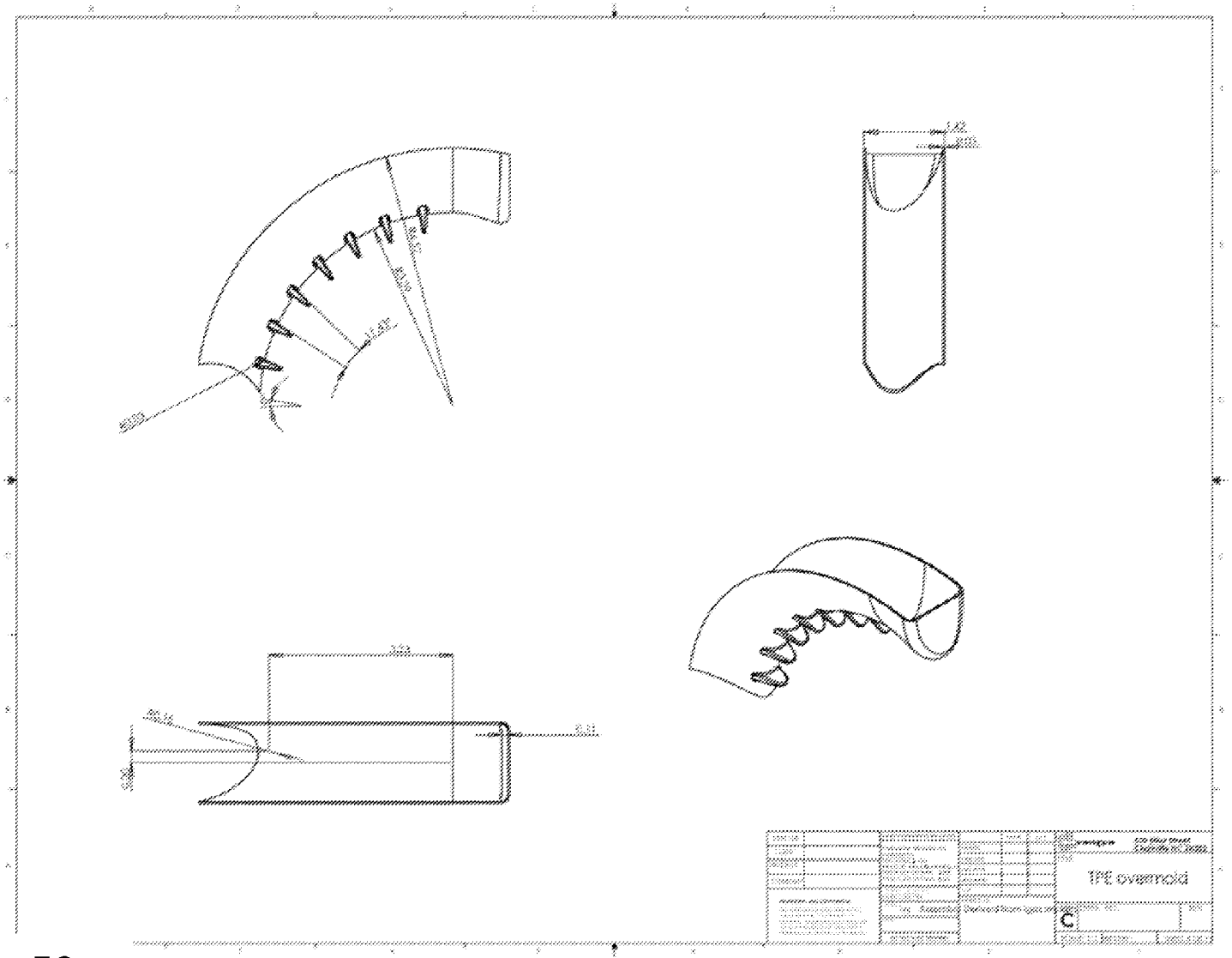
Figure 51:
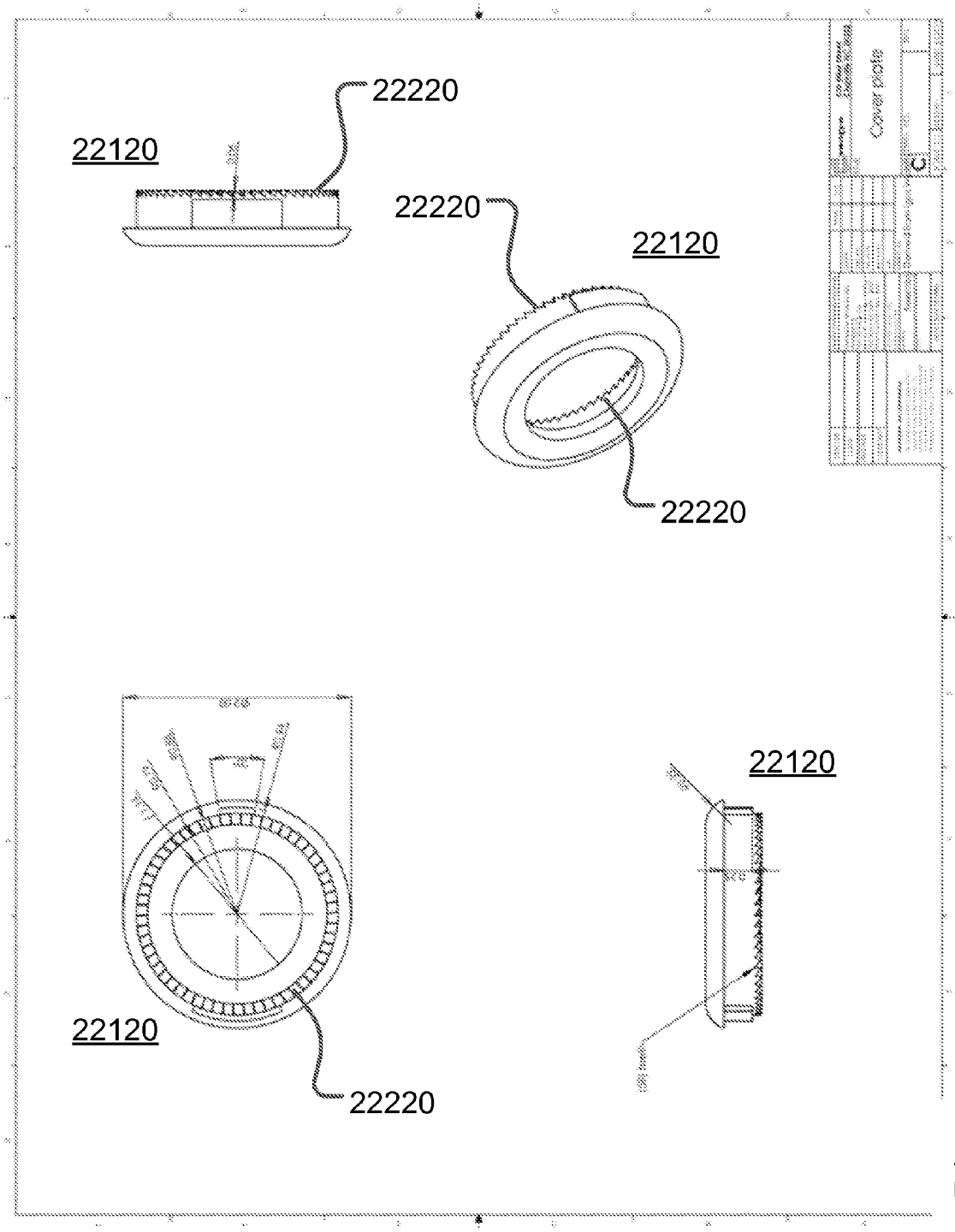
Figure 52:
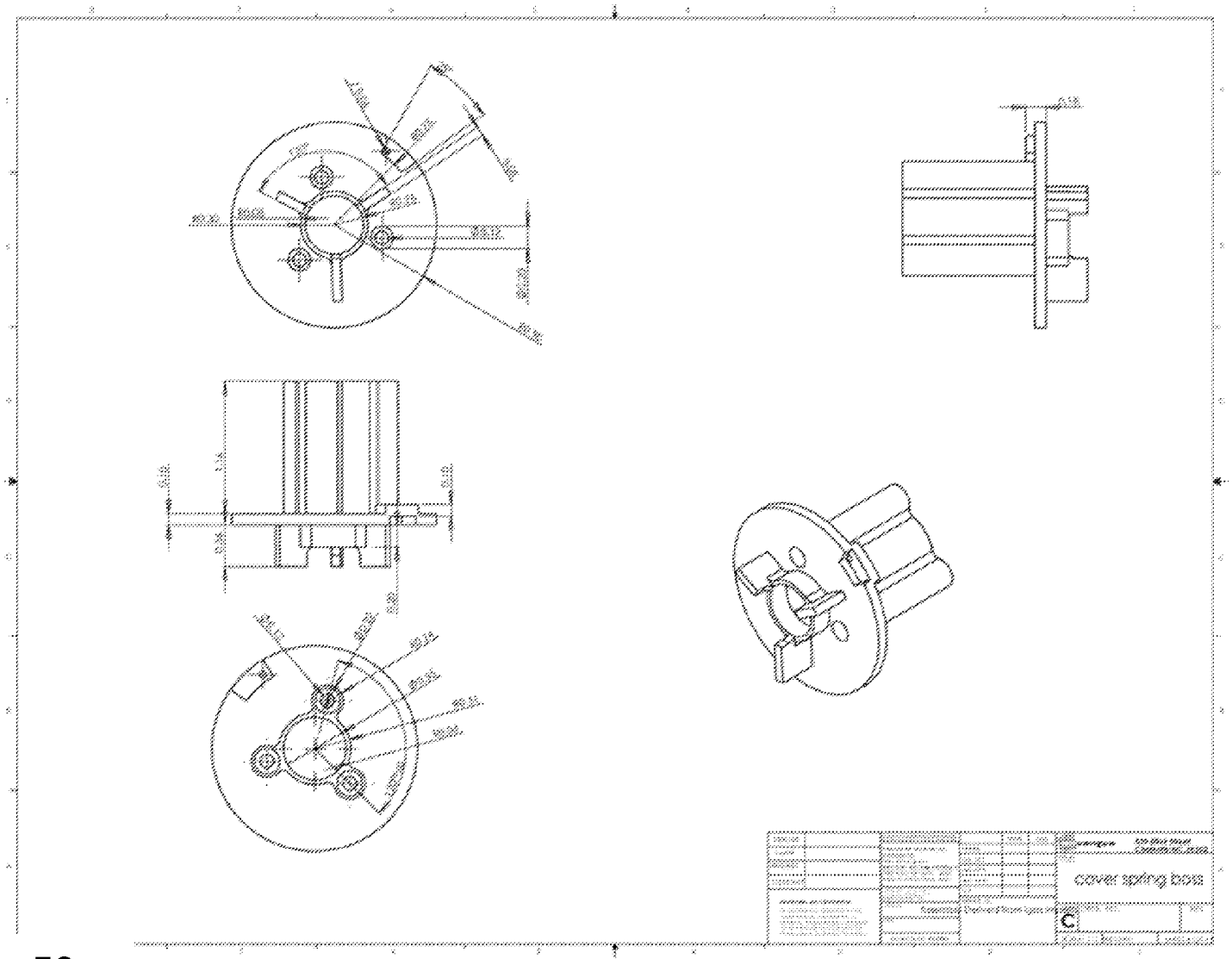
Figure 53:
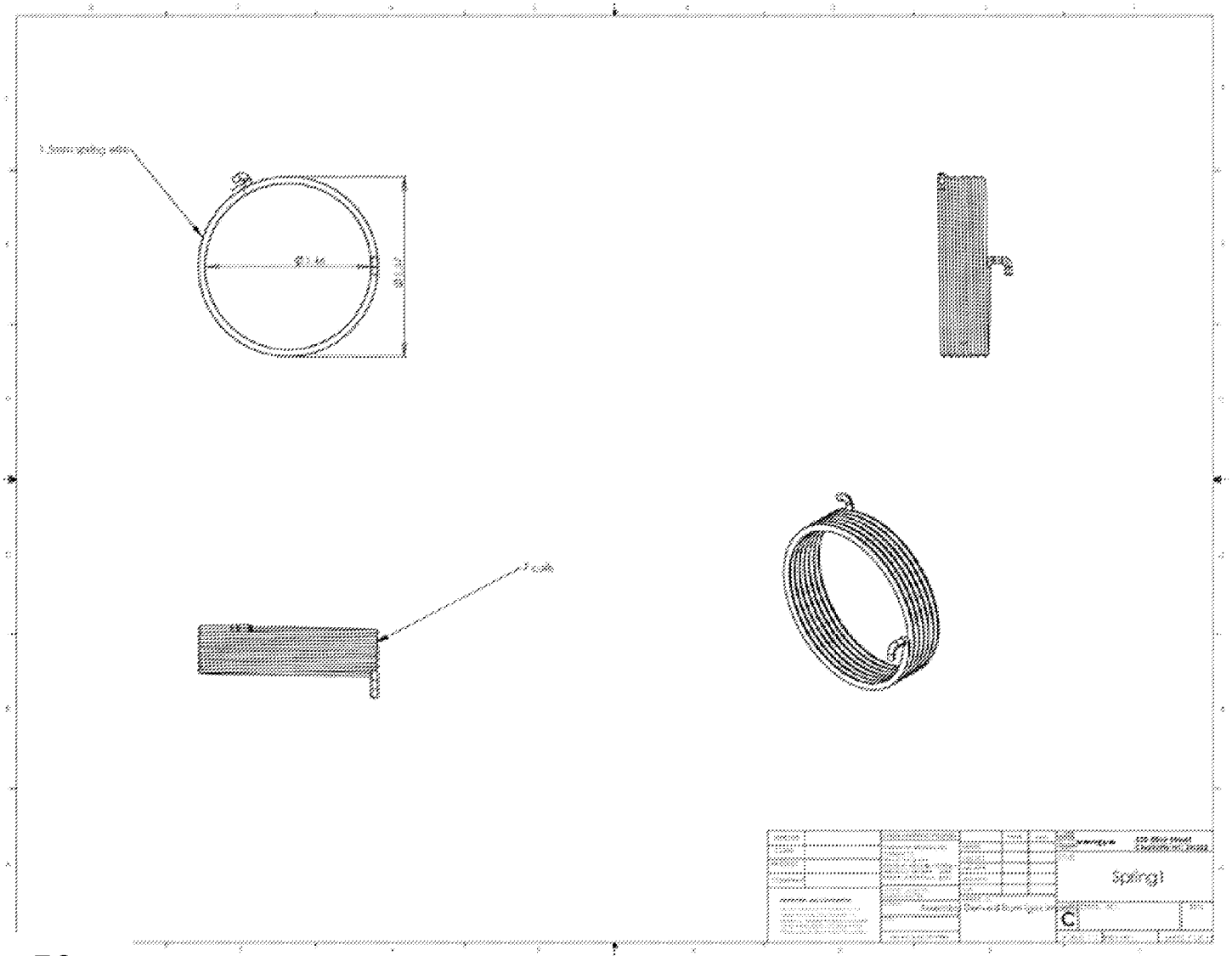
Figure 54:
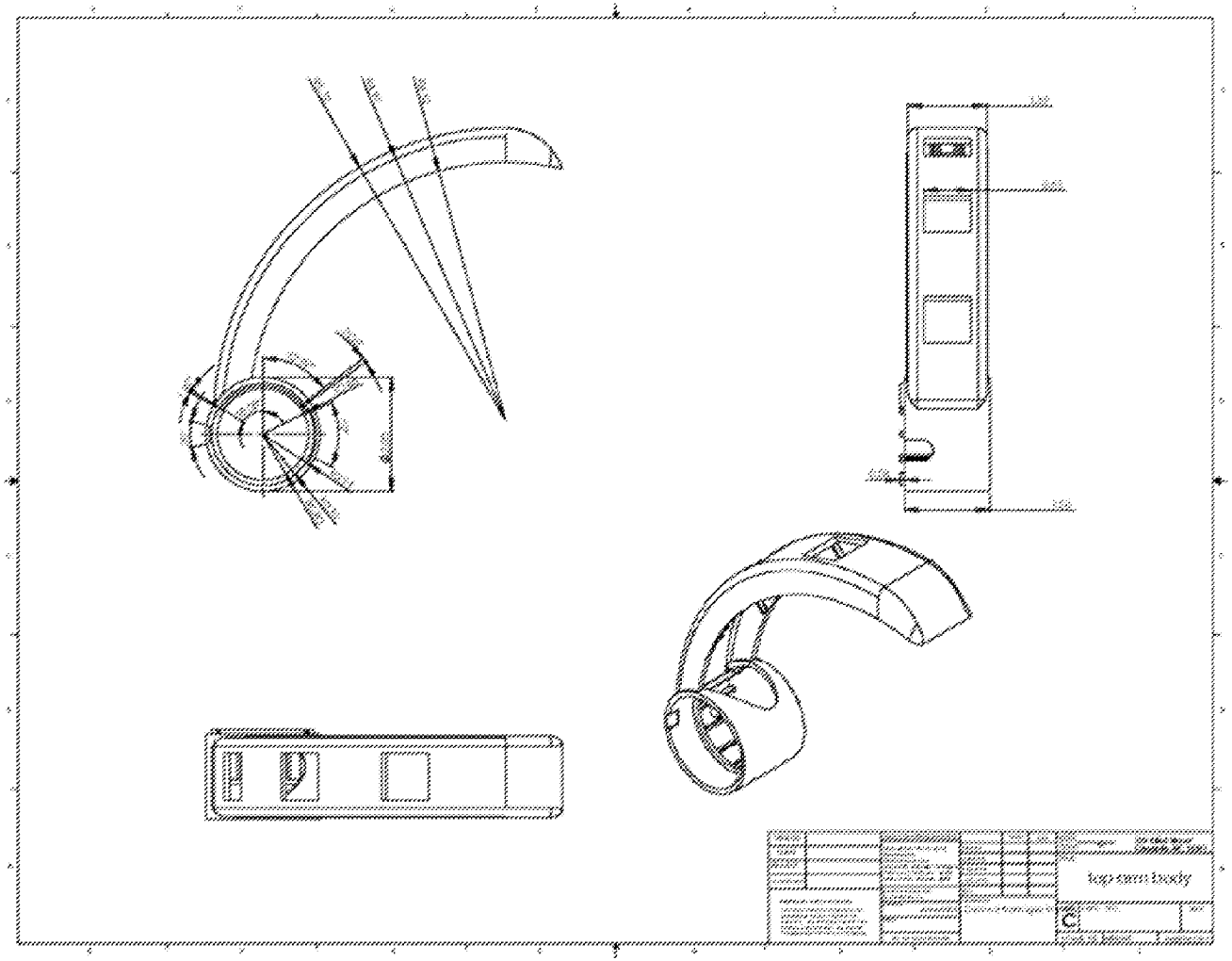
Figure 55:
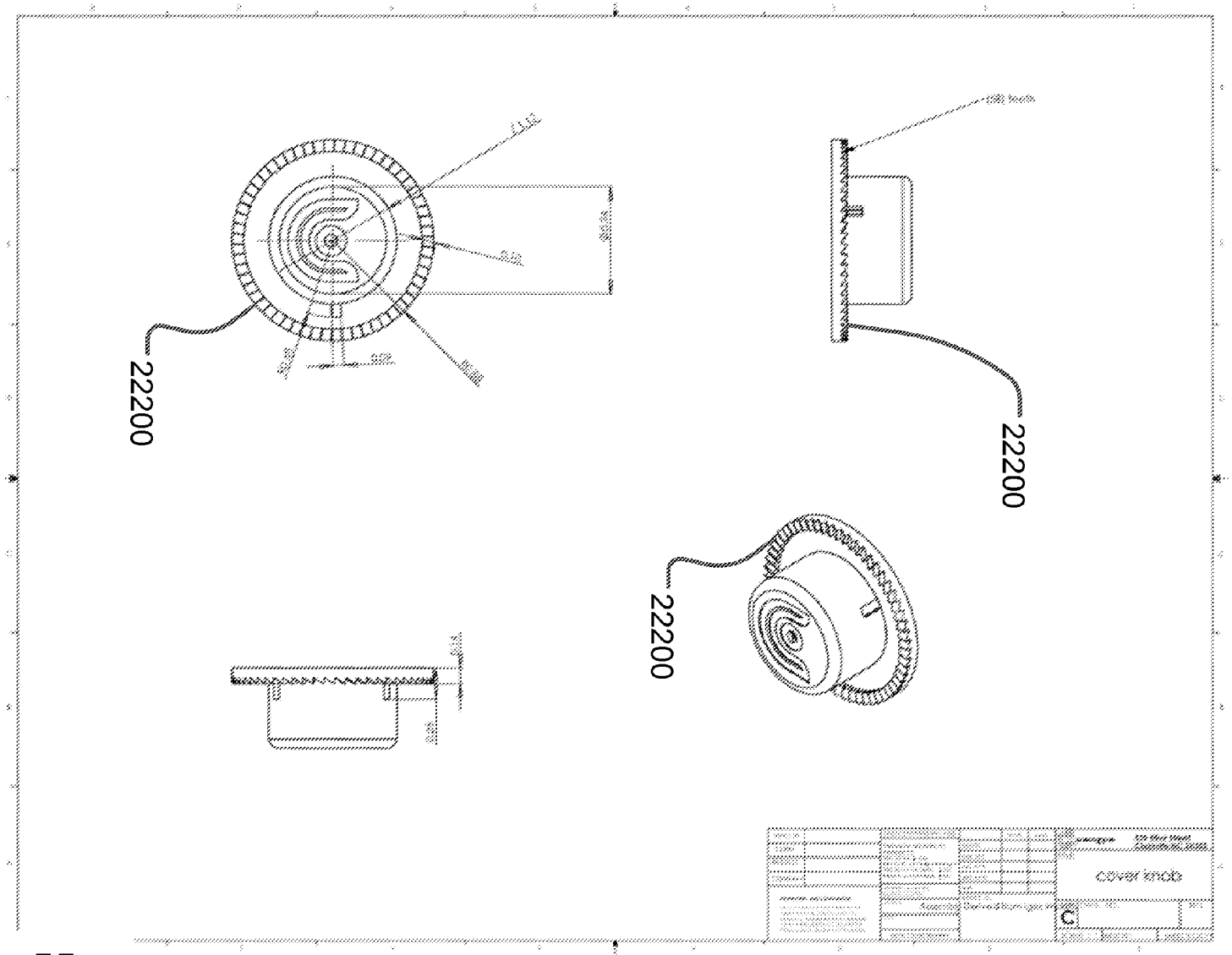
Figure 56:
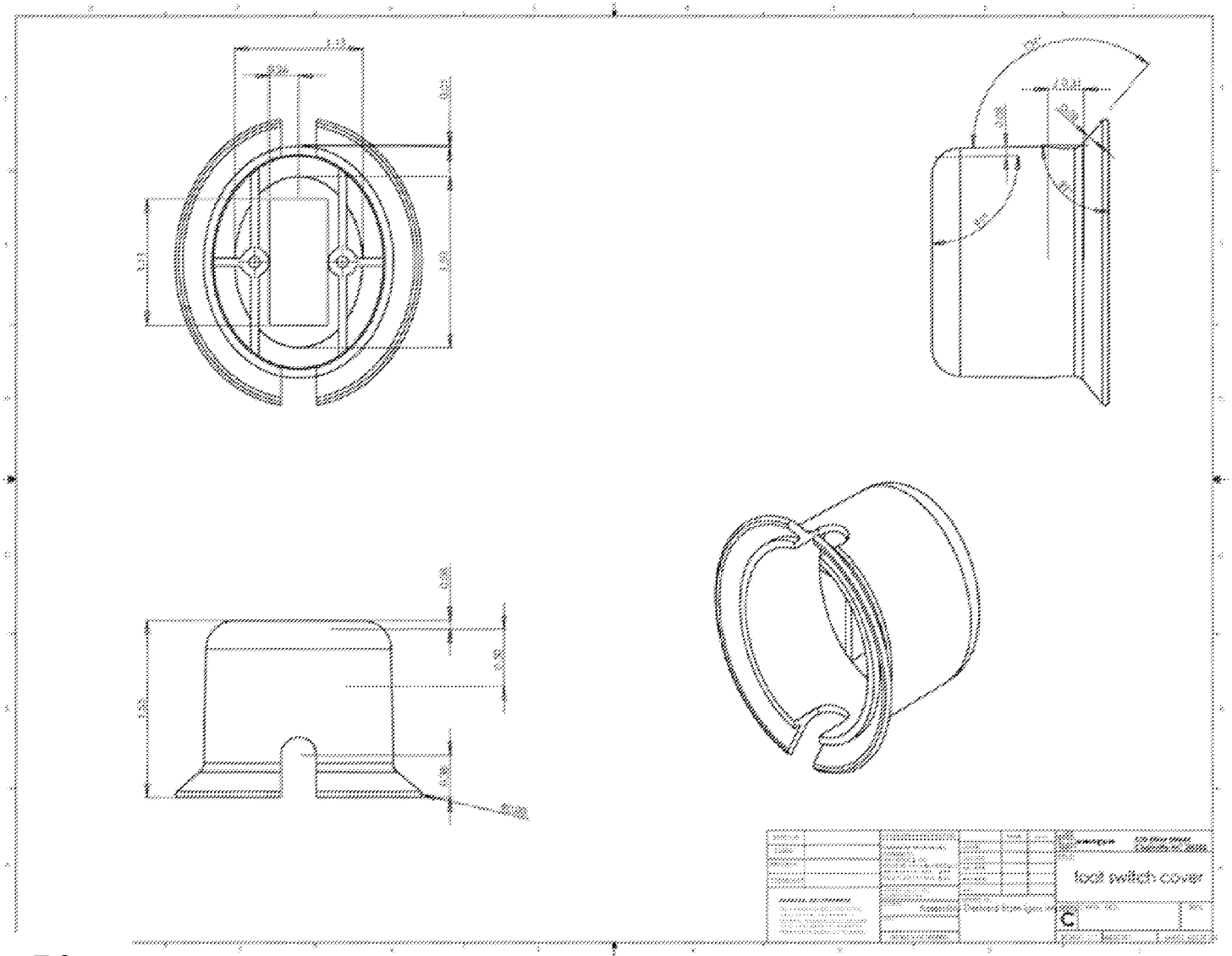
Figure 57:
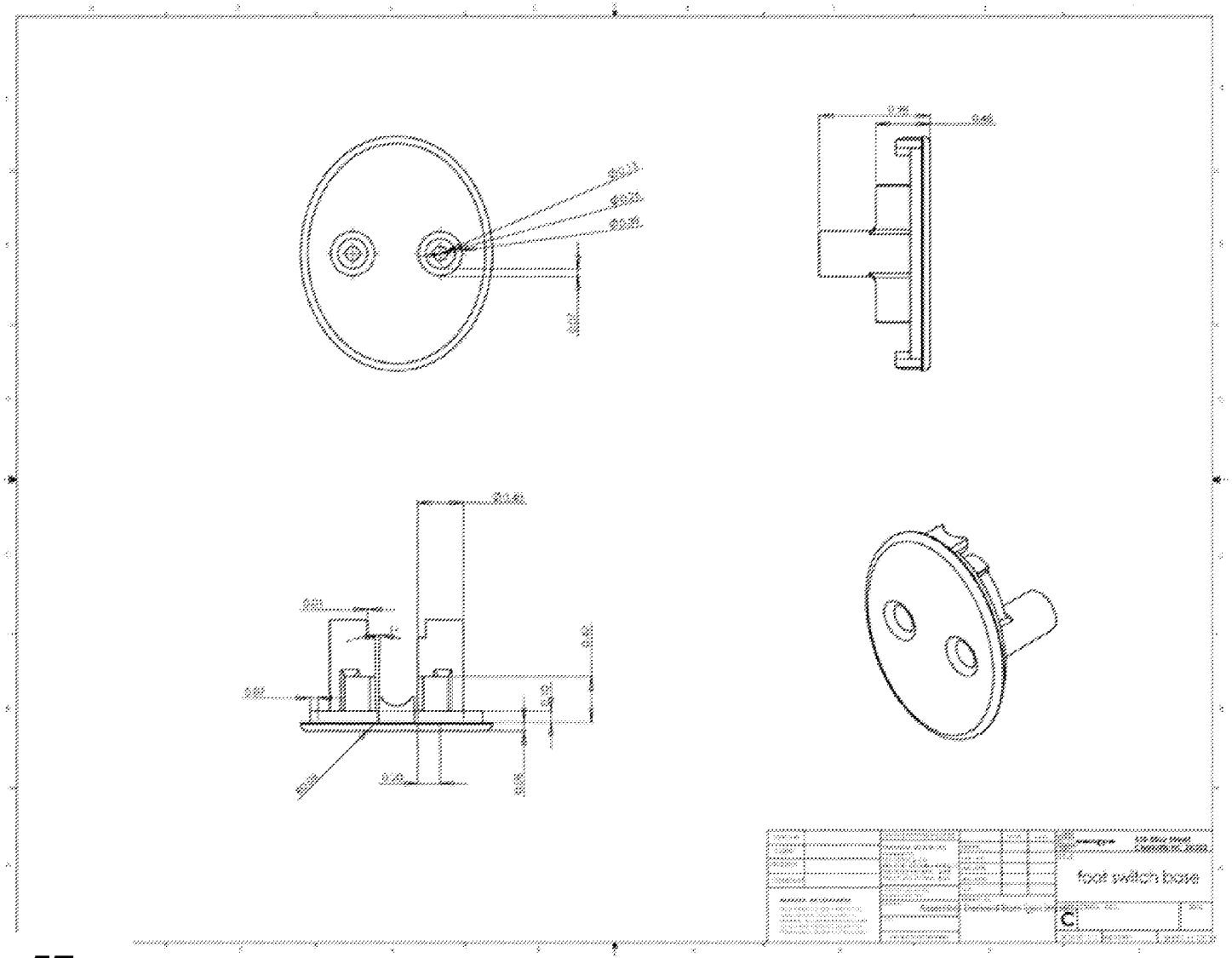
Figure 58:
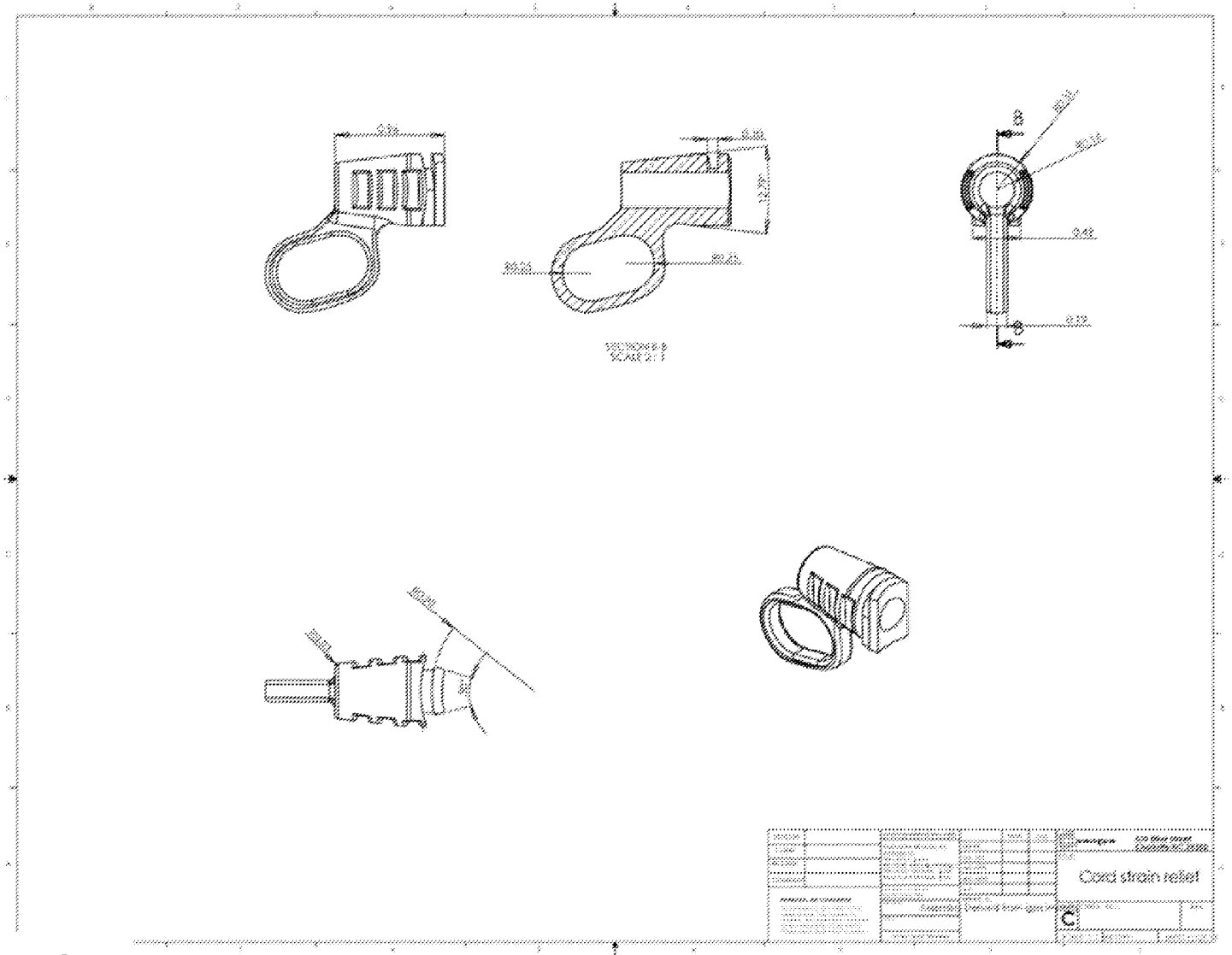
Figure 59:
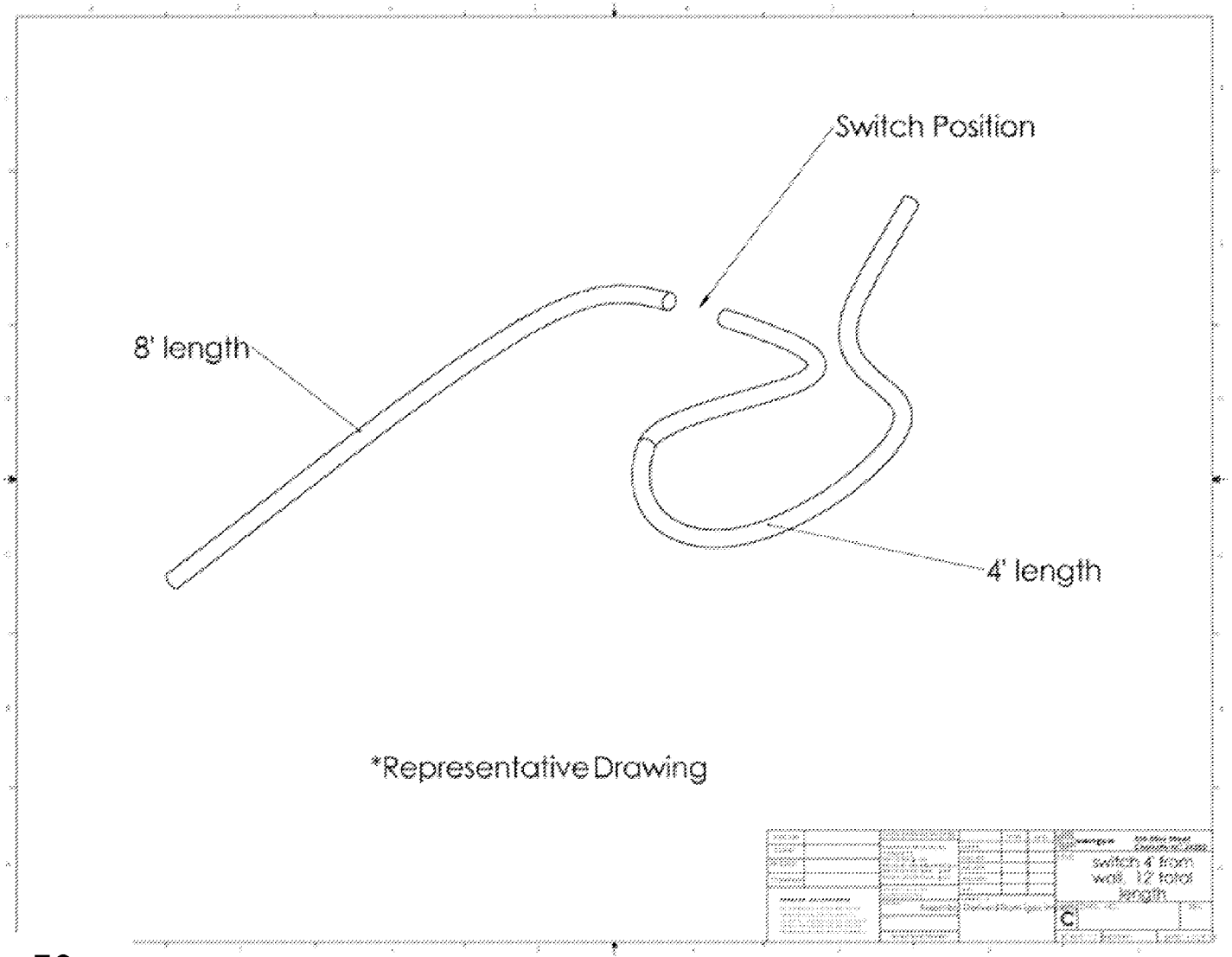
Figure 60:
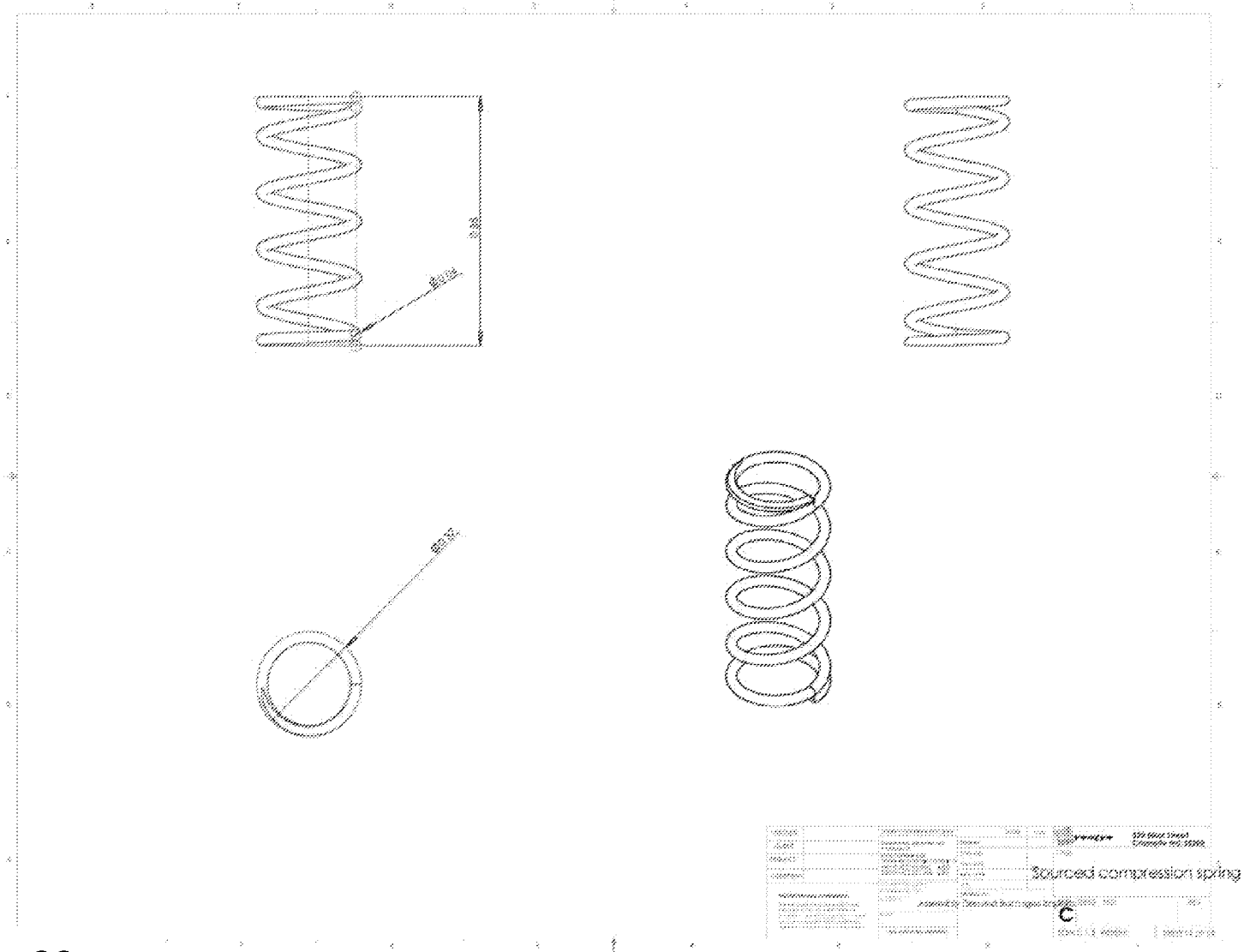
Figure 61:
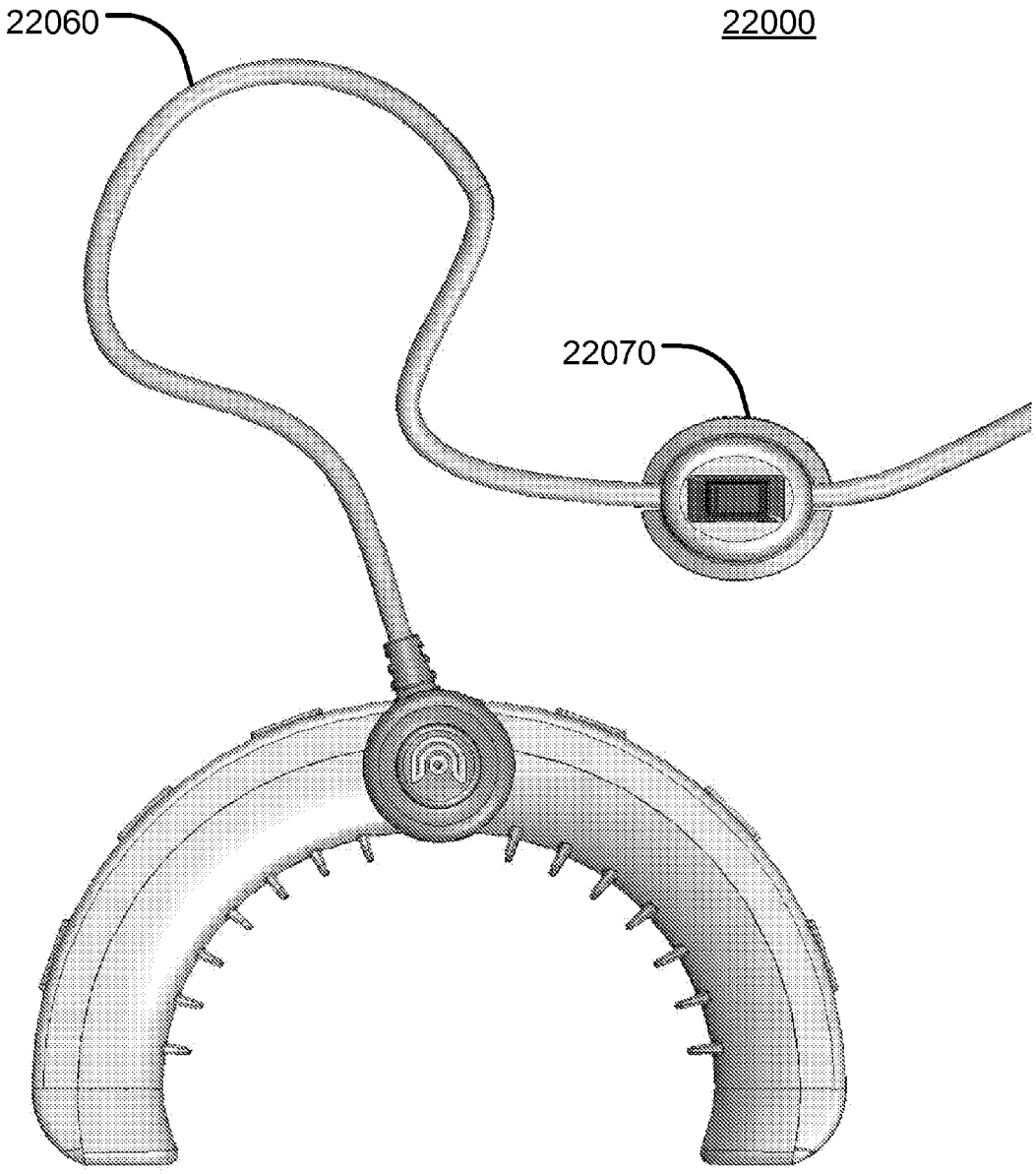
Figure 62:
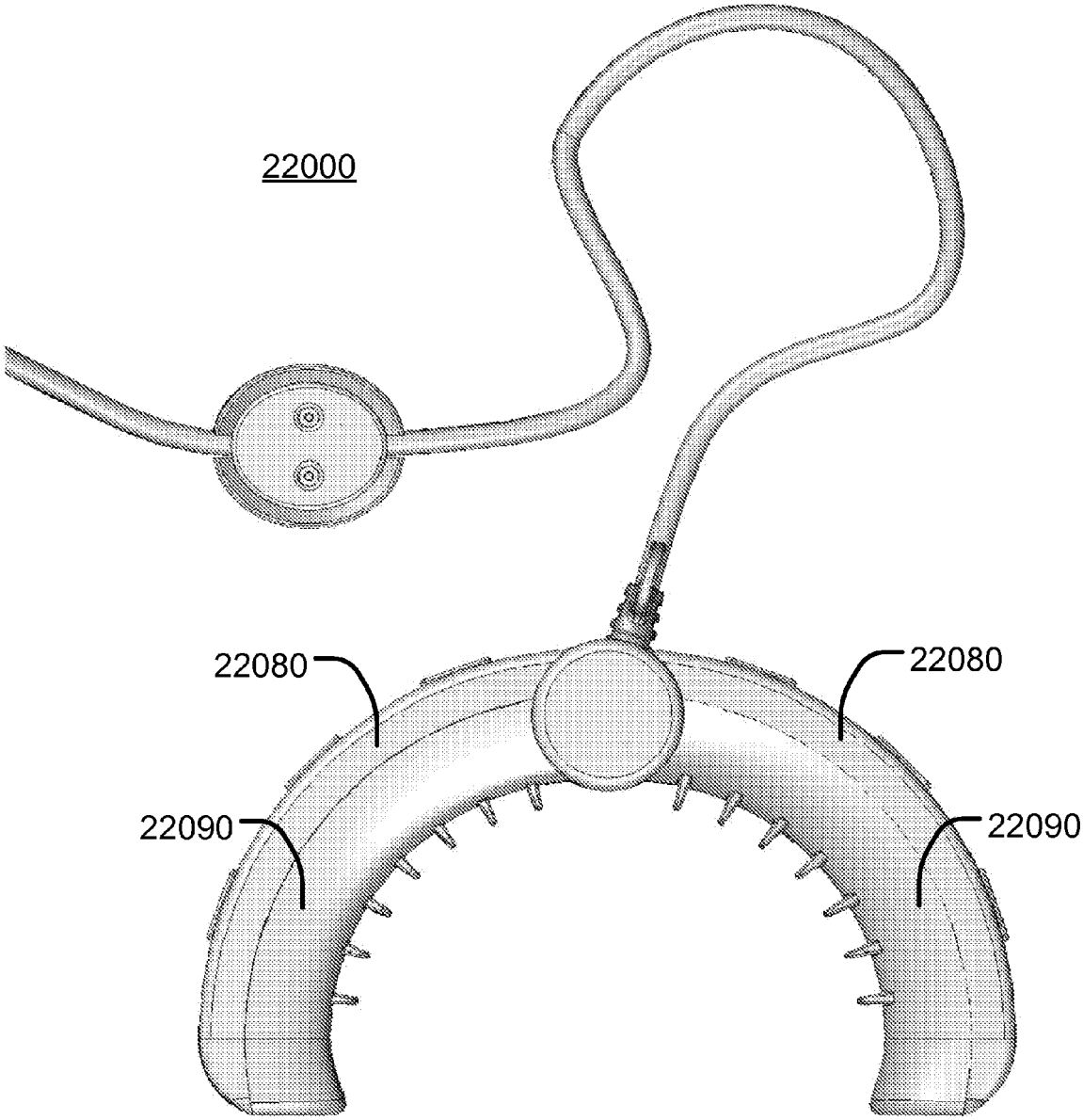
Figure 63:
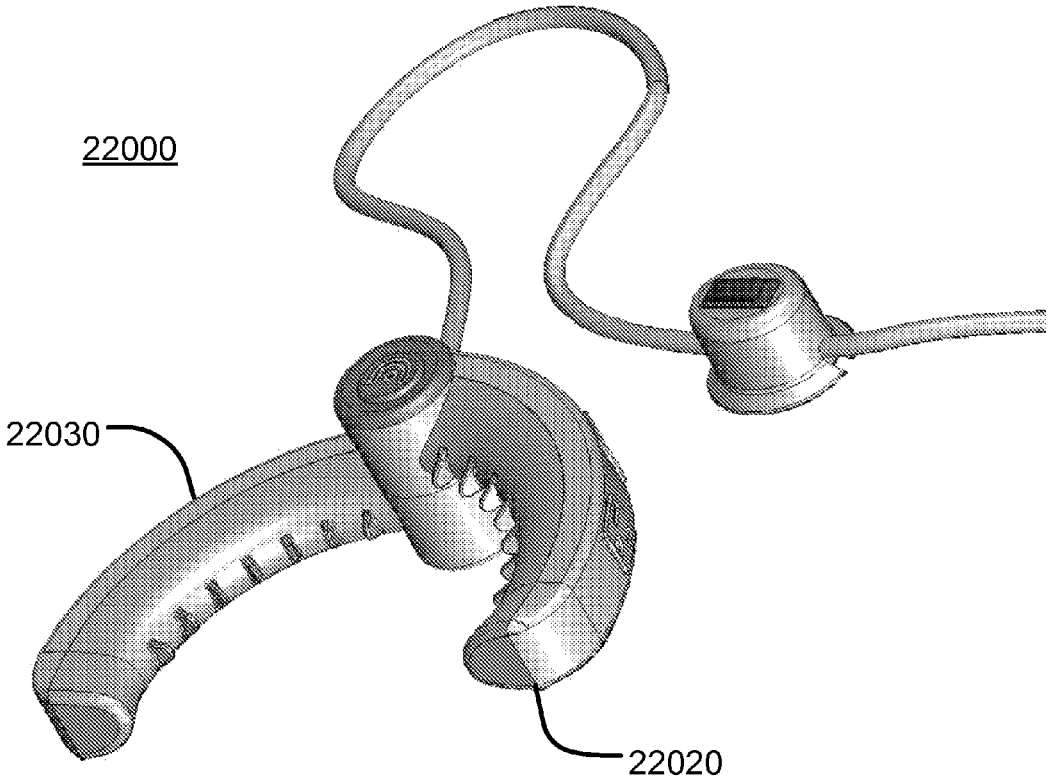
Figure 64:
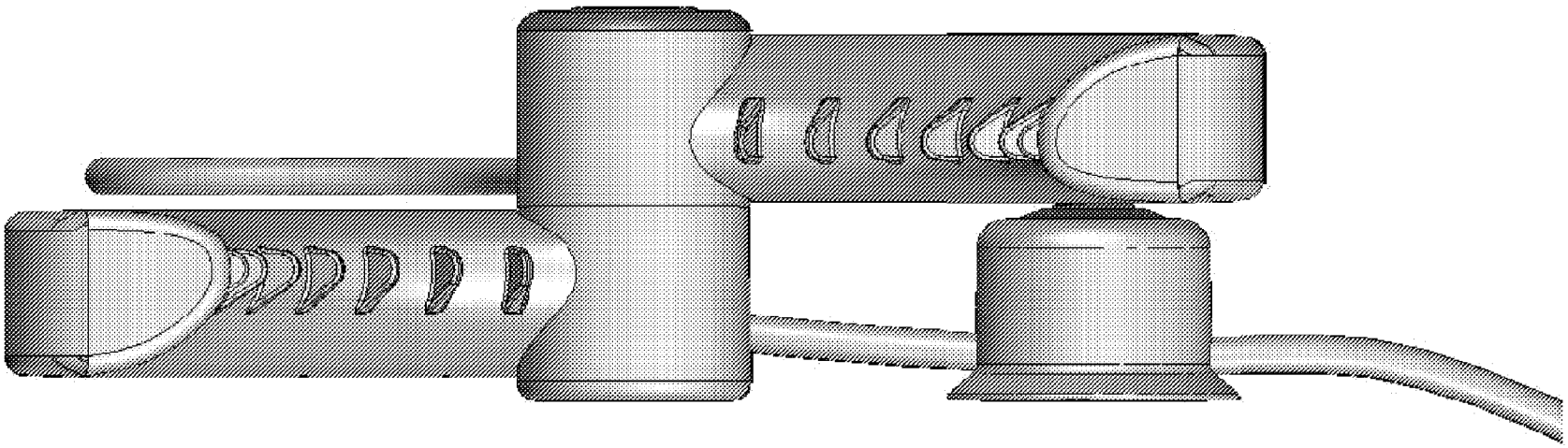
Figure 65:
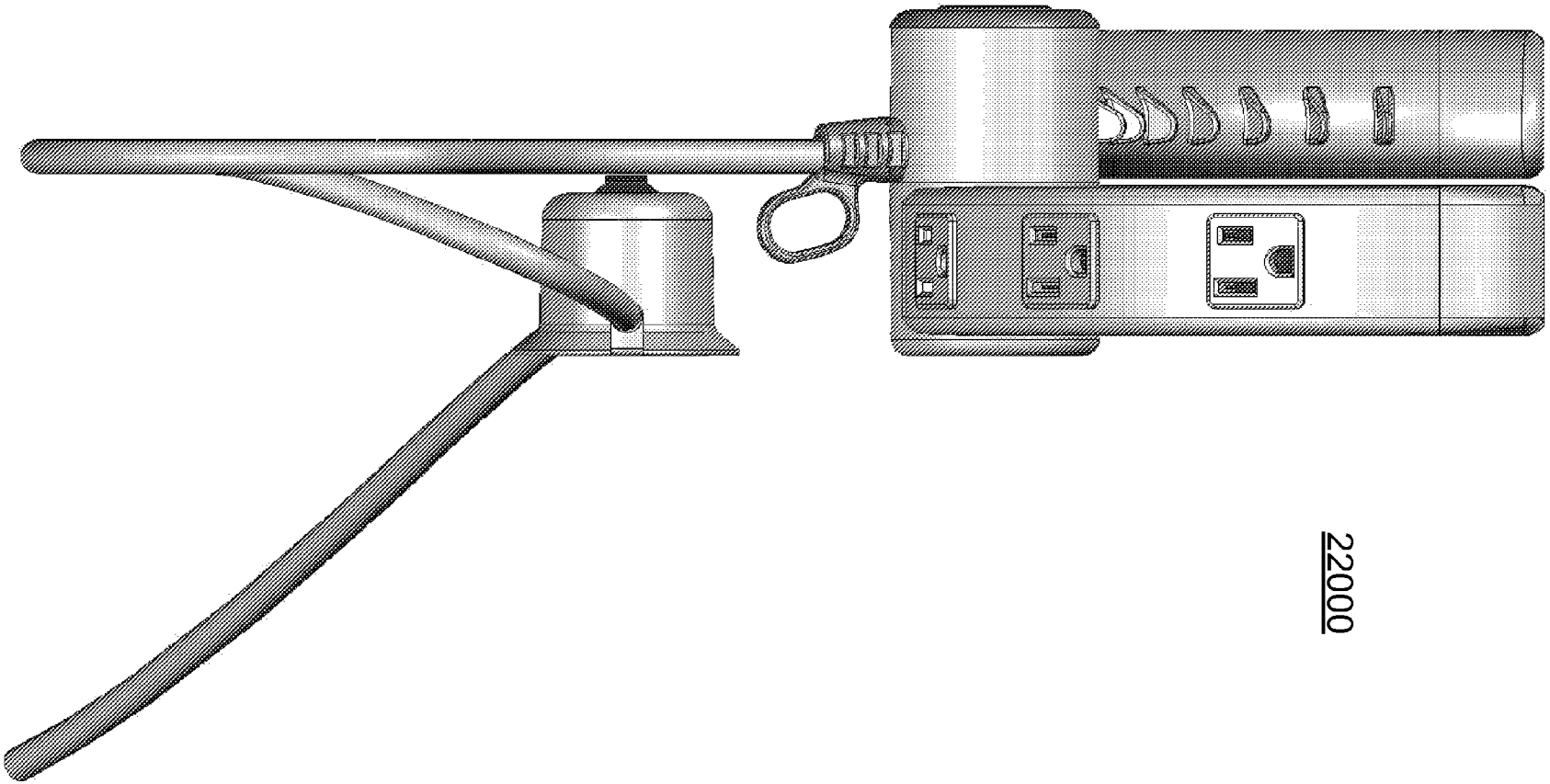
Figure 66:
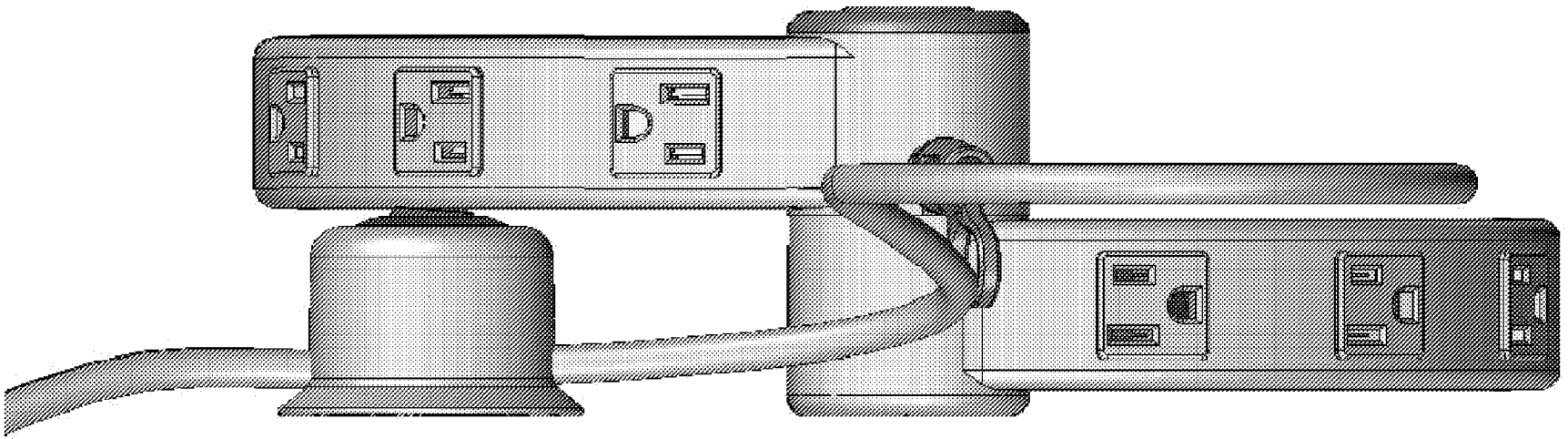
Figure 67:
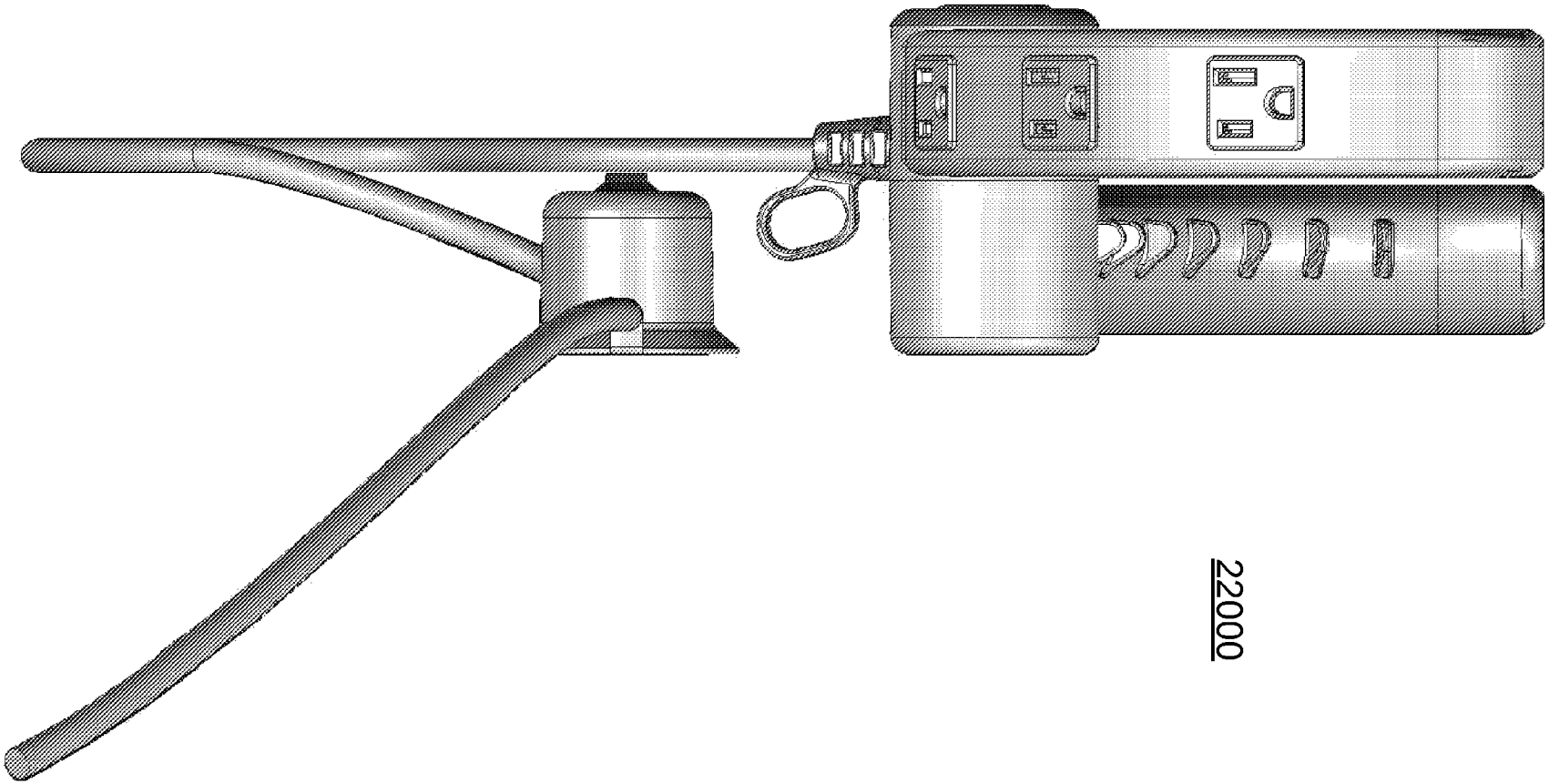
Figure 68:
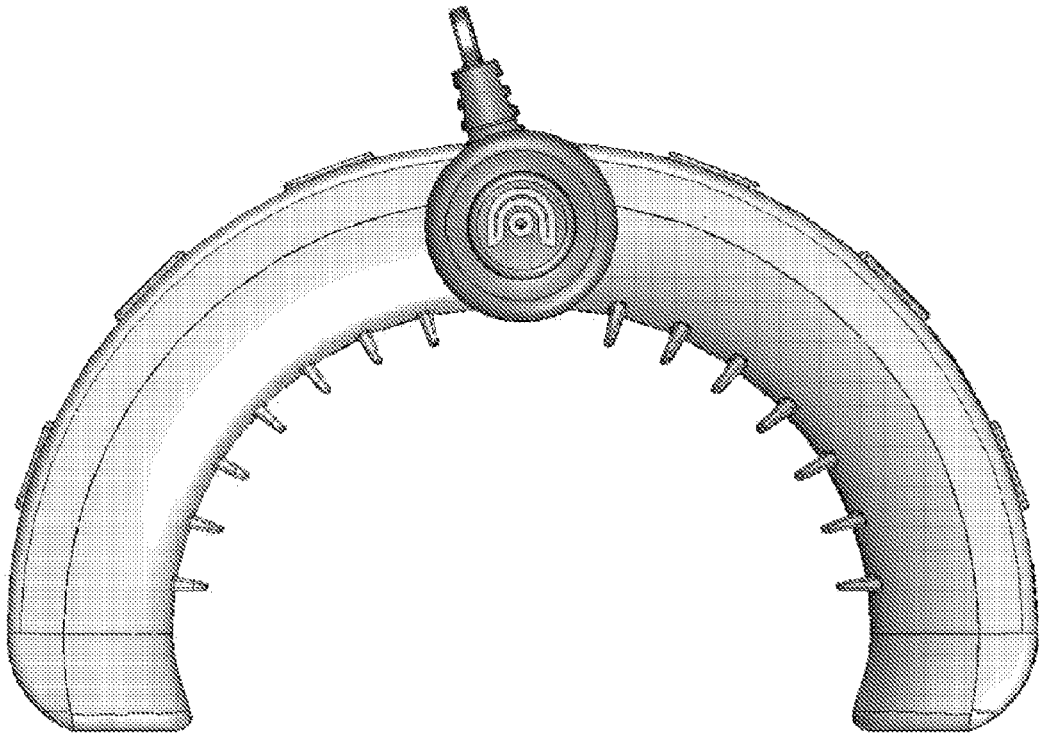
Figure 69:
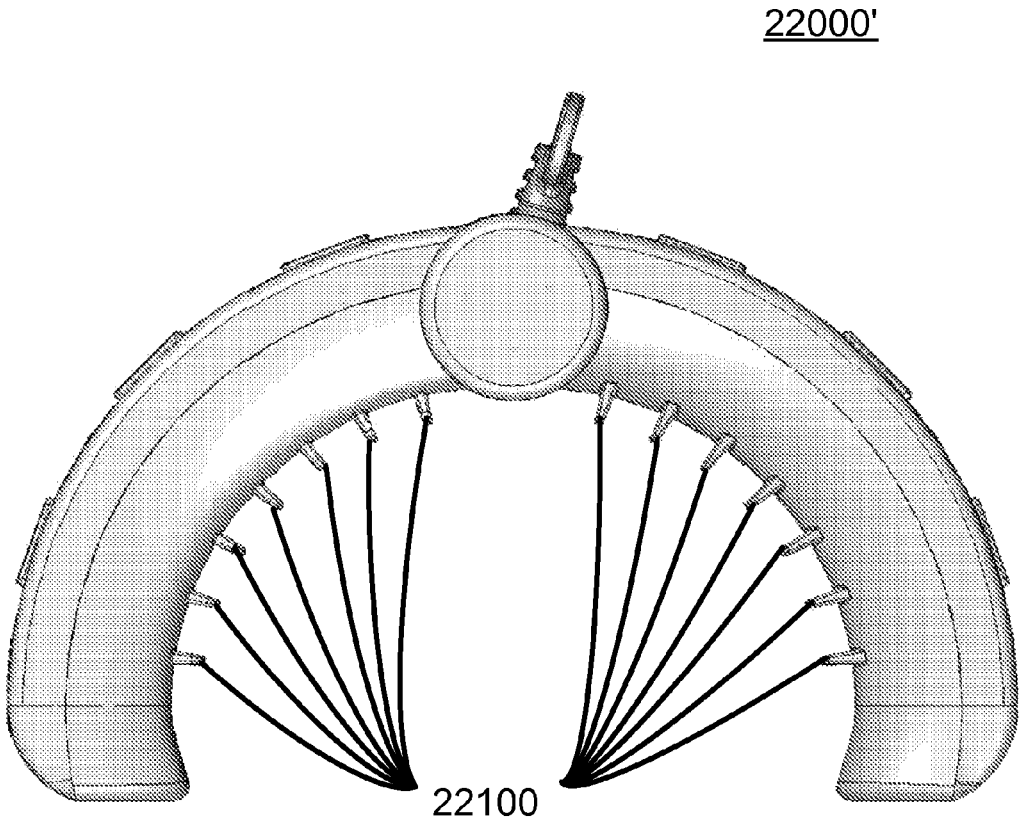
Figure 70:
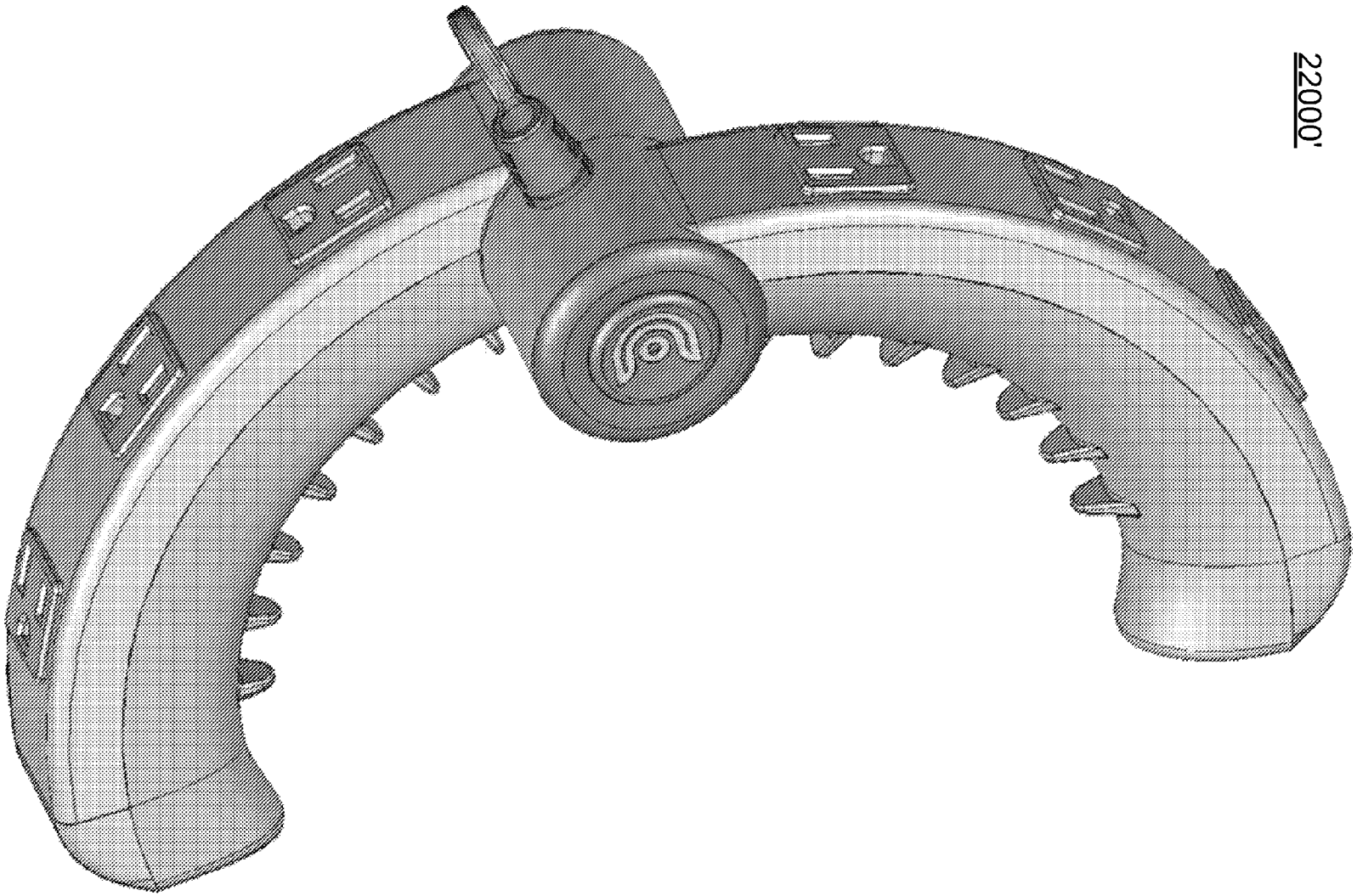
Figure 71:
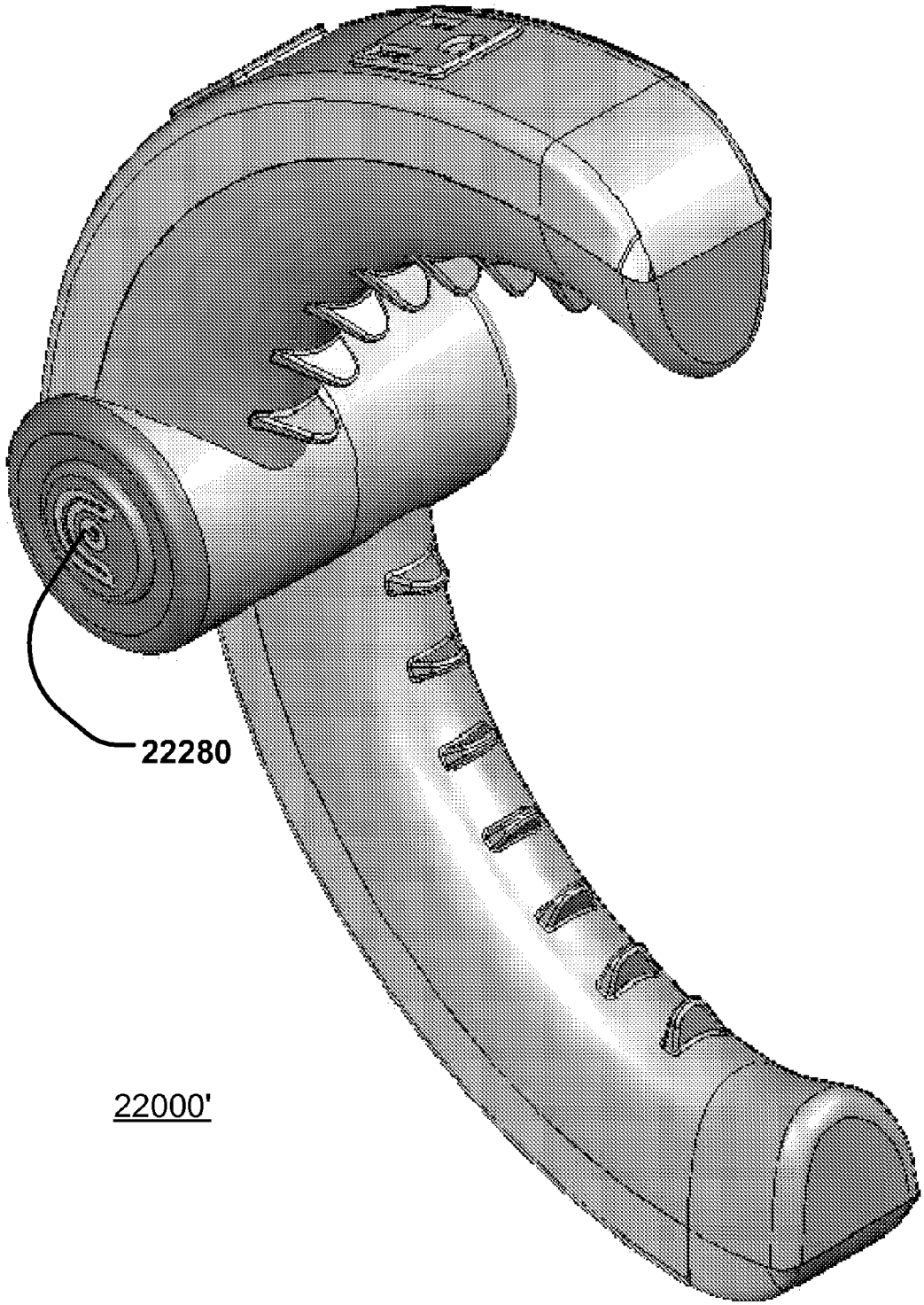
Figure 72:
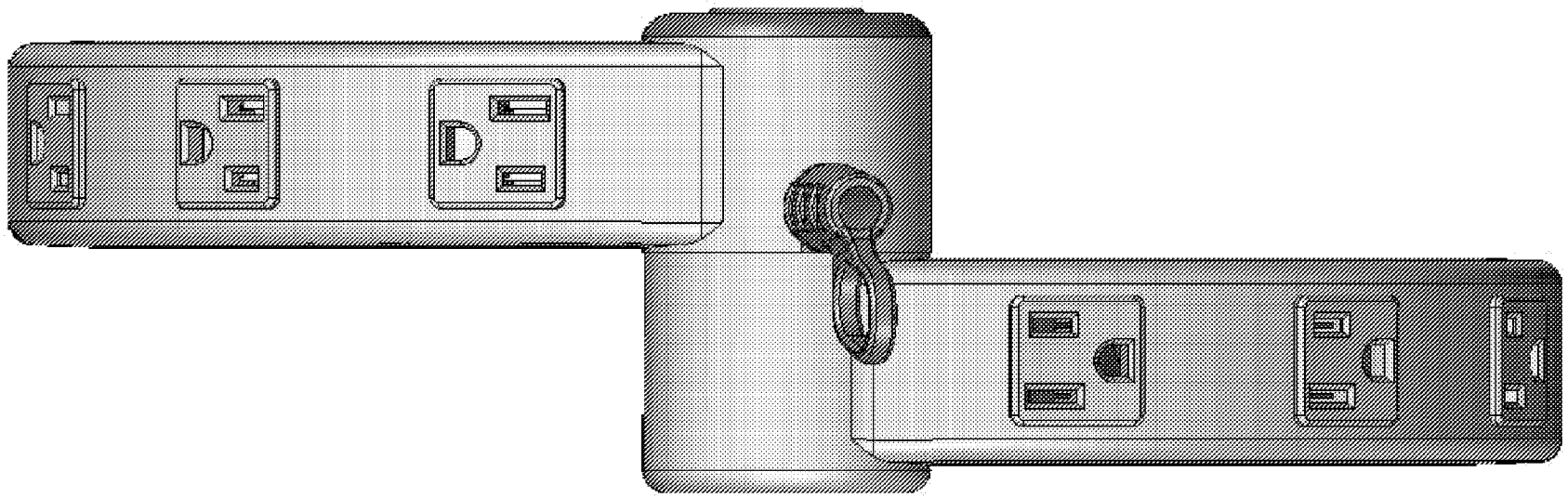
Figure 73:
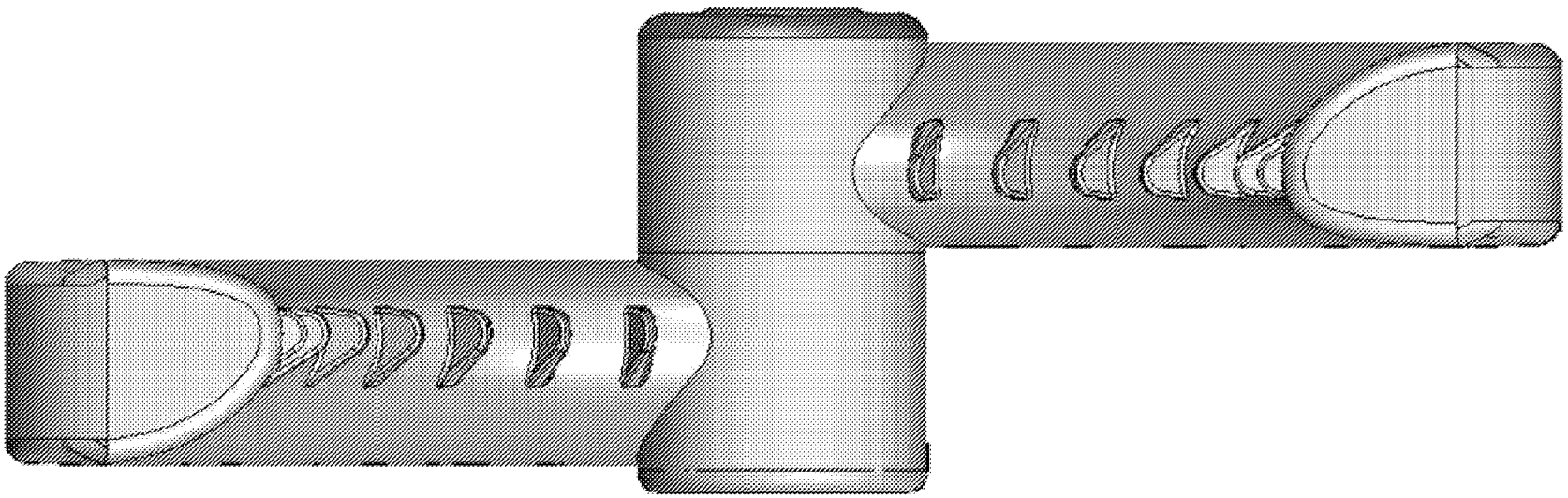
Figure 74:
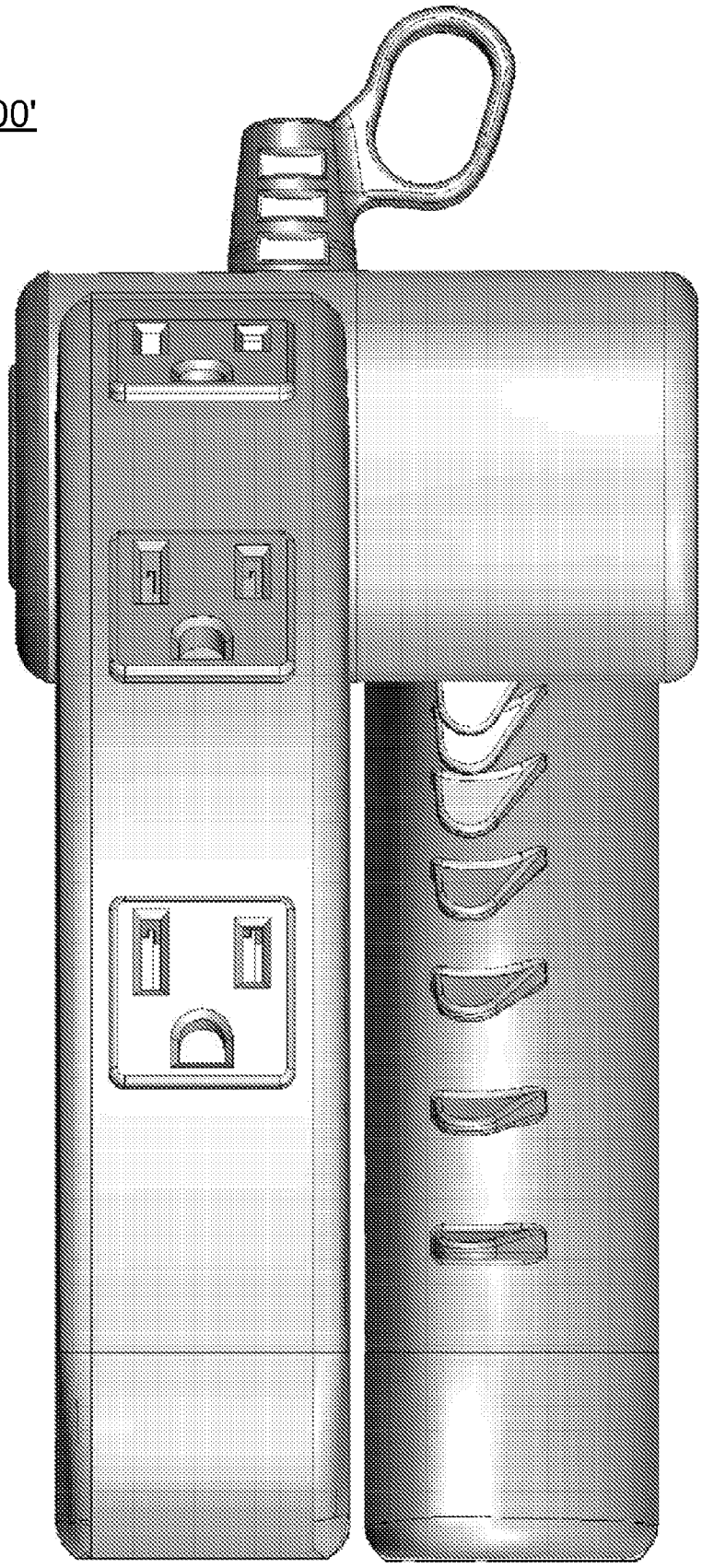

A power strip 21000 is illustrated in FIGS. 43-46. Power strip 21000 is similar in construction to power strip 10, discussed above. A difference illustrated by power strip 21000 is the provision of a hook 21550 at the distal end of arm section 21030 for additional attachment of the power strip to an object that would be too small for mounting between the arm sections. Arm section 21030 also is smaller in cross-section than arm section 21020 and includes no electrical receptacles. Arm section 21020, however, includes five electrical receptacles as shown in FIG. 45.

A final power strip 22000 and/or components thereof are illustrated in FIGS. 47-90. Power strip 22000 represents the preferred commercial embodiment of the invention that is currently being pursued.

Specifically, FIGS. 47 and 61-67 illustrate various views of the power strip 22000 and FIGS. 68-74 illustrate various views of the power strip 22000 in which illustration of the cord and floor switch has been omitted for clarity (hereinafter the power strip is identified and referred to with callout 22000' when the cord and floor switch are not shown in the drawings). The outward appearance and features, and the functioning of, the power strip 22000 correspond to the outward appearance, features, and functions of, for example, the power strip 3000 of FIGS. 19-25. In particular, power strip 22000 includes: a plurality of arm sections 22020,22030; a coupling assembly; and a ratcheting assembly 22190.

With respect to the arm sections 22020,22030 of power strip 22000, each includes three standard, three-prong electrical receptacles 22040 into which electrical plugs may be individually inserted. The electrical receptacles 22040 of a respective arm section 22020,22030 are positioned adjacent each other along a curved length of the respective arm section 22020,22030 to define a row or "strip" of electrical receptacles 22040. Internal wiring including electrical contacts 22951 and ground strip 22953 extend through each arm sections 22020,22030 for supplying power to the electrical receptacles 22040. The electrical contacts 22951 and ground strip 22953 are illustrated in the drawings with respect to only one of the arm sections, but it should be understood that the other arm section includes the same electrical contacts 22951 and ground strip 22953. A main power cord 22060 of the power strip 22000 supplies power to the electrical contacts 22951 and ground strip 22953 by way of internal wiring, which internal wiring also is not shown for clarity of illustration. The main power cord 22060 extends from the upper arm section 22020 of the power strip 22000 to a standard electrical outlet of a building (not shown). A floor switch 22070 is provided for turning on and off of the power strip 22000 by depressing of a button of the floor switch 22070. As the floor switch 22070 is disposed on the floor, the floor switch 22070 may be operable with a foot. The floor switch 22070 also may be illuminated when power is provided to the power strip 22000.

Each of the arm sections 22020, 22030 includes a rigid, arcuate portion 22080 that is formed from a hard material through one or more molding processes. The molding processes may include injection molding, rotational molding, and/or blow molding. Each arm section 22020,22030 also includes an outer resilient portion 22090 that is elastic and capable of resuming its prior shape after deformation. This resilient portion 22090 of each arm section 22020,22030 preferably comprises an over molded portion having resilient protuberances 22100 for tensioned gripping. The tensioned gripping results from compression of the resilient protuberances 22100 that occurs when the arm sections 22020,22030 are forced into a closed position about an object upon which the power strip 22000 is to be mounted.

The form of the resilient protuberances 22100 for tensioned gripping that are disposed on the inner concave portion of the arm sections 22020,22030 include bendable or flexible fingers, which in use conform to and provide good gripping of the object to which the power strip 22000 is mounted.

The protuberances 22100 also are aligned in two generally parallel rows, each row of which is generally offset from a centerline of its respective arm section 22020,22030 in a direction toward the other row of the other arm section 22020, 22030. This arrangement of the two rows of protuberances 22100 is best seen, for example, in FIGS. 64 and 73. Each arm section 22020,22030 further includes a profile that is not symmetrical along the respective centerline of the arm section, again as best seen, for example, in FIGS. 64 and 73. Instead, the profile of each arm section 22020,22030 includes a rounded edge that is offset toward the other arm section 22020,22030, with the protuberances 22100 on each arm section 22020,22030 extending long this rounded edge.

The coupling assembly of the power strip 22000 serves to couple the two arm sections 22020,22030 together. The coupling assembly includes a connecting member 22500 that is secured to the lower arm section 22030 and, specifically, a body 22031 of the lower arm section 22030, via three fasteners (not shown) such as screws or bolts. The connecting member 22500 also includes a circular platform 22900 that is received within a cylindrical recess 22910 of a body 22021 of the upper arm section 22020 and that abuts a circumferential ledge 22920 of the body 22021 of the upper arm section 22020. This abutment of the connecting member 22500 with the upper arm section 22020 and its mounting to the lower arm section 22030 via the three fasteners serves to retain the upper and lower arm sections 22020,22030 to one another for relative rotational movement about an axis of the connecting member 22500 while precluding relative axial movement along such axis.

A torsion spring 22121 also is provided that biases the arm sections from a closed position toward an open position. The torsion spring 22121 is secured at one end to the connecting member 22500 and abuts one of a plurality of ribs 22033 formed in the body 22021 of the upper arm section 22020 such that relative rotational movement of the arm section 22020,22030 away from the closed position results in tensioning of the torsion spring 22121.

The ratchet assembly defines stepped or degrees of relative rotational movement between the first arm section 22020 and the second arm section 22030. The ratchet assembly also selectively permits rotational movement of the arm sections 22020,22030 toward one another while precluding rotational movement of the arm sections 22020,22030 away from one another. In this respect, the ratchet assembly includes inclined teeth elements 22200 disposed along a circumferential area of the release member 22280 that protract in the axial direction to engage corresponding inclined teeth elements 22220 disposed along a circumferential area of a rim cap 22120. The rim cap 22120 is received within the cylindrical recess of the upper arm section 22020 and includes a portion or circular flange that extends outside thereof to overlay and cover the surrounding edge of the cylindrical recess of the upper arm section 22020. The rim cap 22120 further preferably is received within the cylindrical recess in a snap-fit engagement whereby the rim cap 22120 is secured to the upper arm section 22020 in fixed disposition relative thereto. An opening in the rim cap 22120 receives therethrough a portion of release member 22280 to thereby define a "release button."

The teeth elements 22200 are urged into engagement with the inclined teeth elements 22220 by a respective biasing element comprising a compression spring 22230. Due to the shape of the inclined teeth elements 22200,22220 and their relative dispositions, the ratchet assembly permits relative rotational movement between the first arm section 22020 and the second arm section 22030 toward one another and precludes or inhibits relative rotational movement between the first arm section 22020 and the second arm section 22030 away from one another. The spacing between the teeth elements 22200,22220 of the ratchet assembly defines the increments in the direction of permitted relative rotational movement of the arm section 22020,22030.

The compression spring 22230 is disposed between and abuts the circular platform 22900 of the connecting member 22500 and the release member 22200, and the release member 22200 is mounted via slots therein on three guides 22935 of the connecting member 22500 that protract in the axial direction for sliding movement along the axis thereof relative to the connecting member 22500 between a first position, in which the teeth elements 22200,22220 are in interlocking engagement, and a second position, in which the teeth elements 22200,22220 are out of interlocking engagement. Preferably, while the compression spring 22230 urges interlocking engagement of the teeth elements 22200,22220, the spring force preferably is not so great as to preclude release of the arm sections 22020,22030 if a great amount of torque is applied so that irreparable damage to the power strip 22000 that otherwise would occur is avoided.

The release member 22280 comprises a portion that is exposed and serves as a "button" for release of the locking engagement of the teeth elements 22200,22220 and may include the word "PUSH" or other indicia, such as a logo or trademark, disposed thereon. The release member 22280 is retained within the rim cap 22120 and is configured to slide back and forth in the axial direction. The release member 22280 is biased by the compression spring into a disposition in which the top of the release member 22280 is raised above the circular flange of the rim cap 22120.

In operation, the power strip 22000 may be clamped onto an object or portion thereof, such as, for example, a trunk or branch of a tree, a stud in a building under construction, or a work bench or work table. By depressing the release member 22280, the two arm sections 22020,22030 are released from a locked condition to an unlocked position and can be freely moved within their relative range of motion about their mutual pivot axis of the connection member 22500. Moreover, the torsion spring 22121 preferably causes the arm sections 22020,22030 to separate when the release button 22280 is depressed. The power strip 22000 then can be positioned such that the object is disposed between the arm sections 22020, 22030. Upon ceasing depression of the release member 22280 (which is biased by the torsion spring 22121), the teeth elements 22200,22220 of the arm sections 22020, 22030 will return to their interlocked position such that movement of the arm sections 22020,22030 in increments toward one another will be permitted but movement of the arm sections 22020,22030 away from one another will be precluded or inhibited. The arm sections 22020,22030 then can be closed in tight fitting disposition on the object located there between for mounting of the power strip 22000 to the object.

Figure 88:
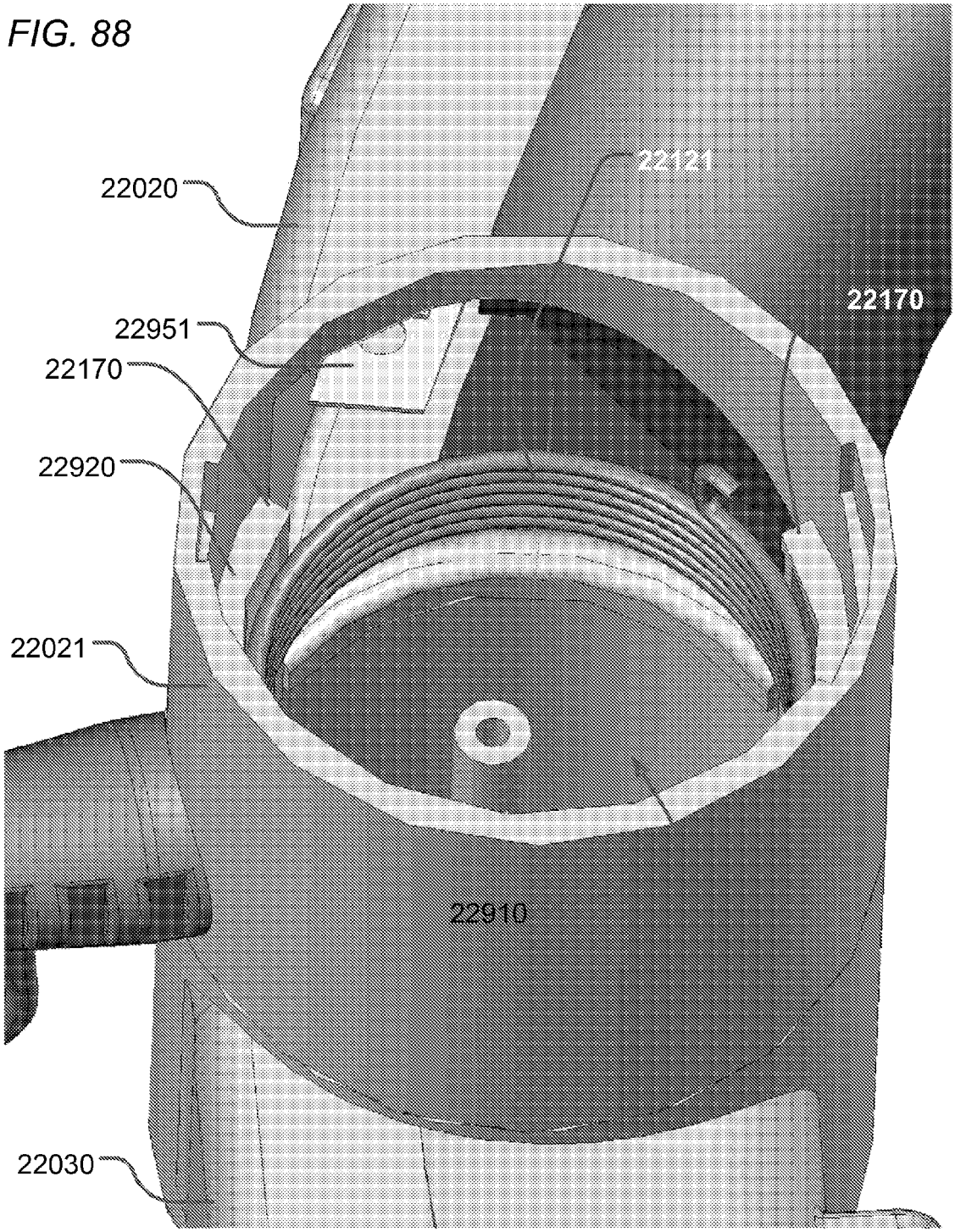
Figure 89:
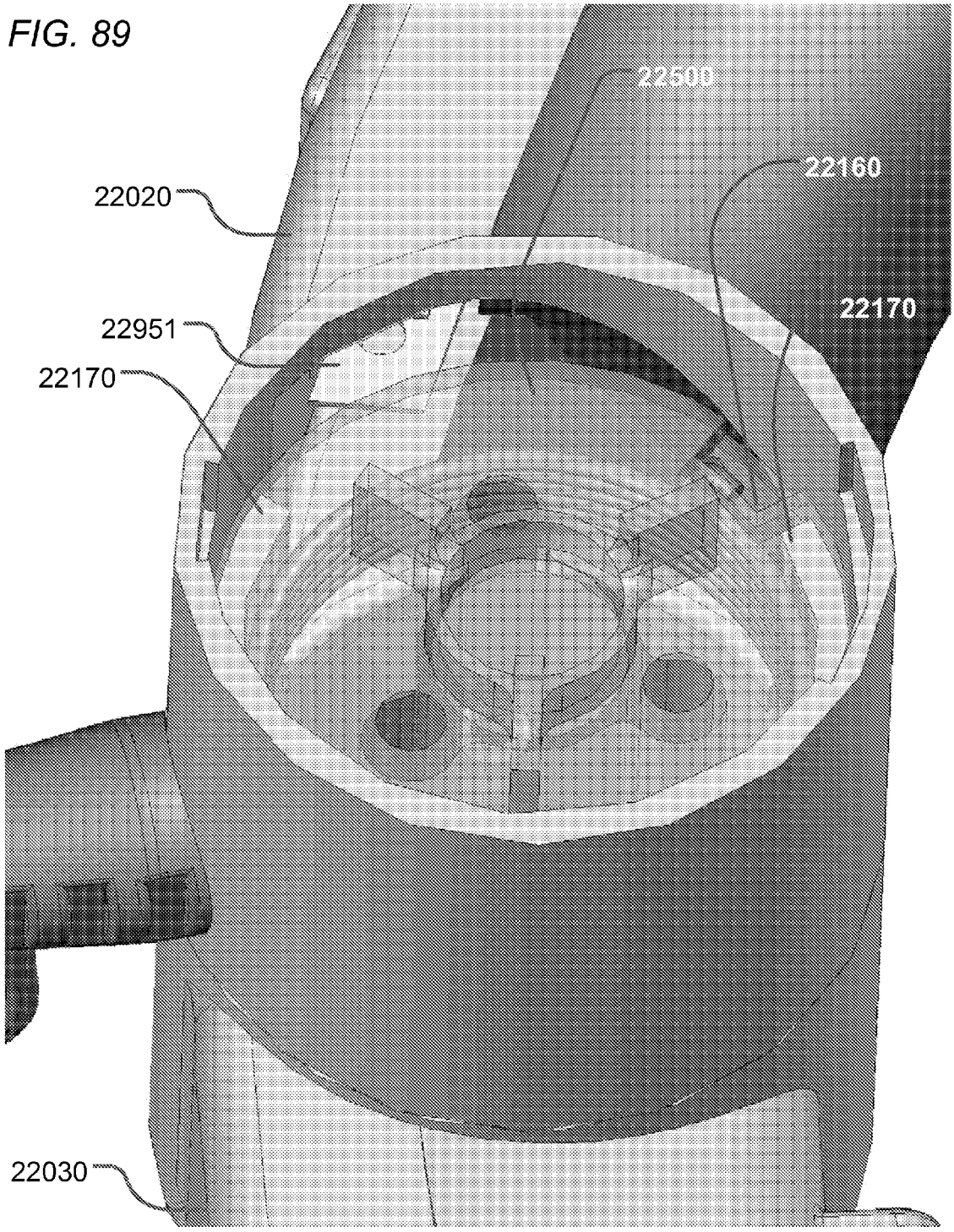

Additionally, in order to inhibit repetitive circular motion of the arm sections 22020,22030 relative to one another, which would tend to cause winding of any electrical wires extending between the arm sections 22020,22030 through the coupling assembly, stops preferably are provided for limiting the range of the relative rotational movement of the arm section 22020,22030. In this respect, a stop 22160 is provided on the connection member 22500 that engagements corresponding stops 22170 provided on the upper arm section 22020 which serve to limit the range of relative rotational movement of the arm section 22020,22030. The stops 22170 preferably are formed by the ends of the semicircular circumferential ledge of the upper arm section 22020 against which the connection member abuts when it is secured to the lower arm section 22030. The stops 22160,22170 are best illustrated in FIGS. 88-90, wherein the connection member 22500 is omitted in FIG. 88, is shown as transparent in FIG. 89, and is shown in solid form in FIG. 90.

FIGS. 48-60 illustrate individual components of the powers strip 22000.

Figure 75:
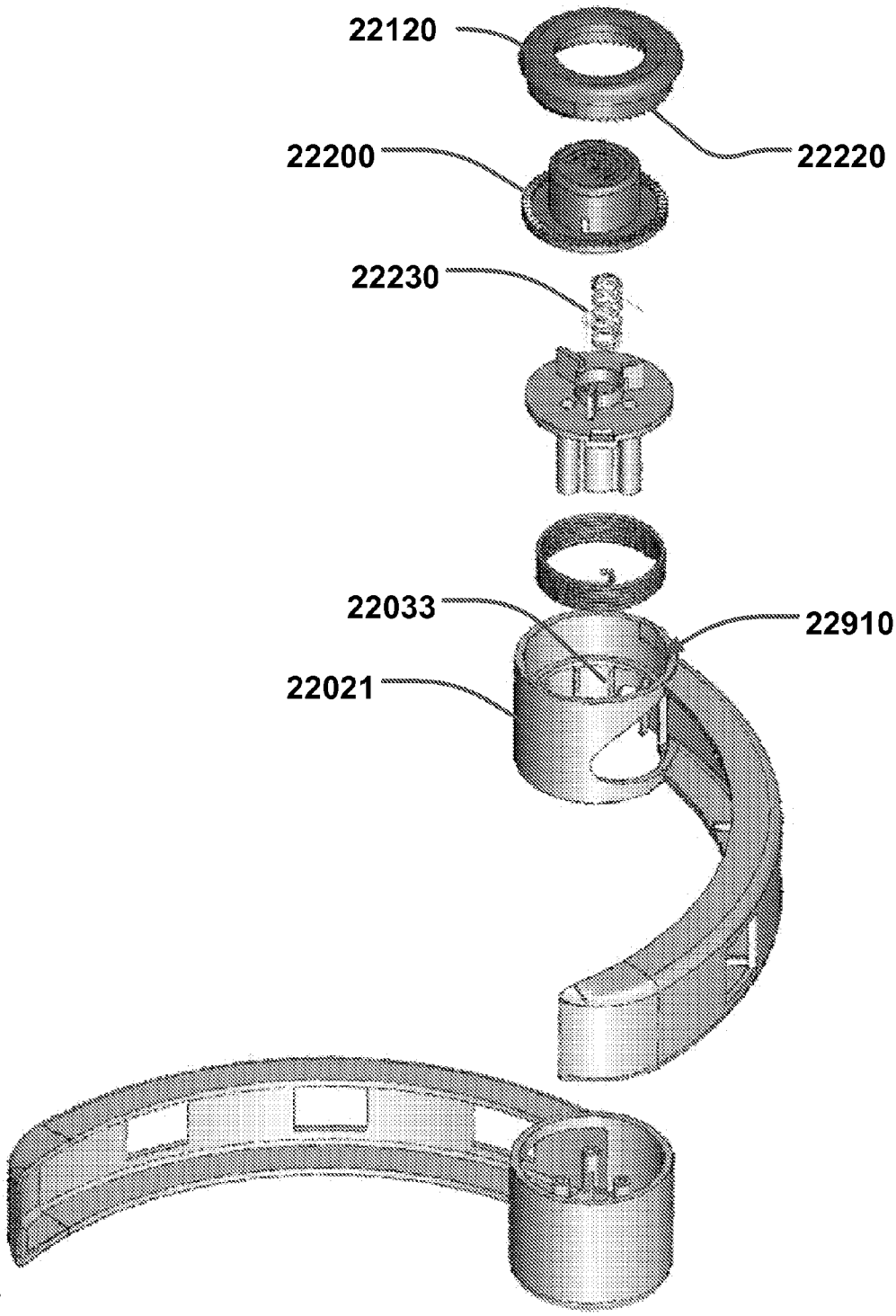
Figure 76:
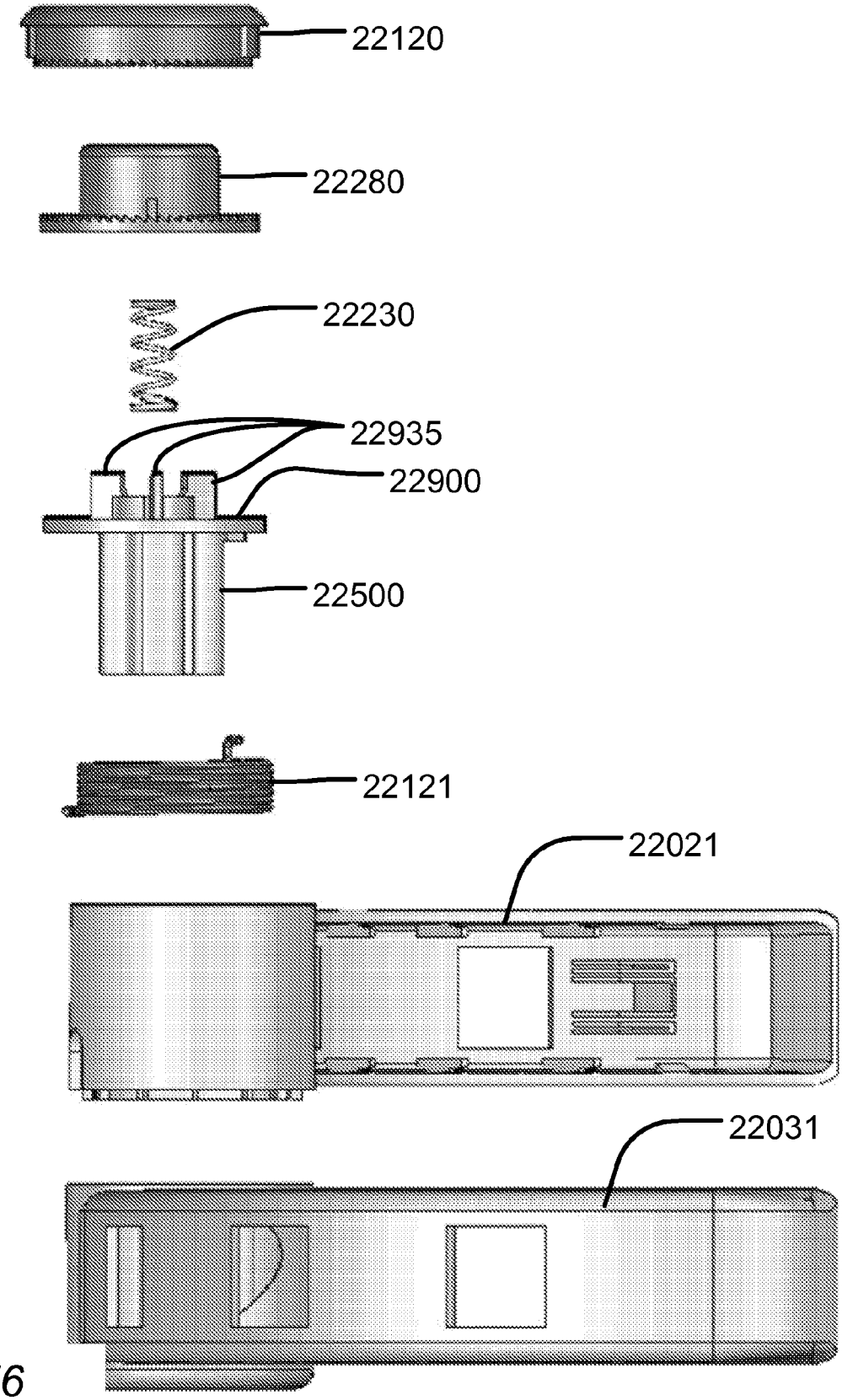
Figure 77:
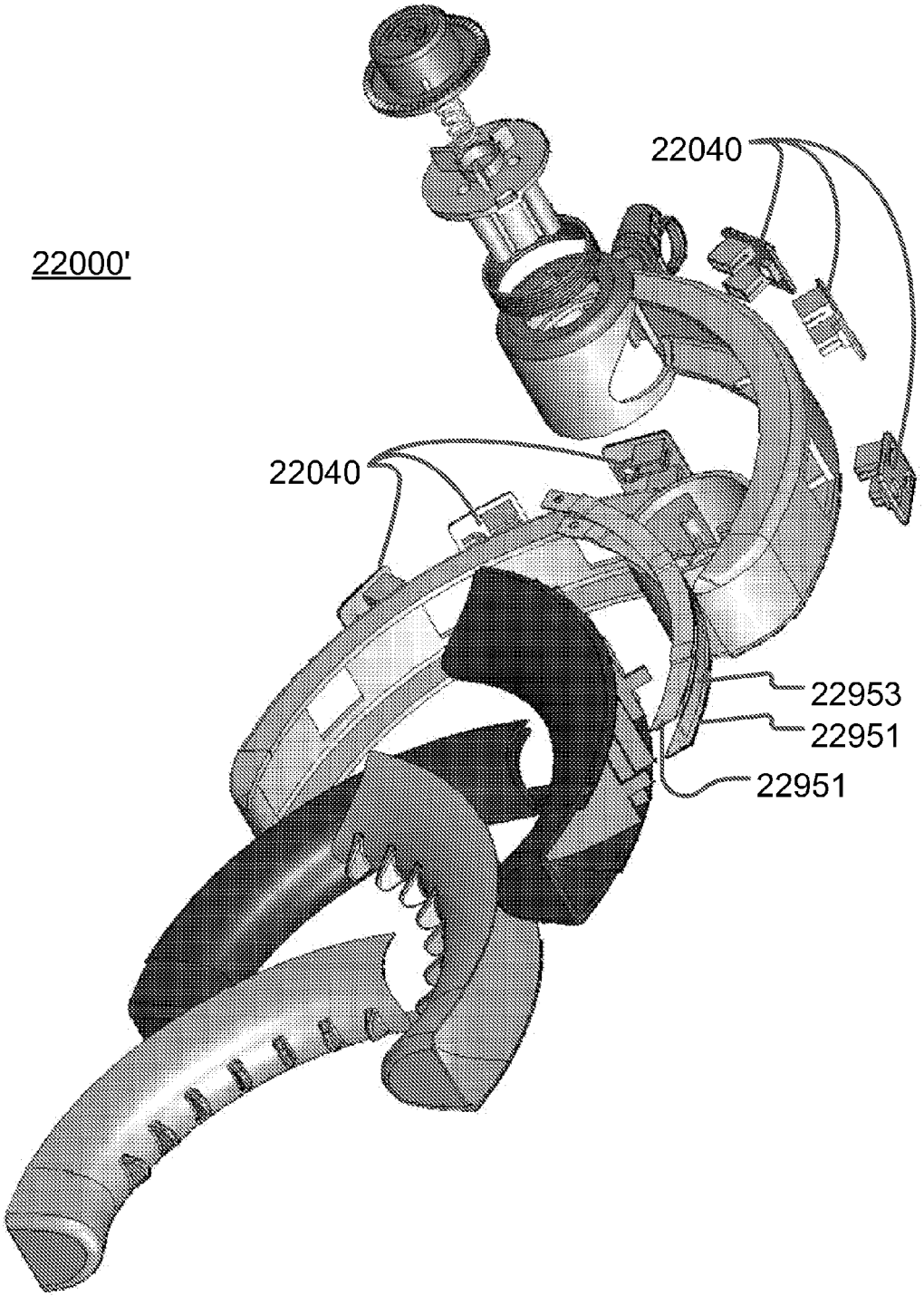
Figure 78:
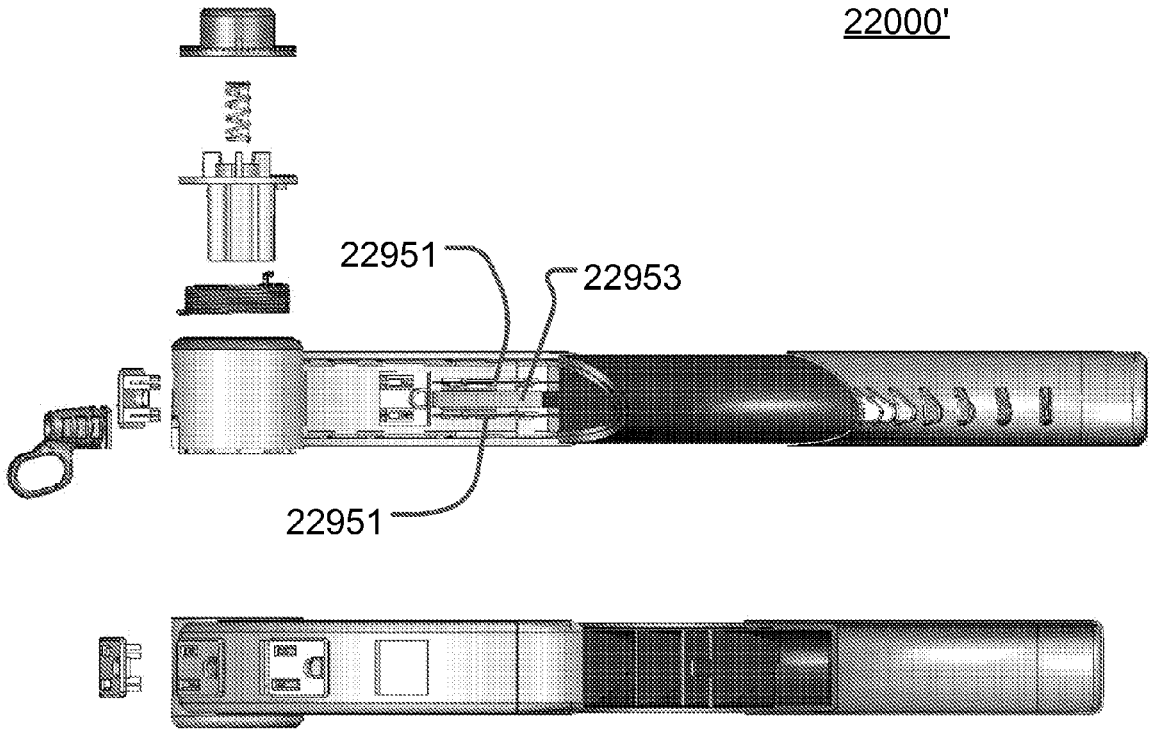
Figure 79:
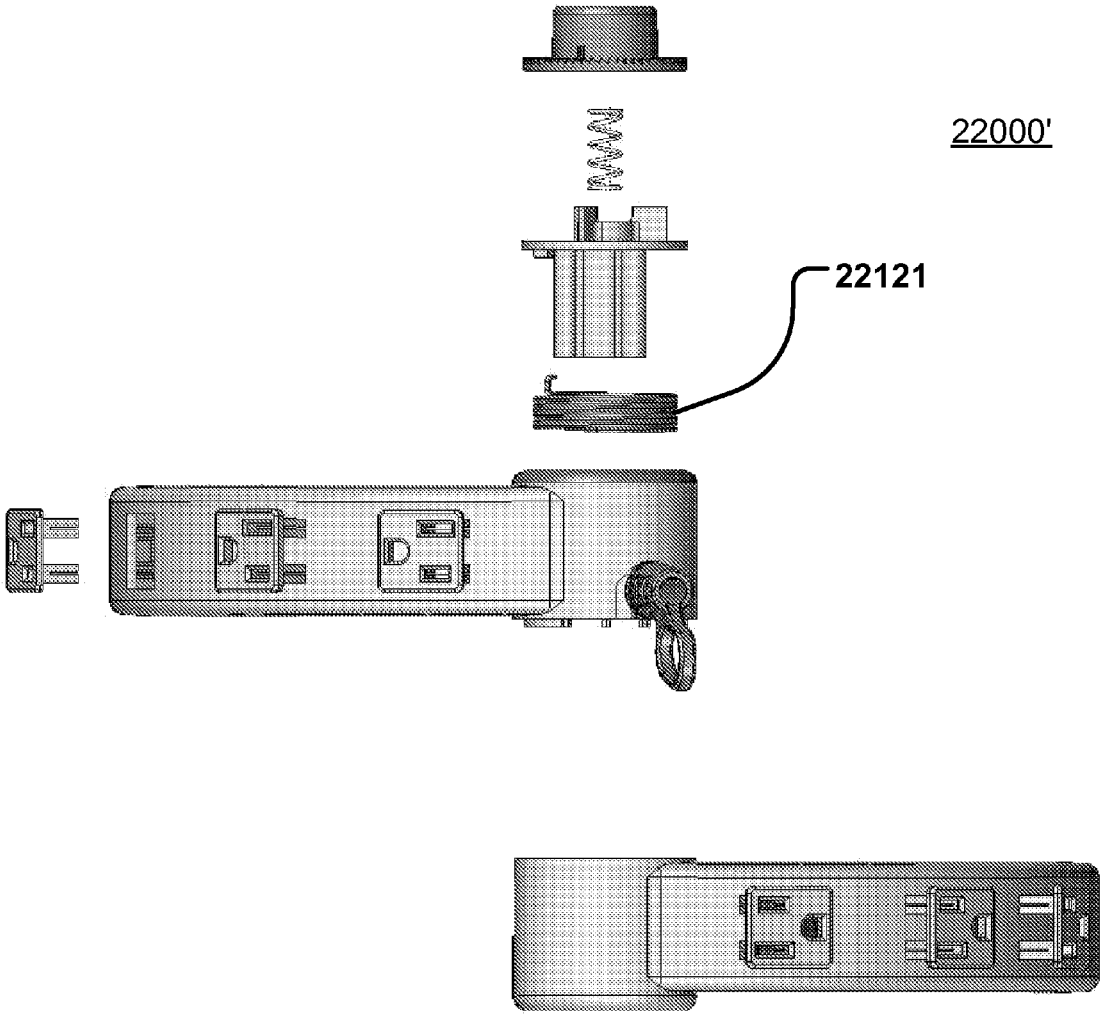
Figure 80:
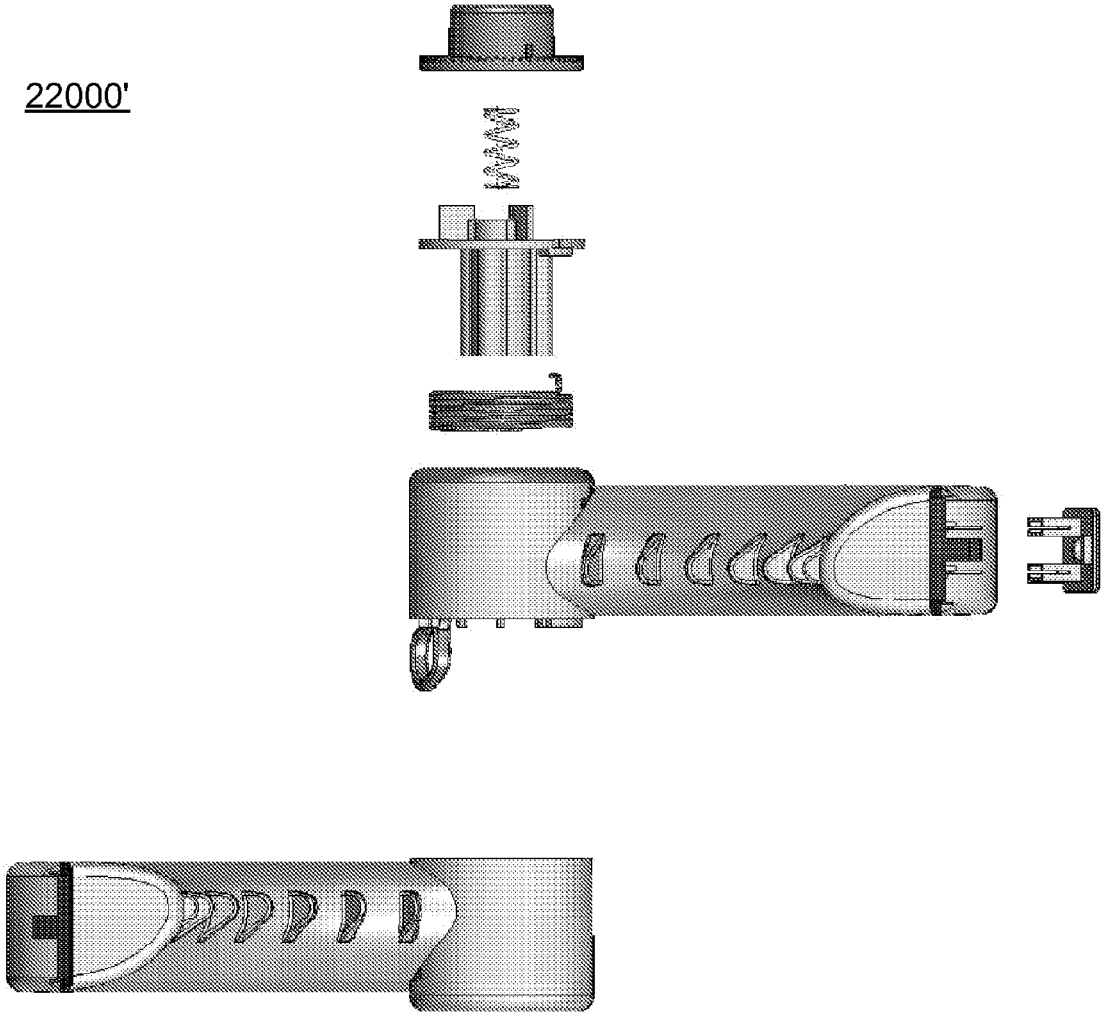
Figure 81:
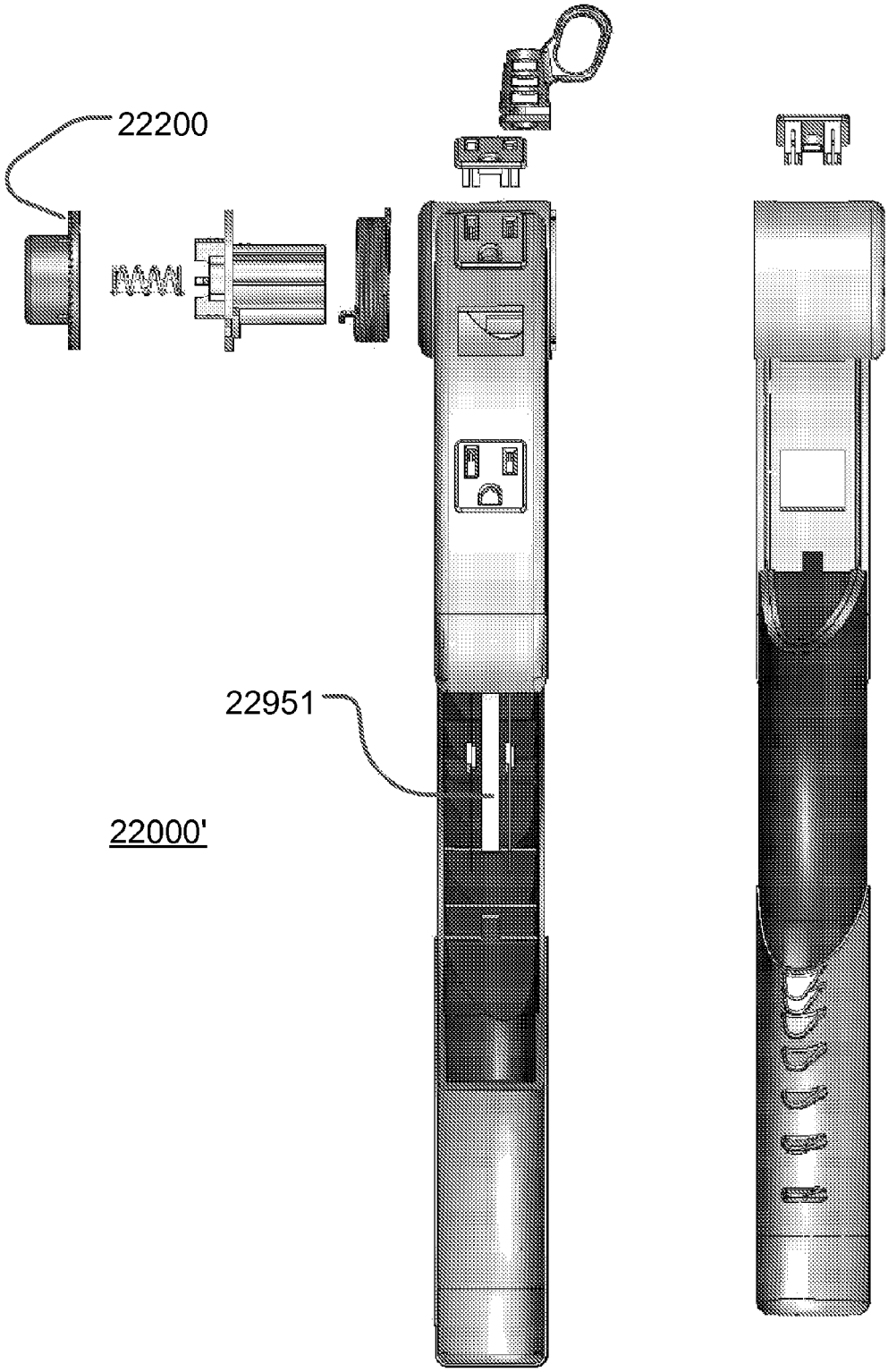

FIGS. 75-76 illustrate an exploded view of a subset of components of the ratcheting and coupling assemblies of the power strip 22000.

FIGS. 77-81 illustrate an exploded view of the power strip 22000' (wherein electrical and ground strips are shown in the drawings only for one of the arm sections and have been omitted in the drawings from the other arm section, and wherein the wires and screw/bolt fasteners also have been omitted from the drawings, all for clarity of illustration).

Figure 82:
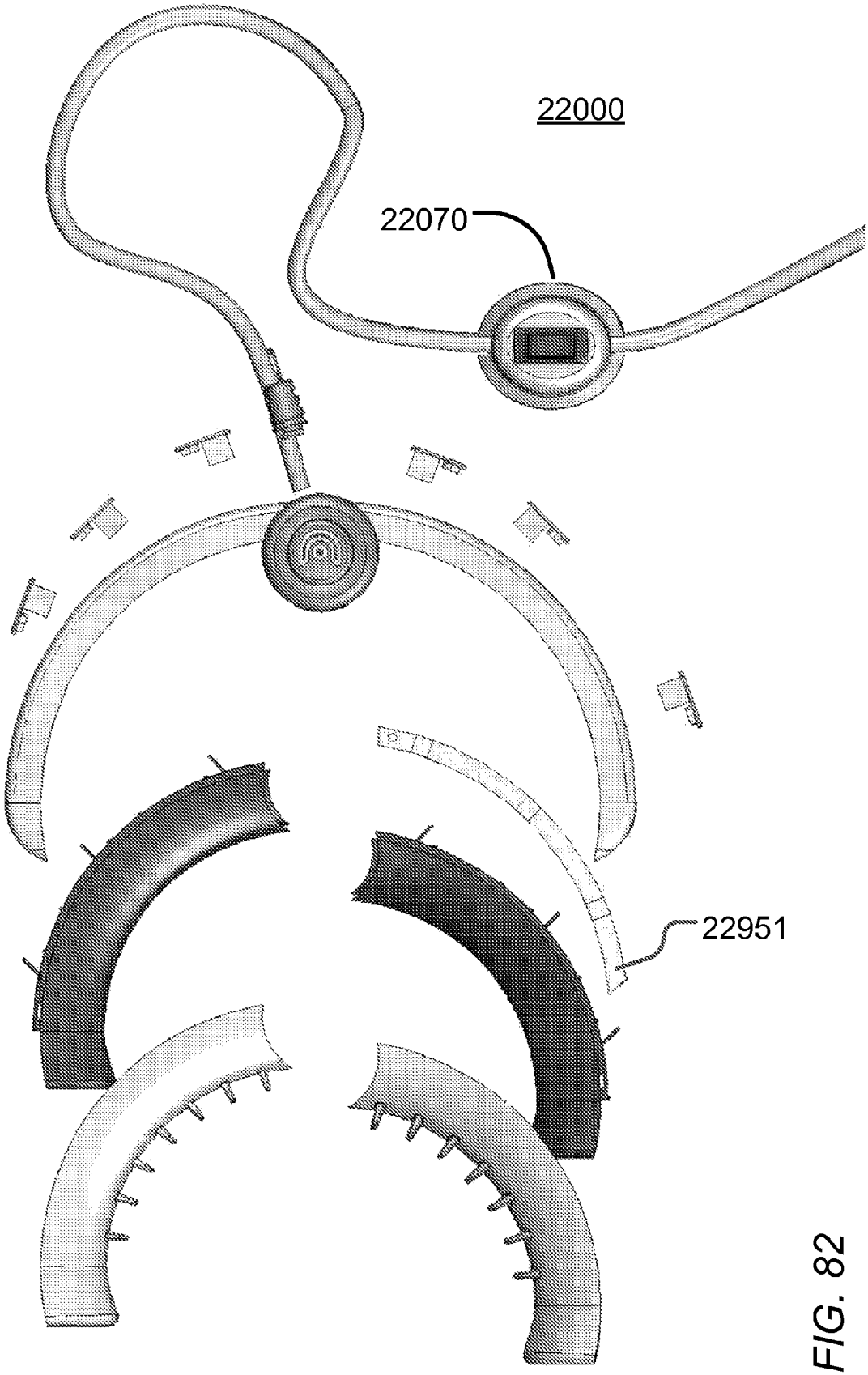
Figure 83:
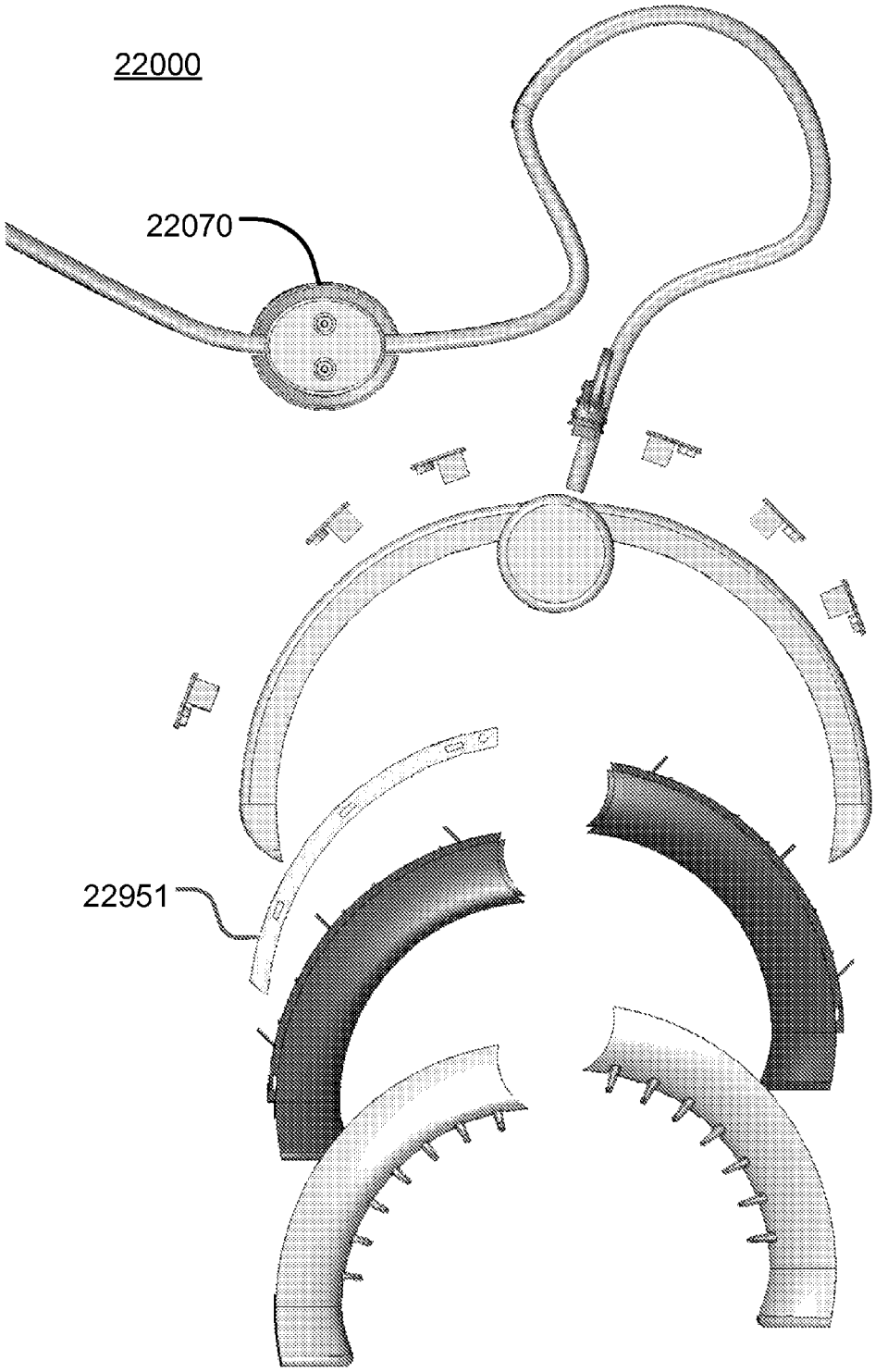

FIGS. 82-83 illustrate similar exploded views of the power strip 22000.

Figure 84:
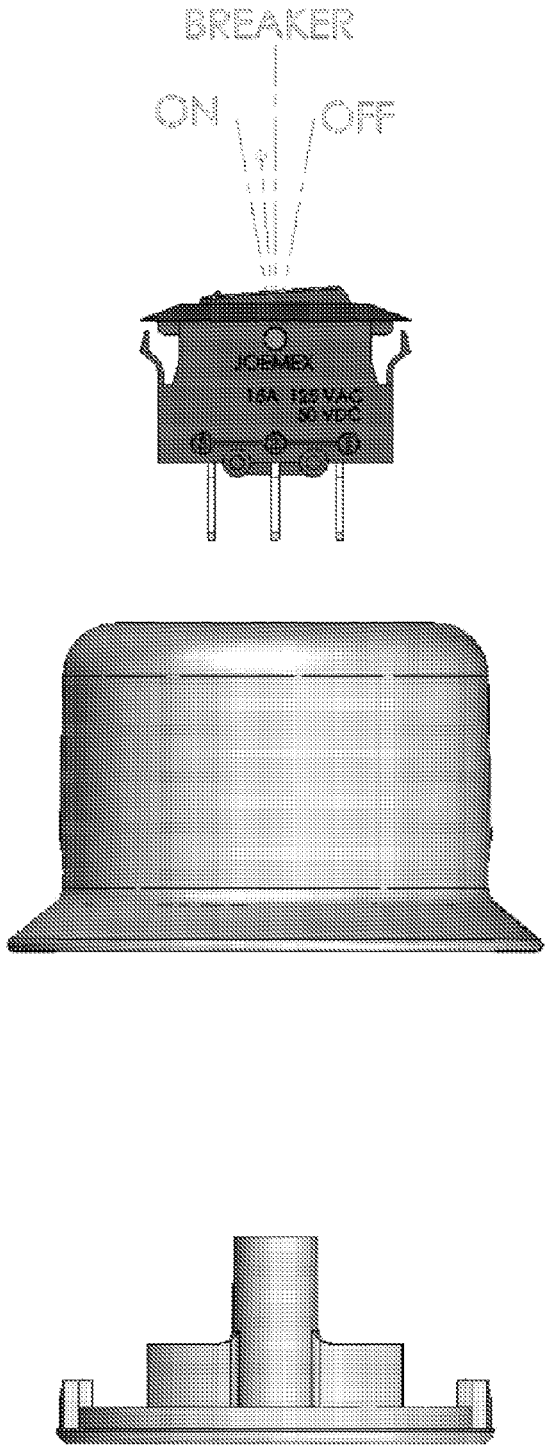

FIG. 84 illustrates an exploded view of the floor switch of the power strip 22000.

Figure 85:
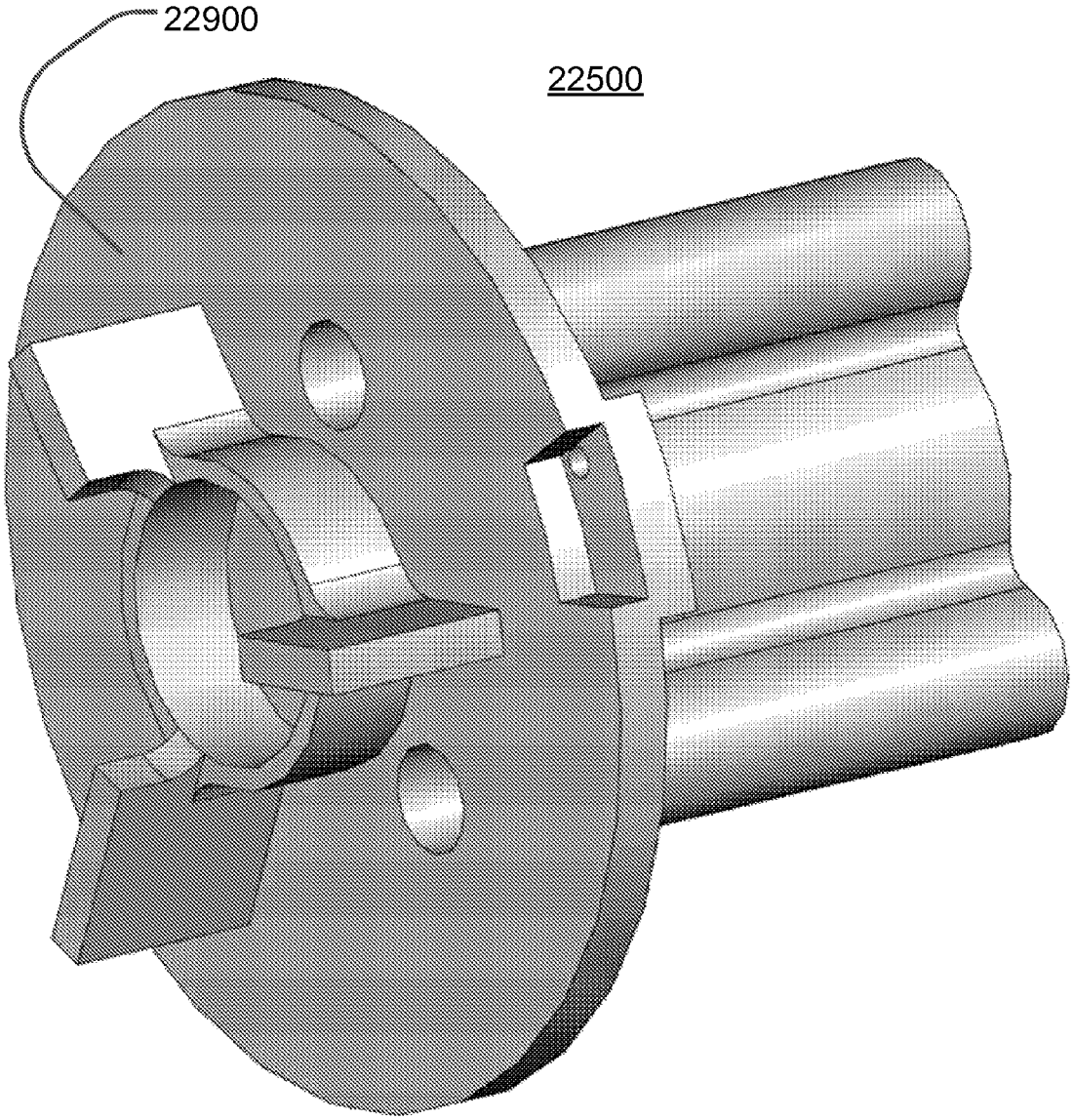
Figure 86:
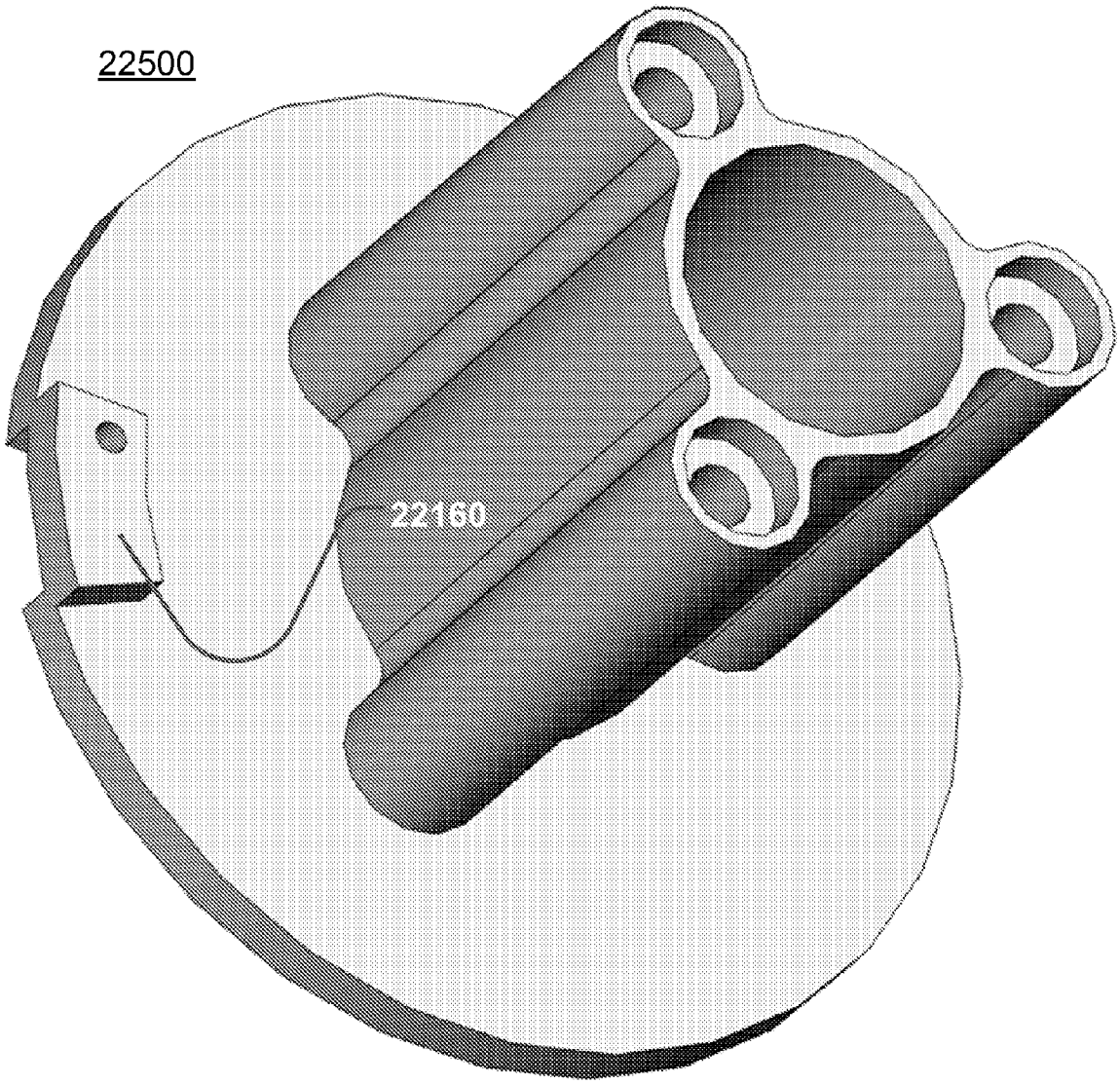
Figure 87:
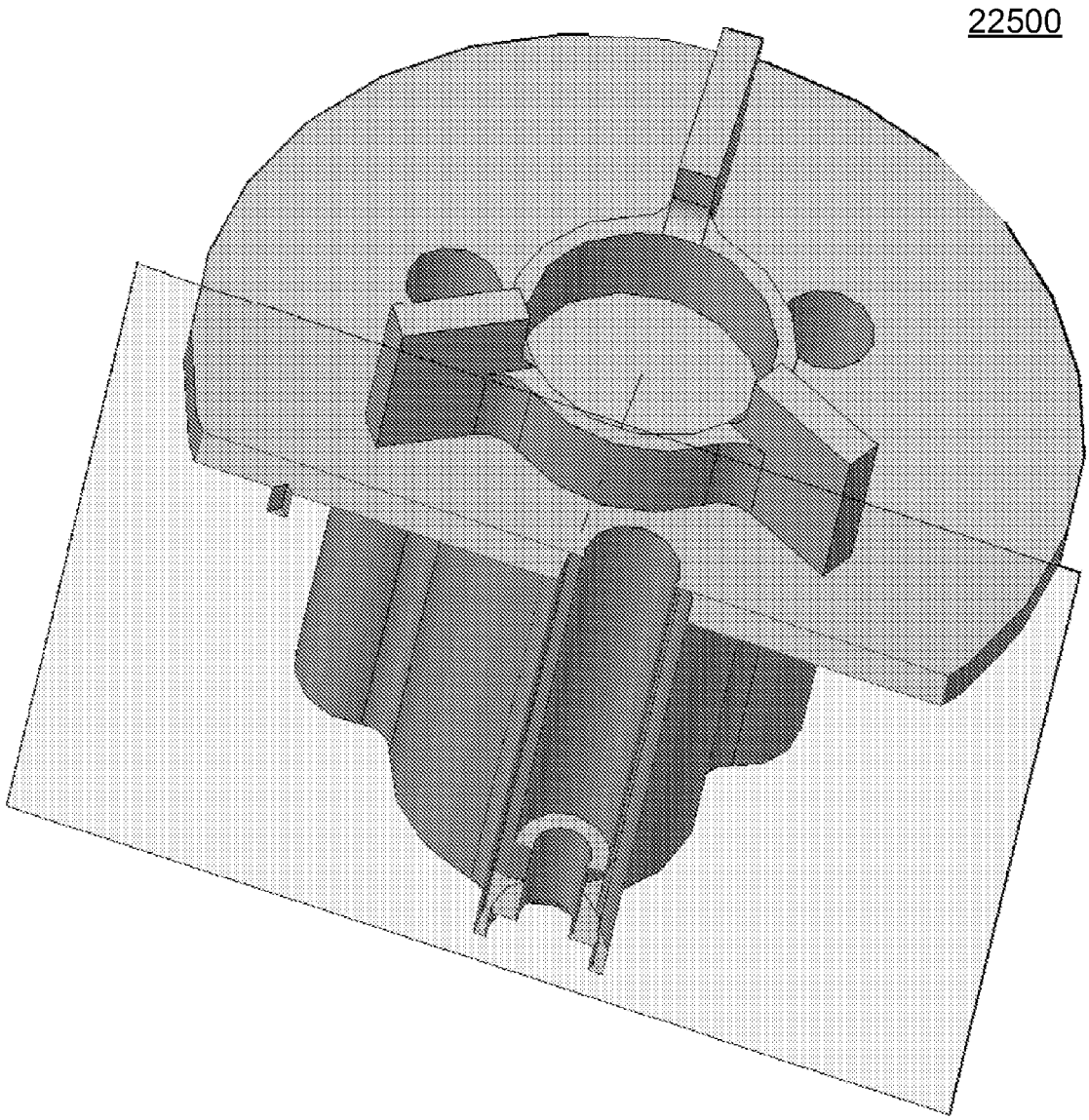

FIGS. 85-86 illustrate a connector or connecting member 22500 of the power strip 22000 that joins the two arm section together for rotational movement relative to each other about an axis extending through the connector or connecting member 22500, and FIG. 87 illustrates the connector or connecting member 22500 of FIGS. 85-86 in cross-section taken along the plane shown in FIG. 87.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. An apparatus having electrical receptacles and structure that facilitates the attachment of the apparatus to an object, comprising:

(a) a plurality of arm sections, at least one of the plurality of arm sections including a plurality of electrical receptacles that are positioned adjacent each other along an extent of the respective arm section to define a row or "strip" of electrical receptacles;

(b) a coupling assembly configured to couple the arm sections together such that a first arm section is coupled to a second arm section for rotational movement about an axis relative to the second arm section, wherein the coupling assembly comprises a connecting portion of the first arm section that is received within the second arm section in abutting engagement with the second arm section such that the second arm section is retained to the first arm section, the abutment of the connecting portion with the second arm section serving to retain the first and second arm sections to one another for relative rotational movement about the rotational axis while precluding relative axial movement along the axis; and (c) a ratcheting assembly configured to define degrees of relative rotational movement about the axis between the first arm section and the second arm section.

2. The apparatus of claim 1, wherein the ratcheting assembly is further configured to selectively permit rotational movement of the first arm section and the second arm section through defined increments of rotational movement toward one another, while inhibiting rotational movement of the first arm section and the second arm section away from one another.

3. The apparatus of claim 2, wherein the ratcheting assembly is configured to selectively permit rotational movement of the first arm section and the second arm section away from one another.

4. The apparatus of claim 3, further comprising a biasing member configured to urge the first arm section and the second arm section rotationally away from one another.

5. The apparatus of claim 4, wherein the first arm section comprises a first stop and the second arm section comprises a second, corresponding stop, the first stop and the second stop configured to move into abutting engagement with each other for limiting the extent to which the first arm section and the second arm section are rotatable away from each other about the axis.

6. The apparatus of claim 1, wherein the first arm section comprises a first stop and the second arm section comprises a second, corresponding stop, the first stop and the second stop configured to move into abutting engagement with each other for limiting the extent to which the first arm section and the second arm section are rotatable away from one another about the axis.

7. The apparatus of claim 1, wherein each of the arm sections includes a rigid, arcuate portion that is formed from a hard material through one or more molding processes.

8. The apparatus of claim 1, wherein each arm section includes an outer resilient portion that is elastic and capable of resuming its prior shape after deformation.

9. The apparatus of claim 8, wherein the resilient portion of each arm section comprises an over molded portion having resilient protuberances for tensioned gripping, the tensioned gripping resulting from compression of the resilient protuberances that occurs when the arm sections are forced into a closed position about an object upon which the apparatus is to be mounted.

10. The apparatus of claim 1, wherein the connecting portion of the first arm section comprises a connecting member that is secured to a body of the first arm section in fixed disposition relative thereto.

11. The apparatus of claim 1, wherein the connecting portion of the first arm section comprises a fastener that is secured to a body of the first arm section in fixed disposition relative thereto.

12. An apparatus having electrical receptacles and structure that facilitates the attachment of the apparatus to an object, comprising:

(a) a plurality of arm sections, at least one of the plurality of arm sections including a plurality of electrical receptacles that are positioned adjacent each other along an extent of the respective arm section to define a row or "strip" of electrical receptacles;

(b) a coupling assembly configured to couple the arm sections together such that a first arm section is coupled to a second arm section for rotational movement about an axis relative to the second arm section, wherein the coupling assembly comprises a connecting portion of the first arm section that is received within the second arm section in abutting engagement with the second arm section such that the second arm section is retained to the first arm section, the abutment of the connecting portion with the second arm section serving to retain the first and second arm sections to one another for relative rotational movement about the rotational axis while precluding relative axial movement along the axis; and (c) a ratcheting assembly configured to, (i) define degrees of relative rotational movement about the axis between the first arm section and the second arm section, and (ii) selectively permit rotational movement of the first arm section and the second arm section through defined increments of rotational movement toward one another, while inhibiting rotational movement of the first arm section and the second arm section away from one another;

(d) wherein each arm section includes an outer resilient portion that is elastic and capable of resuming its prior shape after deformation, the resilient portion of each arm section comprising an over molded portion having resilient protuberances for tensioned gripping, the tensioned gripping resulting from compression of the resilient protuberances that occurs when the arm sections are forced into a closed position about an object upon which the apparatus is to be mounted.

13. The apparatus of claim 12, further comprising a biasing member configured to urge the first arm section and the second arm section rotationally away from one another.

14. The apparatus of claim 12, wherein each of the arm sections includes electrical receptacles positioned adjacent each other along an extent of the respective arm section to define a row or "strip" of electrical receptacles, the extent of the respective arm section being curved.

15. The apparatus of claim 12, wherein the connecting portion of the first arm section comprises a connecting member that is secured to a body of the first arm section in fixed disposition relative thereto.

16. The apparatus of claim 12, wherein the connecting portion of the first arm section comprises a fastener that is secured to a body of the first arm section in fixed disposition relative thereto.

17. An apparatus having electrical receptacles and structure that facilitates the attachment of the apparatus to an object, comprising:

(a) a plurality of arm sections, at least one of the plurality of arm sections including a plurality of electrical receptacles that are positioned adjacent each other along an extent of the respective arm section to define a row or "strip" of electrical receptacles;

(b) a coupling assembly configured to couple the arm sections together such that a first arm section is coupled to a second arm section for rotational movement about an axis relative to the second arm section, wherein the coupling assembly comprises a connecting portion of the first arm section that is received within the second arm section in abutting engagement with the second arm section such that the second arm section is retained to the first arm section, the abutment of the connecting portion with the second arm section serving to retain the first and second arm sections to one another for relative rotational movement about the rotational axis while precluding relative axial movement along the axis;

(c) a ratcheting assembly configured to, (i) define degrees of relative rotational movement about the axis between the first arm section and the second arm section, and (ii) selectively permit rotational movement of the first arm section and the second arm section through defined increments of rotational movement toward one another, while inhibiting rotational movement of the first arm section and the second arm section away from one another; and (e) a biasing member configured to urge the first arm section and the second arm section rotationally away from one another;

(f) wherein the first arm section comprises a first stop and the second arm section comprises a second, corresponding stop, the first stop and the second stop configured to move into abutting engagement with each other for limiting the extent to which the first arm section and the second arm section are rotatable away from one another.

18. The apparatus of claim 17, wherein the connecting portion of the first arm section comprises a connecting member that is secured to a body of the first arm section in fixed disposition relative thereto.

19. The apparatus of claim 17, wherein the connecting portion of the first arm section comprises a fastener that is secured to a body of the first arm section in fixed disposition relative thereto.

* * * * *